US006634426B2

(12) United States Patent
McCoy et al.

(10) Patent No.: US 6,634,426 B2
(45) Date of Patent: Oct. 21, 2003

(54) DETERMINATION OF PLUNGER LOCATION AND WELL PERFORMANCE PARAMETERS IN A BOREHOLE PLUNGER LIFT SYSTEM

(75) Inventors: James N. McCoy, 2210 Midwestern Pkwy., Wichita Falls, TX (US) 76308; Augusto L. Podio, Austin, TX (US); Dieter J. Becker, Wichita Falls, TX (US); Orvel Lynn Rowlan, Wichita Falls, TX (US)

(73) Assignee: James N. McCoy, Wichita Falls, TX (US)

( * ) Notice: Subject to any disclaimer, the term of this patent is extended or adjusted under 35 U.S.C. 154(b) by 0 days.

(21) Appl. No.: 09/999,024

(22) Filed: Oct. 31, 2001

(65) Prior Publication Data

US 2002/0084071 A1 Jul. 4, 2002

Related U.S. Application Data

(60) Provisional application No. 60/244,664, filed on Oct. 31, 2000.

(51) Int. Cl.[7] ..... E21B 47/00

(52) U.S. Cl. ..... 166/254.1; 166/250.15; 166/250.03; 166/372; 166/374; 166/64; 166/68; 417/508; 137/487; 137/624.2

(58) Field of Search ..... 166/250.15, 250.03, 166/370, 372, 374, 53, 64, 65.1, 68, 369, 373, 66, 254.1; 417/507, 508; 137/624.19, 624.2, 487

(56) References Cited

U.S. PATENT DOCUMENTS 3,991,825 A * 11/1976 Morgan
4,036,297 A * 7/1977 Swihart
4,150,721 A 4/1979 Norwood ..... 166/53
4,417,858 A 11/1983 Stout ..... 417/58
4,526,228 A 7/1985 Wynn ..... 166/53
4,664,602 A 5/1987 Gordon ..... 417/56

(List continued on next page.)

OTHER PUBLICATIONS

Wayne Westerman, "*Plunger Lift Evaluation for Oil Wells*", *Southwestern Petroleum Short Course*, Jan. 20, 1999, pp. 154–157.

(List continued on next page.)

*Primary Examiner*—Roger Schoeppel
(74) *Attorney, Agent, or Firm*—Sidley Austin Brown & Wood LLP

(57) ABSTRACT

Plunger lift operations are difficult to optimize due to lack of knowledge of tubing pressure, casing pressure, bottom-hole pressure, liquid accumulation in the tubing and location of the plunger. Monitoring the plunger position in the tubing helps the operator (or controller) to optimize the removal of liquids and gas from the well. The plunger position can be tracked from the surface by monitoring acoustic signals generated as the plunger falls down the tubing. When the plunger passes by a tubing collar recess, an acoustic pulse is generated that travels up the gas within the tubing. The acoustic pulses are monitored at the surface, and are converted to an electrical signal by a microphone. The signal is digitized, and the digitized data is stored in a computer. Software processes this data along with the tubing and casing pressure data to display plunger depth, plunger velocity and well pressures vs. time. Plunger arrival at the liquid level in the tubing and plunger arrival at the bottom of the tubing are identified on the time plots. Inflow performance is calculated. Software displays the data and analysis in several formats including a graphical representation of the well showing the tubing and casing pressures, plunger location, gas and liquid volumes and flow rates in the tubing and annulus, and inflow performance relationship at operator selected periodic intervals throughout the cycle. Several field cases are presented to show how this information is applied to optimization of plunger lift operations.

31 Claims, 40 Drawing Sheets

U.S. PATENT DOCUMENTS

| | | | | | |
|---|---|---|---|---|---|
| 4,934,186 | A | | 6/1990 | McCoy | 73/151 |
| 4,989,671 | A | * | 2/1991 | Lamp | |
| 5,117,399 | A | | 5/1992 | McCoy et al. | 367/99 |
| 5,146,991 | A | | 9/1992 | Rogers, Jr. | 166/369 |
| RE34,111 | E | | 10/1992 | Wynn | 166/53 |
| 5,200,894 | A | | 4/1993 | McCoy et al. | 364/422 |
| 5,285,388 | A | | 2/1994 | McCoy et al. | 364/422 |
| 5,571,002 | A | * | 11/1996 | Yokoi | |
| 5,634,522 | A | | 6/1997 | Hershberger | 166/372 |
| 5,735,346 | A | * | 4/1998 | Brewer | |
| 5,957,200 | A | | 9/1999 | Majek et al. | 166/250.15 |
| 5,984,013 | A | | 11/1999 | Giacomino et al. | 166/373 |
| 6,148,923 | A | | 11/2000 | Casey | 166/372 |
| 6,241,014 | B1 | | 6/2001 | Majek et al. | 166/53 |

OTHER PUBLICATIONS

Doug Nay et al., "*Utilizing New Casing Plunger Design in Completions Equipped with 4.50" OD Casing and with Multiple Perforations, Southwestern Petroleum Short Course*, (1998) pp. 8–12.

J. F. Lea, "*Nodal Analysis of Plunger Lift Operations", Southwestern Petroleum Short Course*, (1998) pp. 67–83.

Thomas A. Hill, III, "*Automating Plunger Lift Management", Southwestern Petroleum Short Course*, (1997) pp. 81–84.

Dan Phillips et al., "*Training/Troubleshooting Guide for Plunger Systems", Southwestern Petroleum Short Course*, (1997) pp. 173–185.

Sandro Gasbarri et al., "*A Dynamic Plunger Lift Model for Gas Wells",* Copyright 1997, *Society of Petroleum Engineers, Inc.,* 1997 SPE Production Operations Symposium, pp. 1–9 (Oklahoma City, Oklahoma, Mar. 9–11, 1997).

Brian Ary et al., "*Case Study of Plunger Lift Installations in the San Juan Basin", Southwestern Petroleum Short Course*, (1996) pp. 8–13.

J. O. A. Baruzzi et al., SPE 29455 "*Optimum Plunger Lift Operation*", Copyright 1995, *Society of Petroleum Engineers, Inc.,* Production Operations Symposium, pp. 117–131 (Oklahoma City, Oklahoma, Apr. 2–4, 1995).

Ali Hernandez et al., SPE 26556 "*Liquid Fall–Back Measurements in Intermittent Gas Lift with Plunger*", Copyright 1993, *Society of Petroleum Engineers, Inc.,* 68th Annual Technical Conferernce and Exhibition of Petroleum Engineers, pp. 429–438 (Houston, Texas, Oct. 3–6, 1993).

S. J. Morrow, Jr. et al., "*Increasing Production Using Microprocessors and Tacking Plunger–Lift Velocity", Southwestern Petroleum Short Course*, (1993) pp. 82–88.

Charlie McCoy et al., "*Plunger Lift An Economic Alternative to Sucker Rod Pumps", Southwestern Petroleum Short Course*, (1992) pp. 337–344.

L. Marcano et al., SPE 23682 "*Mechanistic Design of Conventional Plunger Lift Installations"*, Copyright 1992, *Society of Petroleum Engineers, Inc.,* Second Latin American Petroleum Engineering Conference, II LAPEC, of the Society of Petroleum Engineers, pp. 289–302 (Caracas, Venezuela, Mar. 8–11, 1992).

Charlie McCoy, "*Artificial Lifting with Plunger Lift Systems", Southwestern Petroleum Short Course*, (1991) pp. 356–365.

Paul L. Ferguson et al., "*Extending Economic Limits and Reducing Lifting Costs; Plungers Prove to be Long Term Solutions", Southwestern Petroleum Short Course*, (1988) pp. 233–241.

L. N. Mower et al., SPE 14344 "*Defining the Characteristics and Performance of Gas–Lift Plungers",* Copyright 1985, *Society of Petroleum Engineers*, 60th Annual Technical Conference and Exhibition of the Society of Petroleum Engineers, pp. 1–7 (5 attachments) (Las Vegas, Nevada, Sep. 22–25, 1985).

R. G. Turner et al., "*Analysis and Prediction of Minimum Flow Rate for the Continuous Removal of Liquids from Gas Wells", Journal of Petroleum Energy*, (Nov. 1969) pp. 1475–1482.

R. H. Caldwell, "*Plunger Lift Operations", National Supply Company*, Forth Worth, pp. 14–17 (No. date).

Noel Dean Rietman, "*Fluid Production by the Free–Travel Plunger Method in Low Pressure Gas Wells", The Shamrock Oil & Gas Company*, pp. 68–72 (No date).

James D. Hacksma, "*Predicting Plunger Lift Performance", Shell Oil Company*, pp. 109–118 (No date).

Stanley C. Brown, "*Predicting Plunger Performance", McMurry Oil Tools, Inc.* pp. 97–104 (No date).

Pat Trammel et al., "*Continuous Removal of Liquids From Gas Wells By Use of Gas Lift", Southwestern Petroleum Short Course*, pp. 139–146 (No date).

E. Beauregard et al., "*Introduction to Plunger Lift: Applications, Advantages and Limitations", Southwestern Petroleum Short Course*, pp. 294–302 (No date).

Paul L. Ferguson et al., "*Will Plunger Lift Work In My Well?", Southwestern Petroleum Short Course*, pp. 301–311 (No date).

James F. Lea et al., "*Defining The Characteristics And Performance of Gas Lift Plungers", Southwestern Petroleum Short Course*, pp. 393–420 (No date).

Jimmy Christian et al., "*Replacing Beam Pumping Units with Plunger Lift", Southern Petroleum Short Course*, pp. 69–76 (No date).

* cited by examiner

CONVERSELY THE DEPTH TO THE PLUNGER PASSING A COLLAR RECESS CAN BE CALCULATED BY DETERMINING $\Delta T_2$ BY $\square = \frac{\Delta T_2}{\phantom{x}} \times VEL$ FIG. 16 W1: DimockCP_min.1.SERIES_1
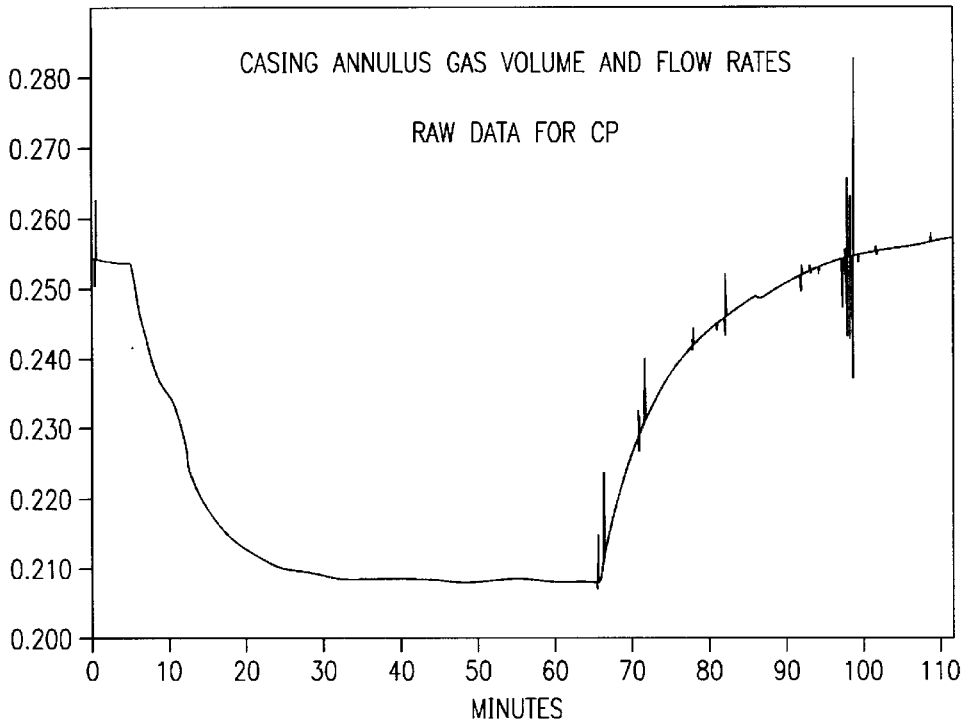
FIG. 17 W4: (W1*204.15)−6.9
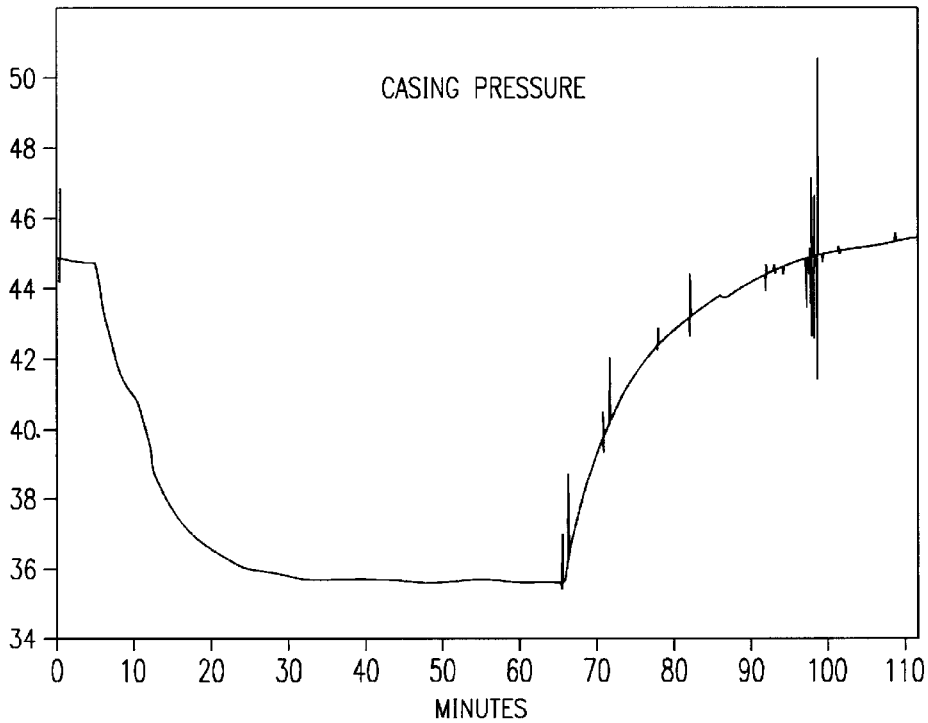

FIG. 18 W7: extract(W4,8365,162410)
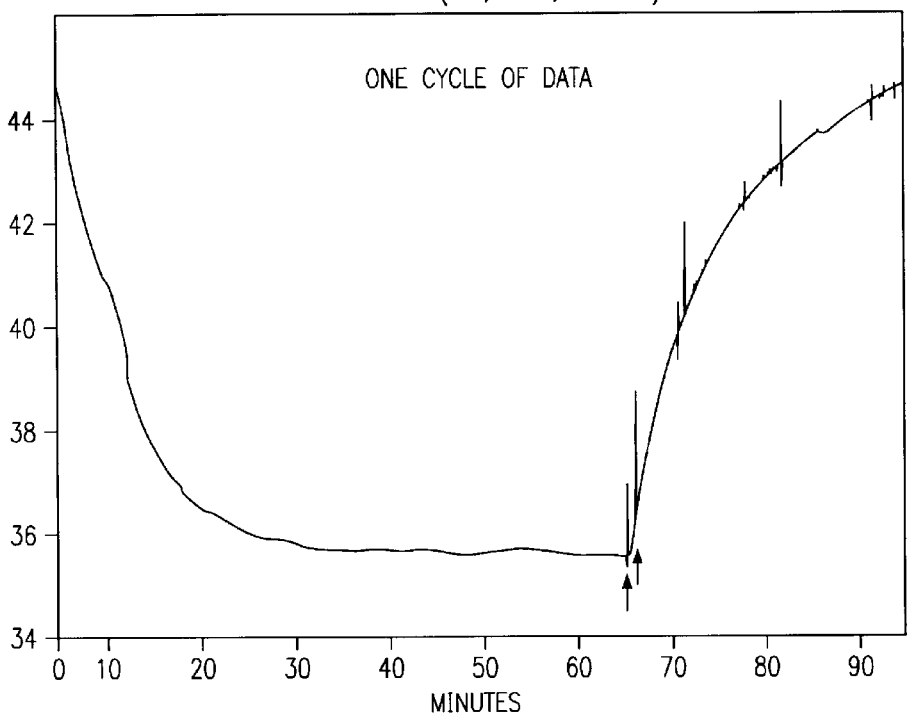
FIG. 19 W8: Movavg(w7,1800)
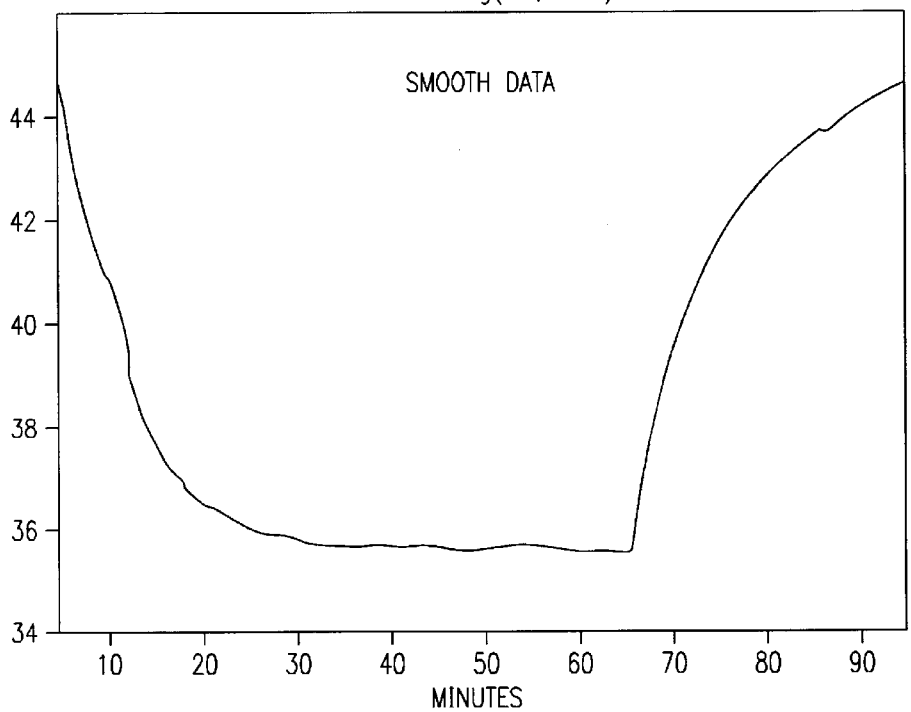

FIG. 20 W9: (W8/14.7)*5800*0.1062
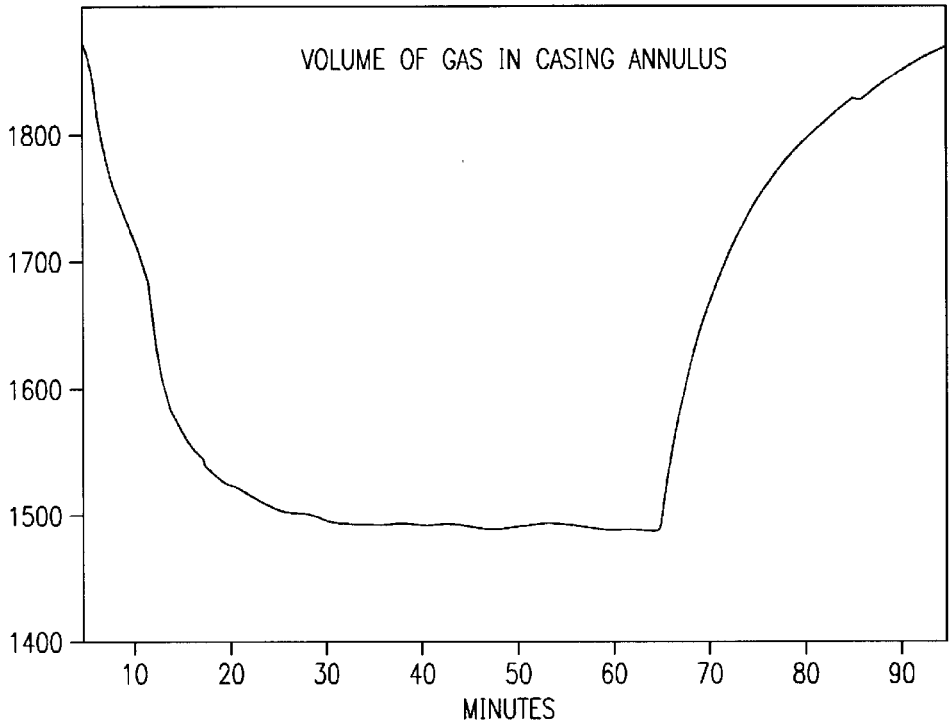
FIG. 21 W10: Deriv(w9)
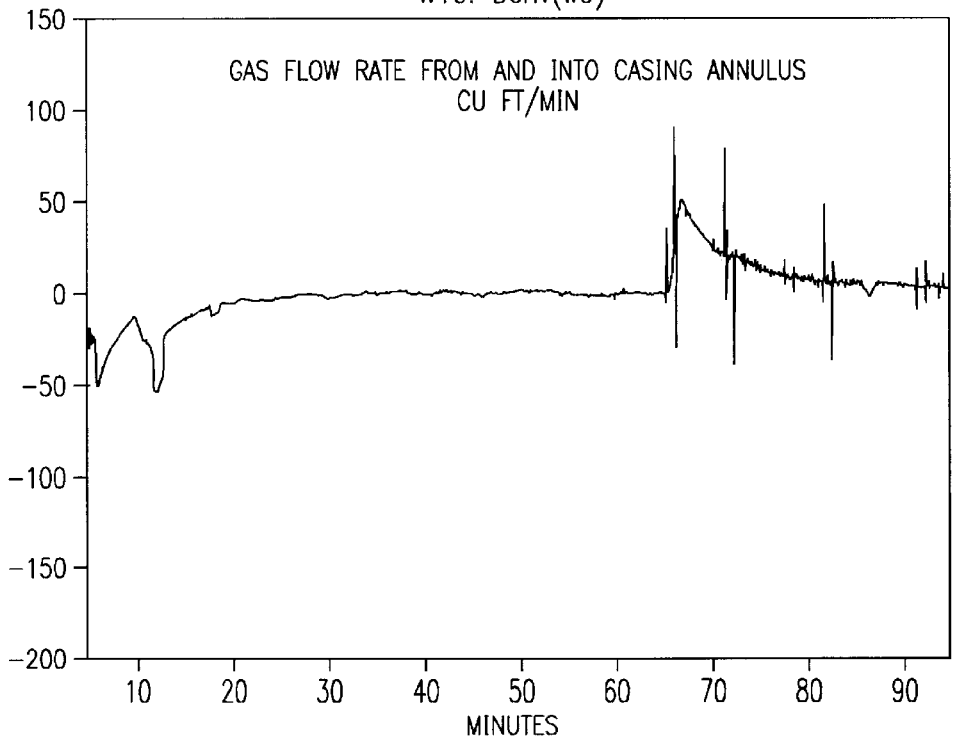

THIS DATA CAN BE USED TO SET AUTOMATIC CONTROLLER.
FOR SIMPLICITY, ALWAYS START PLOT WITH START OF SHUT-IN

THIS DATA CAN BE USED TO SET AUTOMATIC CONTROLLER. FOR SIMPLICITY, ALWAYS START PLOT WITH START OF SHUT-IN

DETERMINATION OF PLUNGER LOCATION AND WELL PERFORMANCE PARAMETERS IN A BOREHOLE PLUNGER LIFT SYSTEM

This application claims the benefit of Provisional Application No. 60/244,664, filed Oct. 31, 2000.

TECHNICAL FIELD OF THE INVENTION

The present invention pertains in general to the removal of fluid from a wellbore in the earth by the use of a plunger lift system and in particular to the determination of the location of the plunger in the wellbore together with well performance parameters.

BACKGROUND OF THE INVENTION

Plunger lift, the only artificial lift process that requires no assistance from outside energy sources, is ideally suited to a variety of downhole well conditions and applications. Two suppliers of equipment plungers are Weatherford Artificial Lift Systems and Ferguson Beauregard. Plunger lift systems consist of a plunger, often referred to as a piston, two bumper springs, a lubricator to sense and stop the plunger as it arrives at the surface, and a surface controller of which several types are available. Various ancillary and accessory components are used to complement and support various application needs.

In a typical plunger lift operation, the plunger cycles between the lower bumper spring located in the bottom section of the production tubing string and the upper bumper spring located in the surface lubricator on top of the wellhead. As the plunger travels to the surface, it creates a solid interface between the lifted gas below and produced fluid above to maximize lifting energy.

The plunger travels from the bottom of the well to the surface lubricator on the wellhead when the force of the lifting gas energy below the plunger is greater than the liquid load and gas pressure above the plunger. Any gas that bypasses the plunger during the lifting cycle flows up the production tubing and sweeps the area to minimize liquid fallback. The incrementation of the travel cycle is controlled by a surface controller and may be repeated as often as needed.

Plungers, a major component in a plunger lift system, are installed in the tubing string and provide a solid interface between the produced fluid column and lift gas. Weatherford and Ferguson Beauregard have various plunger designs available. Among these are lightweight brush types for low-pressure applications; solid plungers made of 4140 steel are available in different lengths, dependent on bottomhole pressure; plungers with spring-loaded pads that offer enhanced sealing against the tubing during upward travel; and for wells with high paraffin content, plungers with a spiral design. In addition, Weatherford supplies special application plungers for use in coil tubing and highly deviated wells.

Bumpers function as springs in plunger lift systems to absorb the impact of the plunger when it reaches the bottom of the well, and to prevent potential damage to downhole fishing-neck profiles. These subsurface bumpers seat in either a seating nipple, tubing stop or collar stop. Models available include low-cost, freestanding subsurface bumpers for use when a seating device exists in the well, and modular subsurface bumpers that accept several different bottom attachments, such as a hold-down device, cup seal, or standing valve.

Weatherford lubricators are used in plunger lift systems to sense and stop the plunger as it arrives at the surface. They have spring-loaded cushions to absorb the shock and prevent damage to the plunger. Two designs offered by Weatherford are a standard plunger lubricator that incorporates both the flowcross which attached the flowline to the tubing and the needle valve outlet, and a lubricator with the added features of a plunger trap and optional sensor. Both models are available in single or dual outlet configurations.

Various controllers control pneumatic-actuated valves for time-cycled intermittent gas lift, plunger lift, or a combination of both. Several models are offered with features to match the type of control needed for specific applications. Among these are low-cost timers with optional solar panels and rechargeable batteries, high-end controllers that feature input for variable flow time, and self-adjusting automatic time-cycle controllers.

A variety of plunger lift accessories and production enhancement components are available. Magnetic shutoff switches, flow tees, various types of packing elements, collar and tubing stops, standing valves, and seating nipples offer support enhancement to the entire system. Chokes, motor valves, drip pots and regulators, and solar panels complement and assist in maximizing production performance.

A plunger-lift system is a low-cost, efficient method of increasing and optimizing production in oil and gas wells, which have marginal flow characteristics.

Functionally, the plunger provides a mechanical interface between the produced liquids and gas. Using the well's own energy for lift, liquids are pushed to the surface by the movement of a free-travelling piston (plunger) traveling from the bottom of the well to the surface. This mechanical interface eliminates liquid fallback, thus boosting the well's lifting efficiency. In turn, the reaction of average flowing bottom hole pressure increases inflow.

Plunger travel is normally provided by formation gas stored in the casing annulus during a shut-in period. As the well is opened and the tubing pressure allowed to decrease, the stored casing gas moves around the end of the tubing and pushes the plunger to the surface. This intermittent operation is normally repeated several times per day. Plunger-lift is especially appropriate in these four applications:

Gas Wells—eliminates liquid loading. As production velocity drops, wells tend to be less efficient in carrying their own liquids to the surface. The introduction of a plunger in this type well reestablishes the original production decline curve, increasing the economic life of the well. At the same time, it generally reduced the volume of injection gas required.

High Ratio Oil Wells—Can increase the economic life of this type well. By producing the well in an intermittent fashion, the well's own energy can be used. The need for other, more costly, lifting options can be eliminated.

Intermittent Gas Lift Wells—Most intermittent gas-lift wells suffer from liquid fallback. This fallback tends to increase the average flowing bottom hole pressure, thus reducing production. With the plunger serving as a mechanical interface, liquids cannot fall back, but are all brought to the surface.

Paraffin and Hydrate Control—Most plungers have sealing elements that make contact with the inside walls of the tubing. As the plunger travels from the bottom of a well to the surface, the tubing is kept wiped clean, therefore eliminating the buildup or accumulation of paraffin, hydrates, scale and so forth.

Although automatic controllers are available for controlling the operation of plunger lift systems, namely opening and closing the flow line valve, the operation cannot be optimized unless the position of the plunger is known, particularly with respect to the engagement of the plunger with the fluid in the well and critical well performance parameters are determined.

SUMMARY OF THE INVENTION

One embodiment of the present invention is a method for determining the depth of a plunger positioned in a tubing string which is located in a wellbore. The interior of the tubing string is acoustically monitored to detect sounds produced by the plunger as it passes tubing collar recesses. The number of the sounds are counted as the plunger passes the recesses. A determination of depth of the plunger in the tubing string is calculated as a function of the number of the sounds which have been counted and the length of tubing joints in the tubing string.

A further embodiment is a method for determining the position of a plunger which is positioned in a tubing string that is located in a well bore, with respect to the fluid in the wellbore. The interior of the tubing string is acoustically monitored to produce a monitored signal as the plunger descends through the tubing string. An acoustic amplitude of the signal is determined over a moving period of time and the present valve of the acoustic amplitude is compared with one or more previous values of the acoustic amplitude to determine when the present value is less than the previous values by a predetermined amount. An indicator is generated to show that the plunger has reached the fluid when it has been determined that the present value of the acoustic amplitude is less than one or more of the previous values of the acoustic amplitude by the predetermined amount.

A further embodiment is a method for determining the position of a plunger, which is positioned in a tubing string that is located in wellbore, with respect to fluid in the wellbore. Gas pressure in the tubing string is monitored at the surface of the wellbore as the plunger descends through the tubing string toward the fluid in the wellbore. Changes in the pressure are detected. A determination is made when the pressure has increased by a predetermined amount within a predetermined time. An indicator is generated to show that the plunger has reached the fluid when it has been determined that the pressure has increased by said predetermined amount within said predetermined time.

A further embodiment is a method for determining the depth from the surface of a wellbore of a plunger positioned in a tubing string which is located in the wellbore. The interior of a tubing string is acoustically monitored at the wellbore surface to detect the sound produced by the plunger as it passes a tubing collar recess, wherein the sound travels from the plunger to the wellbore surface and is received in a first occurrence and the sound reflects from the upper end of the tubing and travels back to the plunger, and the sound reflects from the plunger and travels to the wellhead surface and is received in a second occurrence. The distance from the wellbore surface to the plunger is determined as a function of the time difference and acoustic velocity of the sound in the gas.

A further embodiment is a method for determining the depth of a plunger in a tubing string which is located in a wellbore. Gas pressure in the tubing string is monitored to produce a pressure signal as the plunger descends downward from the upper end of the tubing string. The plunger causes variations in gas pressure within the tubing string as the plunger passes tubing collar recesses in the tubing string. Variations in tubing gas pressure are counted as they are produced by the plunger in the pressure signal. The depth of the plunger is determined in the tubing string is a function of the counted number of variations in tubing gas pressure and the length of the tubing joints in the tubing string.

A further method of the present invention is determining the depth of a plunger in a tubing string which is located in a wellbore. The gas pressure in the tubing string is sampled to produce a pressure signal as the plunger descends downward from the upper end of the tubing string. The plunger causes variations in gas pressure within the tubing string as the plunger passes tubing collar recesses in the tubing string. The gas pressure is sampled at a rate such that a plurality of samples are collected during the time in which the acoustic pulse from a plunger passing a collar recess. The variations in tubing gas pressure are counted in the pressure signal and these variations are produced by the plunger. The depth of the plunger in the tubing string is determined as a function of the counted number of variations in the tubing gas pressure and the length of tubing joints in the tubing string.

A further method of the present invention is determining the depth of a plunger in a tubing string which is located in a wellbore. Gas pressure is sampled in the tubing string to produce a pressure signal as the plunger descends downward from the upper end of the tubing string. The plunger causes variations in gas pressure within the tubing string as the plunger passes tubing collar recesses in the tubing string. The gas pressure is sampled at a rate sufficiently fast to capture in the pressure signal the variations in gas pressure produced as the plunger passes tubing collar recesses in the tubing string. The variations in tubing gas pressure are counted in the pressure signal and the depth of the plunger in the tubing string is determined as a function of the counted number of variations in tubing gas pressure and the length of tubing joints in the tubing string.

A further method of the present invention is determining when a plunger in a tubing string, which is located in a borehole, reaches fluid at the lower end of the tubing string. The interior of the tubing string is acoustically monitored to detect a sound produced by said plunger as it passes each of a plurality of tubing collar recesses in the tubing string. A determination is made when a predetermined period of time has passed without receiving one of the sounds produced by the plunger as it passes said collar recesses. An indicator is generated to show that the plunger has reached the fluid when the predetermined period of time has passed without receiving one of the sounds produced by said plunger as it passes said collar recesses.

A further method of the present invention is determining when a plunger in the tubing string, which is located in a borehole, reaches fluid at the lower end of the tubing string. Gas pressure in the interior of the tubing string is monitored to produce a pressure signal as the plunger descends downward from the upper end of the tubing string. The plunger causes variations in gas pressure within the tubing string as the plunger passes tubing collar recesses in the tubing string. A determination is made when a predetermined period of time has passed without receiving one of the pressure variations produced by the plunger as it passes the collar recesses. An indicator is generated to show that the plunger has reached the fluid when the predetermined period of time has passed without receiving one of the pressure variations produced by the plunger as it passes the collar recesses.

A further embodiment of the present invention is a method for producing a display for indicating performance of a plunger lift system for a wellbore which has a tubing string installed therein. A plunger is located in the tubing string. A schematic of a wellbore is produced on a display screen and the display includes a representation of the plunger in the tubing string. Gas pressure in the tubing string is monitored to produce a pressure signal which includes gas pressure variations caused by the plunger passing tubing collar recesses in the tubing string. The tubing gas pressure variations are counted in the pressure signal to produce a count number. The depth of the plunger in the tubing string is determined as a function of the count number in the tubing joint length for the tubing joints comprising the tubing string. The plunger representation in the wellbore schematic is positioned at the plurality of positions which are a function of the depths determined for the plunger in the tubing string.

A further embodiment of the present invention is a method for producing a display for indicating performance of a plunger lift system for a wellbore which has a tubing string installed therein. A plunger is located in the tubing string. A schematic of a wellbore is produced on the display screen and the display includes a representation of the plunger in the tubing string. The interior of the tubing string is acoustically monitored to detect sounds produced by the plunger as the plunger passes tubing collar recesses of the tubing string. Each sound is associated with one of the tubing collar recesses. A plurality of the sounds produced by the plunger are counted to produce a count number. A depth of the plunger is determined in the tubing string as a function of the count number and tubing joint length for tubing joints comprising the tubing string. The plunger representation is positioned is the wellbore schematic at a plurality of positions which are a function of the depths determined for the plunger in the tubing string.

A further embodiment of the present invention is a method for evaluating the production performance of a wellbore which has a plunger lift system in which a plunger is located within a tubing string which is positioned in the wellbore. The casing pressure of the borehole is monitored. The tubing pressure is monitored within the tubing string to produce a tubing pressure signal. One of more parameters relating to the production performance of the borehole is calculated wherein the parameters are based on the monitored casing pressure and the monitored tubing pressure. The depth of the plunger in the tubing string is determined based upon data in the tubing pressure signal.

A further aspect of the invention is developing an animation of a well schematic with the plunger and liquid slug moving in the tubing string as measured for position.

A further aspect is displaying of well production parameters to an operator along or in conjunction with well schematics.

BRIEF DESCRIPTION OF THE DRAWINGS

For a more complete understanding of the present invention and the advantages thereof, reference is now made to the following description taken in conjunction with the accompanying drawings in which:

FIG. 16 is a graph of casing pressure transducer aspect as a function of time, FIG. 17 is a graph of casing pressure as a function of time for a cycle of a plunger through the tubing, FIG. 18 is a graph of casing pressure as a function of time for one cycle of operation, FIG. 19 is a graph of smoothed graph of casing pressure as a function of time, FIG. 20 is a graph of volume of gas in a casing annulus as a function of time, FIG. 21 is a graph of gas flow rate from and into a casing annulus as a function of time (in units of cubic feet per minute)

DETAILED DESCRIPTION

The present invention is directed to the determination of the position of a plunger within a tubing string which is located within a borehole used for producing gas and liquid from the earth and produces parameters for optimizing production from a well.

Figure 1:
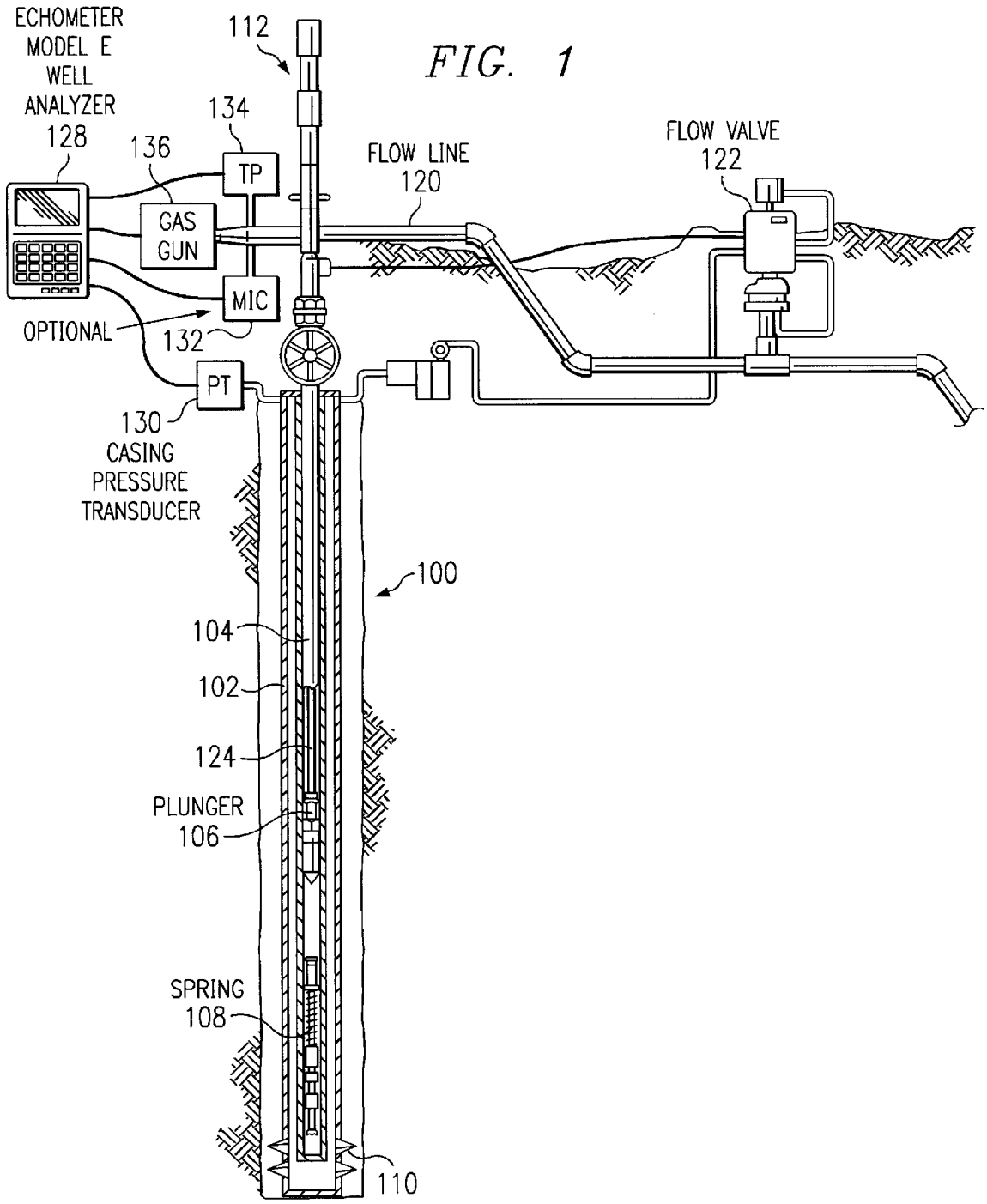
FIG. 1 is a elevation view of a wellbore including equipment for plunger lift operation and having a computerized well analyzer connected thereto with sensors for gas pressure and detection of acoustic signals.

Referring to FIG. 1, there is shown a borehole 100 which has an installed casing 102 and tubing 104 (also referred to as tubing string). The tubing string comprises a group of interconnected tubing joints. A plunger 106 is located within the tubing 104. A spring 108 is positioned within the lower end of the tubing 104 for stopping downward movement of the plunger 106. Gas and fluid enters into the casing through perforations 110. A lubricator-catcher 112 (holder) at the upper end of the tubing 104 holds the plunger 106 when it is driven upward by gas pressure. The tubing 104 is connected through a valve assembly to a flow line 120 which includes an electrically operated in-line flow valve 122. Liquid slug 124 is supported by the plunger 106 and is lifted to the surface of the wellbore by the plunger 106.

An Echometer Model E well analyzer 128 receives the output of a casing pressure transducer 130, the output of a microphone 132 which is connected such that it is exposed to the interior of the tubing 104 for picking up sounds. A tubing pressure transducer 134 measures the pressure within the tubing and provides a tubing pressure signal to the well analyzer 128. An optional gas gun 136 is connected to provide acoustic pulses to the interior of the tubing 104 under control of the well analyzer 128.

In operation, the plunger 106 is released from the catcher 112 of the tubing 104 and is pulled down by a gravity through the tubing string after the flow valve 122 has been closed. During the time that the flow valve 122 is closed, gas enters into the casing 102 through the perforations 110, thereby increasing the pressure of gas within the casing. Fluid also enters through the perforations 110 and passes into the casing annulus and the lower end of the tubing 104. When the plunger 106 reaches the fluid at the bottom of the tubing it enters the fluid and is then stopped by the spring 108. When the pressure of the gas within the tubing below the plunger 106 is at a sufficient level, the flow valve 122 is opened, thereby reducing the pressure above the plunger 106 and the liquid slug 124 above the plunger. The gas pressure within the casing extends into the tubing 104 below the plunger 106. The gas pressure is sufficiently high to force the plunger 106 with its load of fluid upward in the tubing 104. The plunger carries the fluid slug 124 upward until it reaches the surface of the wellbore and is then transferred through the flow line 120 and past the valve 122. The plunger 106 normally remains in the catcher 112 until the valve 122 is closed. The plunger 106 stops within the lubricator catcher 112.

After the plunger 106 is returned to the surface of the wellbore, the flow valve 122 is again closed to allow the plunger to descend and for gas pressure to build up within the casing. Thus, the pressure of the gas is used to lift the fluid from the well.

The production of fluid from the well can be optimized by knowing when the plunger has entered into the fluid at the bottom of the well. If the flow valve 122 is opened before the plunger 106 has reached the fluid, the plunger will be returned to the surface without carrying a column (slug) of fluid. If the plunger 106 is allowed to sit at the bottom of the well within the fluid for an excessive period of time, less fluid than possible will be removed from the well. Therefore, for optimum production of fluid from the well, it is necessary to know the position of the plunger within the tubing 104 and when it enters the fluid.

Figure 2:
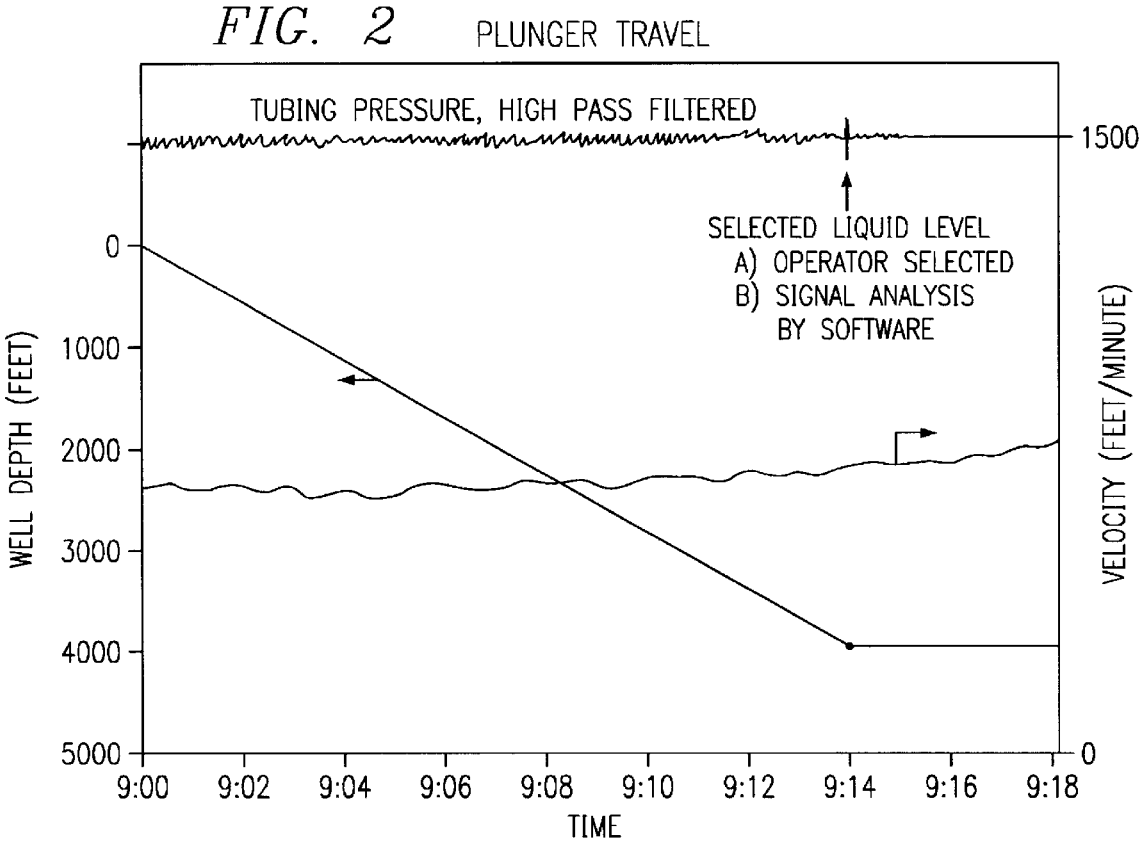
FIG. 2 is a graph illustrating the position of a plunger within a wellbore as a function of time, plunger velocity and a waveform representing an acoustic signal received from the tubing.

FIG. 2 illustrates the movement of the plunger down the tubing as a function of time with the plunger descending from the surface to approximately a depth of 4,000 feet in approximately 14 minutes. At the top of the graph there is shown a trace of tubing pressure that has been filtered, with an arrow indicating when the plunger entered into the fluid within the wellbore.

Figure 3:
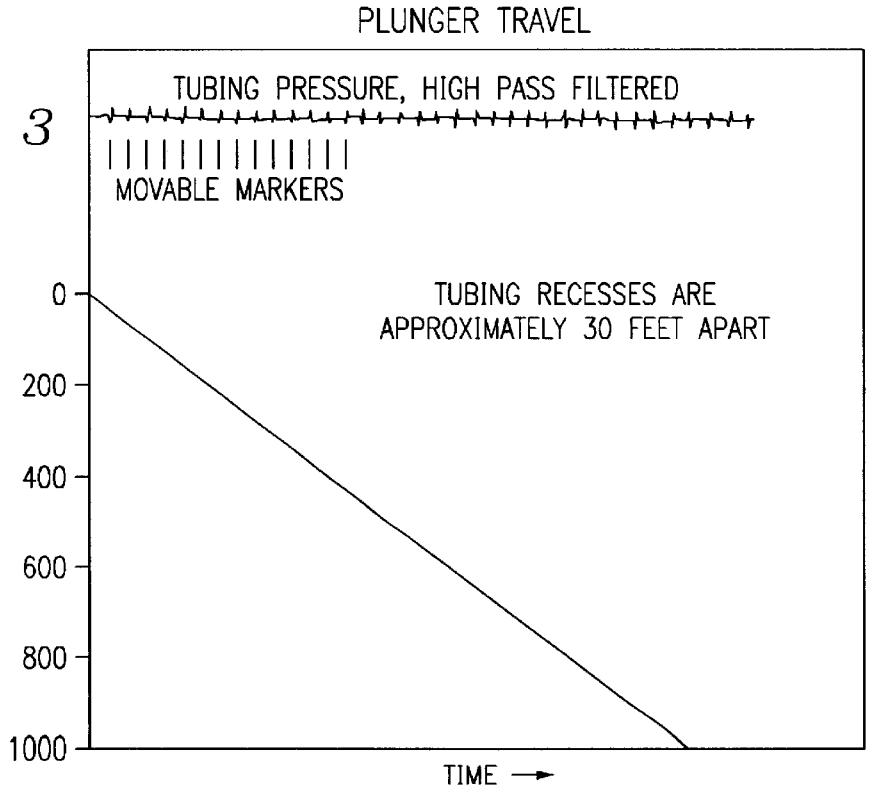
FIG. 3 is a graph illustrating the receipt of pressure pulses created by the movement of a plunger past tubing recesses in a wellbore shown as a function of time and position of the plunger within the wellbore.

FIG. 3 is an illustration of a graph of the position of the plunger 106 as it descends through the tubing and includes a monitoring of tubing pressure. Variations in the tubing gas pressure are caused as the plunger passes through recesses corresponding to the collars that connect the tubing joints. As the plunger passes each of the recesses there is a variation in tubing pressure which is indicated by the sudden variations in the pressure waveform. These variations for the pressure due to the collar recesses are indicated by vertical markers. The pressure changes due to gas leakage around the plunger when it is at the collar recess.

Figure 4:
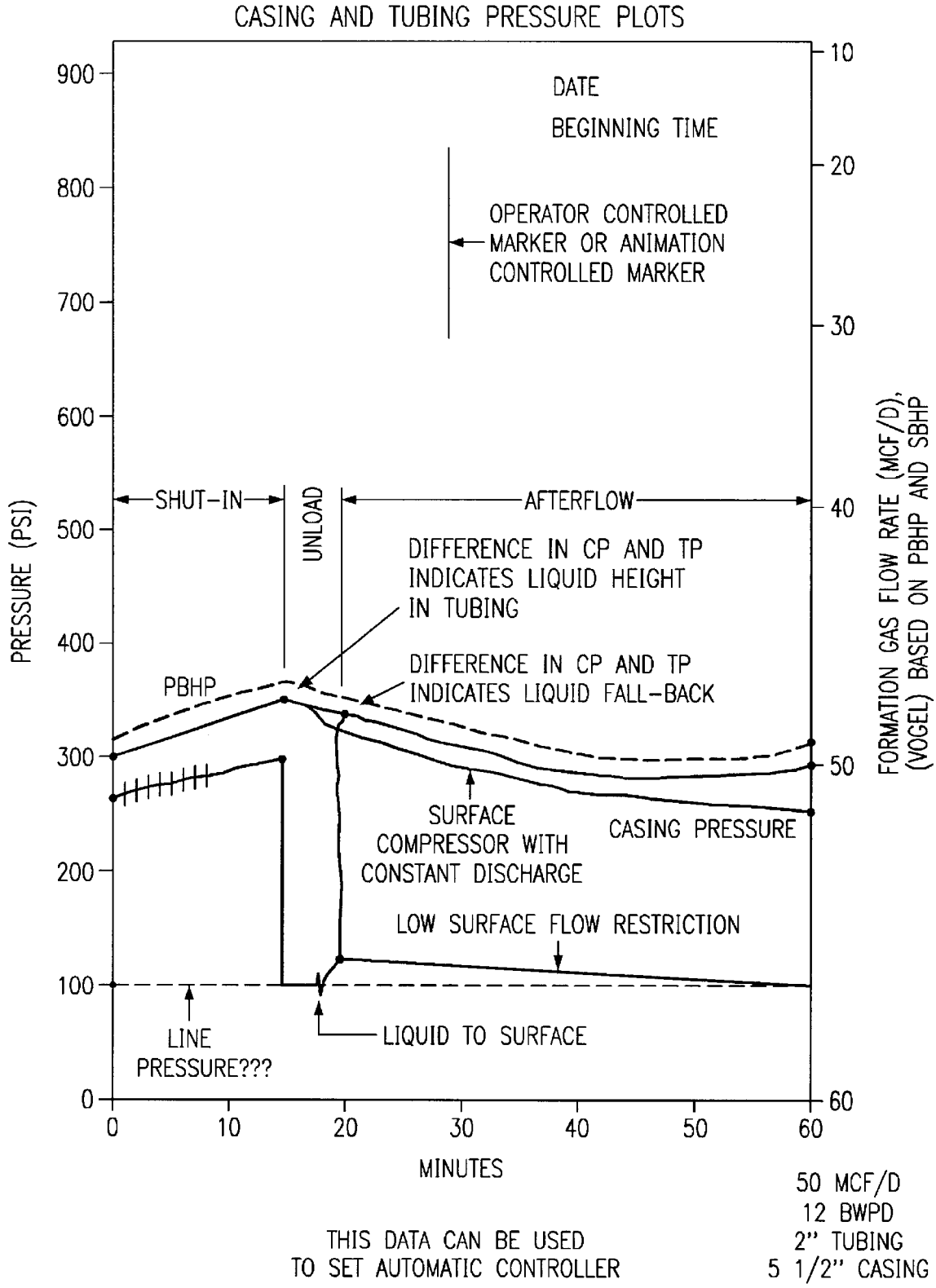
FIG. 4 is a graph having multiple parameters illustrating the three phases of a plunger lift operation as a function of time with corresponding tubing pressure, casing pressure and related parameters.
Figure 24:
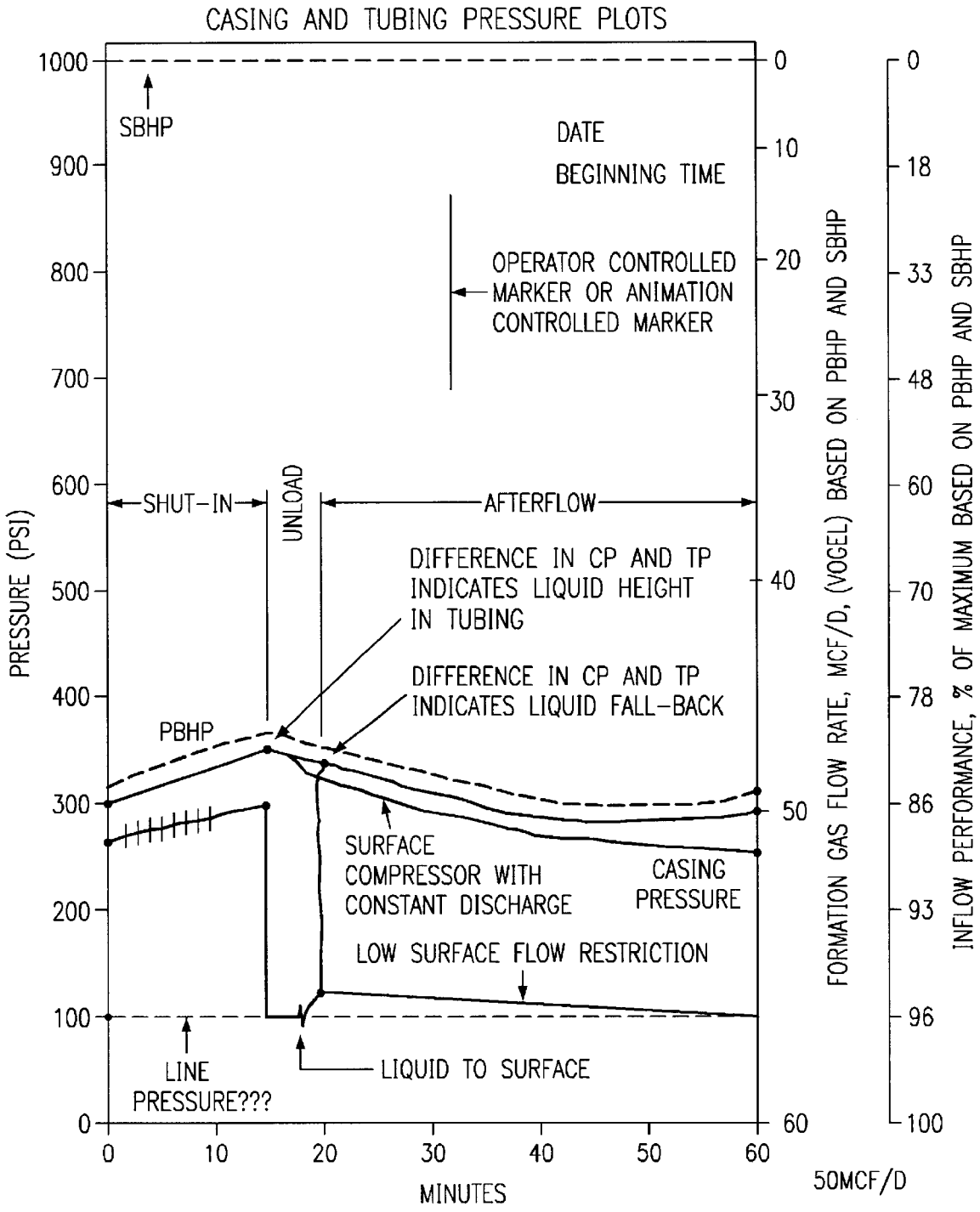
FIG. 24 is a graph having multiple parameters illustrating the three phases of plunger lift operation as a function of time with corresponding tubing pressure, casing pressure and related parameters.
Figure 25:
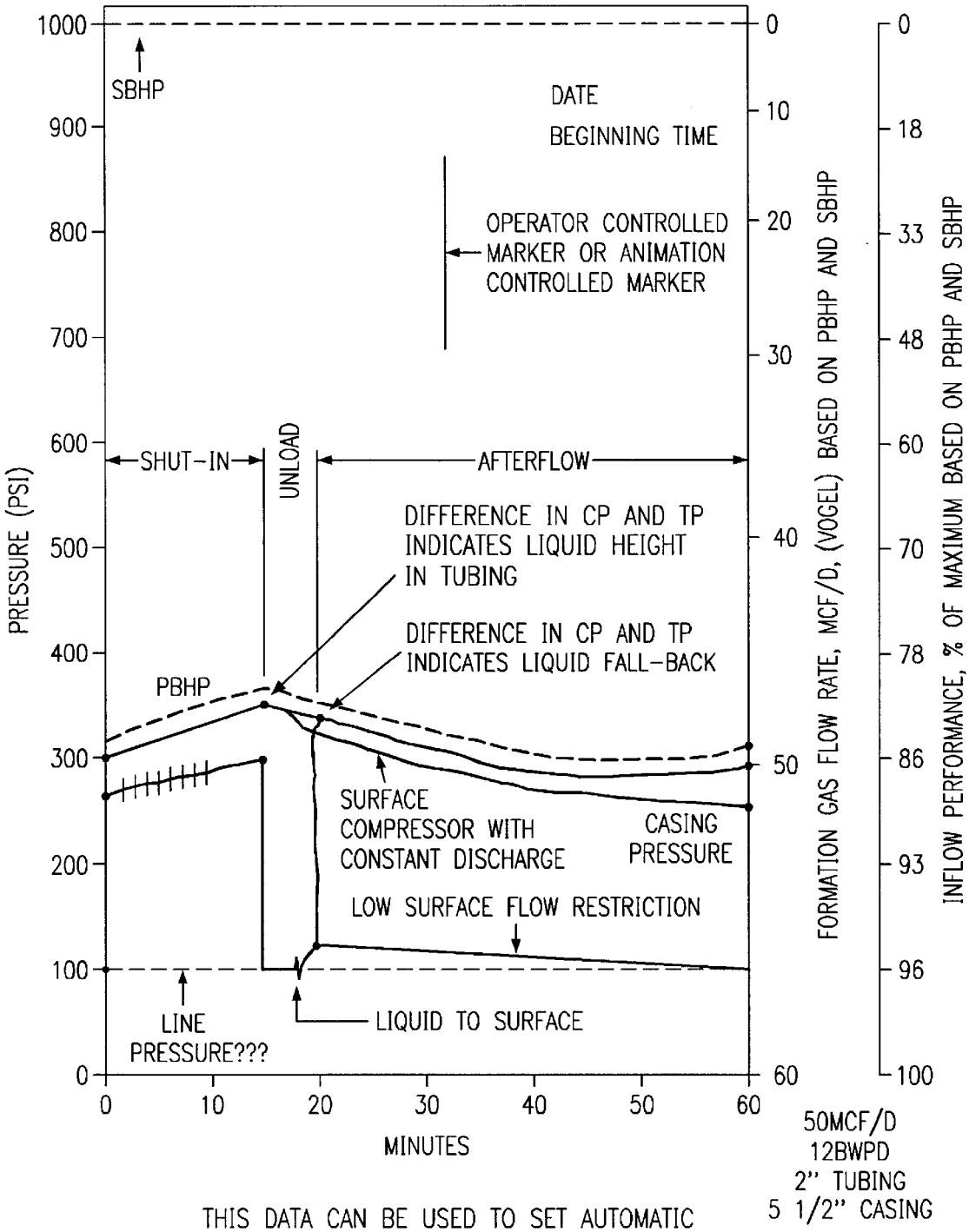
FIG. 25 is a graph having multiple parameters illustrating the three phases of a plunger lift operation as a function of time with corresponding tubing pressure, casing pressure and related parameters.

FIG. 4 and corresponding FIGS. 24 and 25 illustrate various parameters associated with the operation of the plunger lift system. The phases of the plunger lift are shut-in, unload and after flow. The flow valve 122, as shown in FIG. 1, is closed during the shut-in time period and is opened at the beginning of unload portion of the cycle. It remains open through the after flow. The plunger 106 arrives at the surface at the end of the unload period and the fluid slug is delivered during the unload period. During the after flow period gas is released from the tubing into the flow line 120. At the end of the after flow portion of the cycle, the process is begun again with the shut-in portion of the cycle.

The upper-line represents the producing bottom-hole pressure (PBHP). The next lower solid line represents the casing pressure. The difference between the casing pressure and tubing pressure at the end of the shut-in period indicates the liquid height in the tubing. The difference between the casing pressure and tubing pressuring during the after flow period indicates the liquid fall-back and friction. The measurement of the parameters shown in FIG. 4 can be used to set automatic controllers for operation of the plunger lift, in particular the operation of the flow valve 122.

Figure 5:
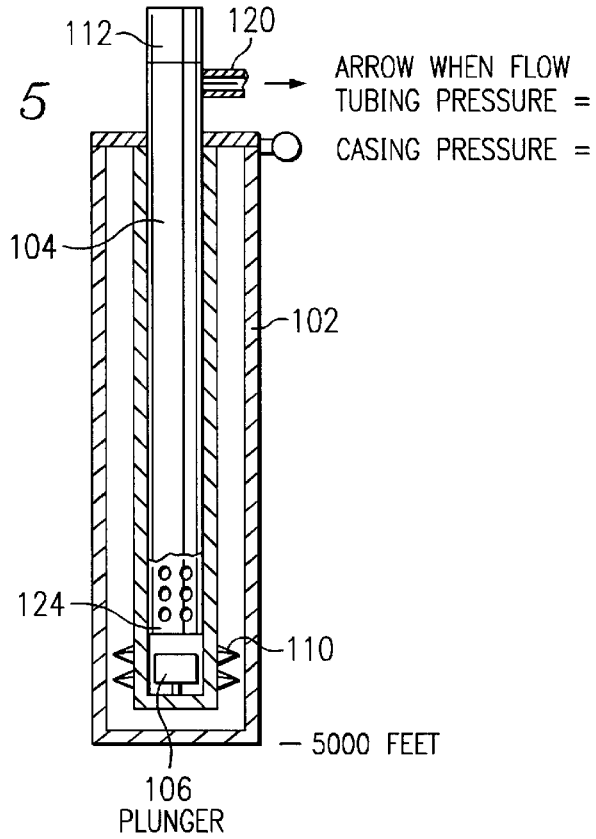
FIG. 5 is a schematic elevation view of a wellbore with a plunger and a liquid slug above the plunger.

FIG. 5 is a schematic illustration of a wellbore with the plunger at the bottom of the well immediately above casing perforations which allow fluid and gas to enter the tubing. This also illustrates that the depth of the well is 5,000 feet. Such an illustration can be displayed on a computer screen to illustrate to the operator the operations that are being carried out within the wellbore.

Figure 6:
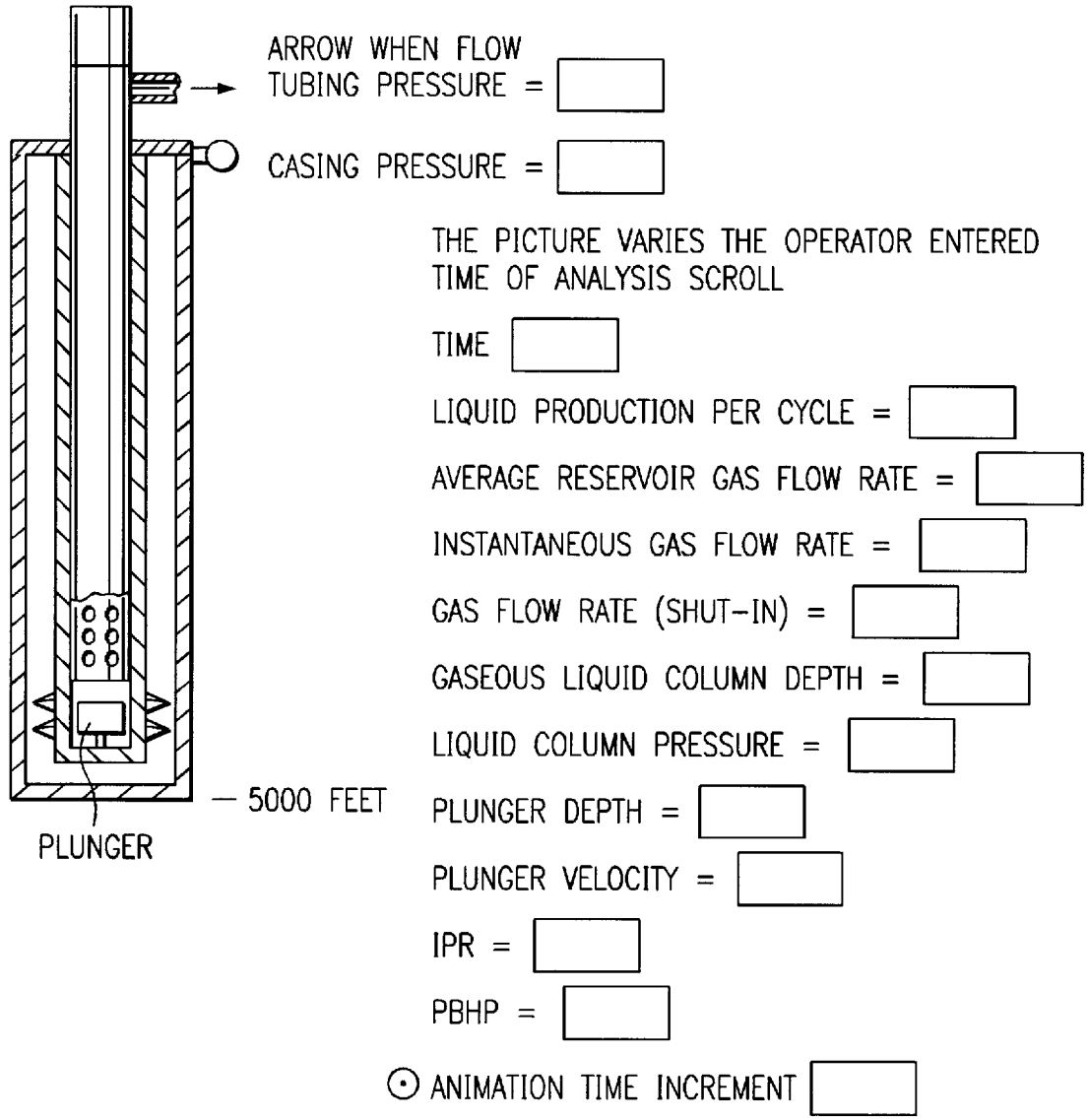
FIG. 6 is an illustration of a wellbore computer screen shot together with specific parameters related to the wellbore operation and illustrated as an animation with multiple positions of the plunger and liquid slug rising to the surface.

FIG. 6 is a further illustration of a computer generated schematic illustration of a wellbore having a plunger, liquid slug and further including parameters that are related with the specific well being evaluated. This provides the basis for an animation which has a time increment as noted at the lower portion of the figure. During the animation the plunger and fluid slug are progressively moved toward the upper end of the tubing as determined by continuous measurements of casing and tubing pressure. The parameters displayed on the screen shown in FIG. 6 include, but are not limited to, tubing pressure, casing pressure, time, liquid production per cycle, average reservoir gas flow rate, instantaneous gas flow rate, gas flow rate, gaseous liquid column depth, liquid column pressure, plunger depth, plunger velocity, IPR open (efficiency), producing bottom-hole pressure, and the animation time increment.

Figure 7:
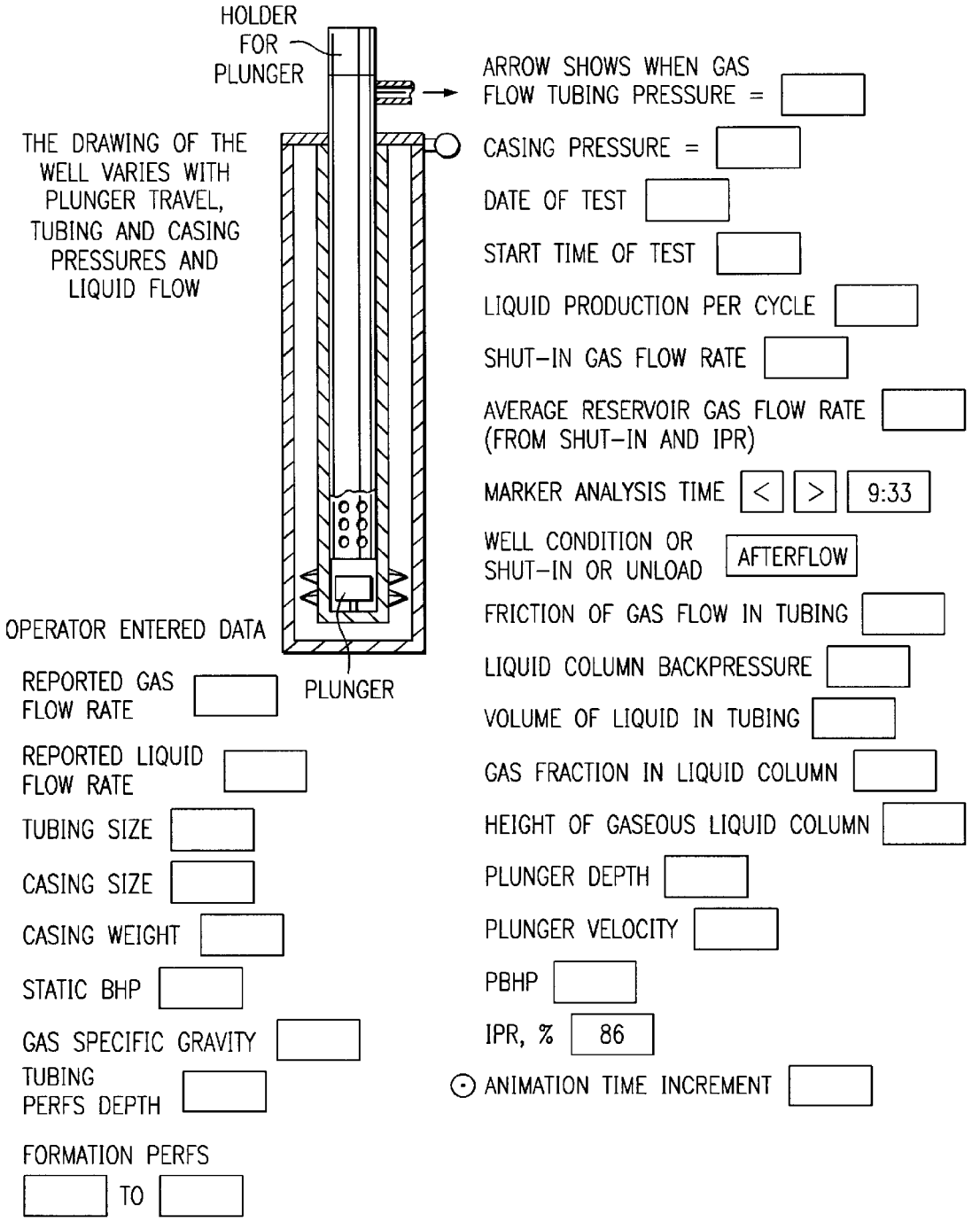
FIG. 7 is a further computer screen illustration of an elevation schematic view of a wellbore with a plunger and overriding liquid slug together with parameters related to the liquid slug operation and including time increments for the animation view of the rising plunger in liquid slug.

FIG. 7 is a further screen display of a schematic illustration of a wellbore together with a plunger and a fluid slug. The illustration in FIG. 7 has additional wellbore information including operator entered data such as reported gas flow rate, reported liquid flow rate, tubing size, casing size, casing weight, static bottom-hole pressure (BHP) and gas specific gravity. It further includes the tubing perforation depth and the formation perforation depth.

Figure 8:
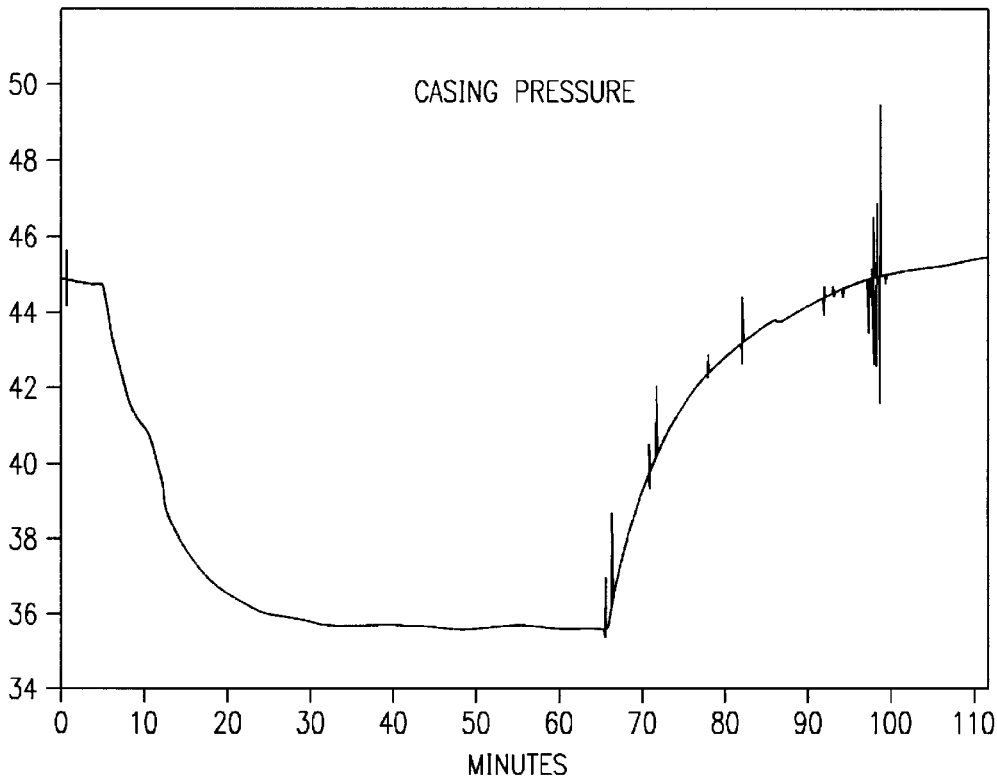
FIG. 8 is a graph illustrating casing pressure for a plunger lift operation as a function of time.
Figure 9:
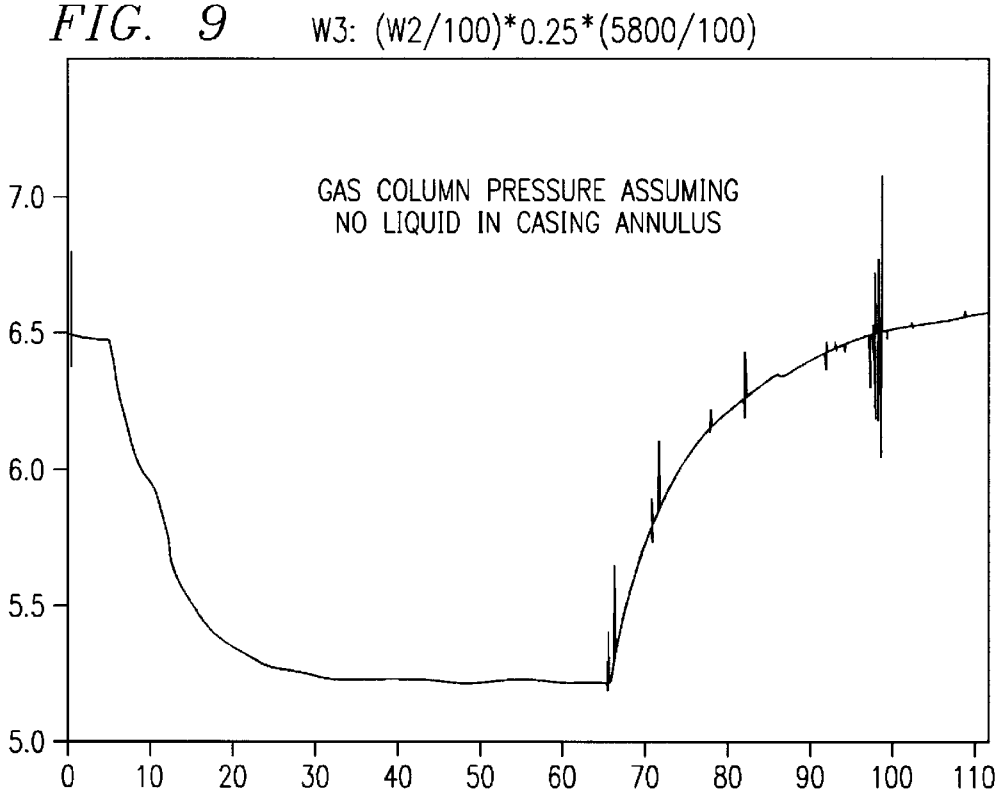
FIG. 9 is a graph illustrating gas column weight as a function of time assuming no liquid in the casing annulus.
Figure 10:
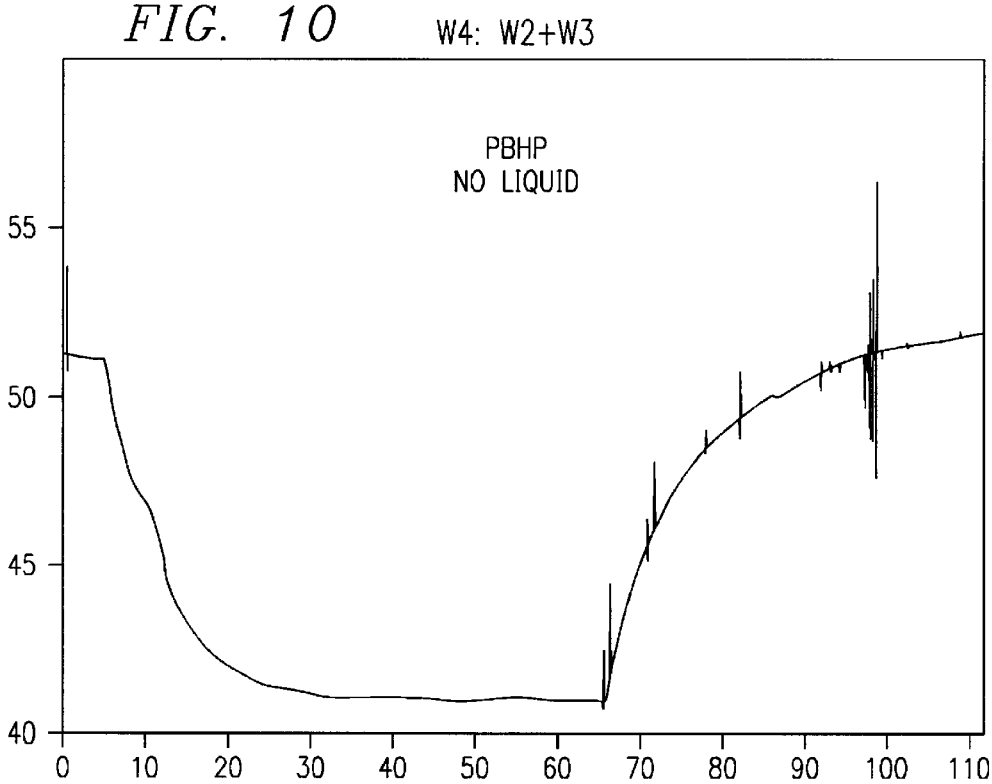
FIG. 10 is a graph of producing bottom-hole pressure with no liquid as a fraction of time for a plunger cycle.
Figure 11:
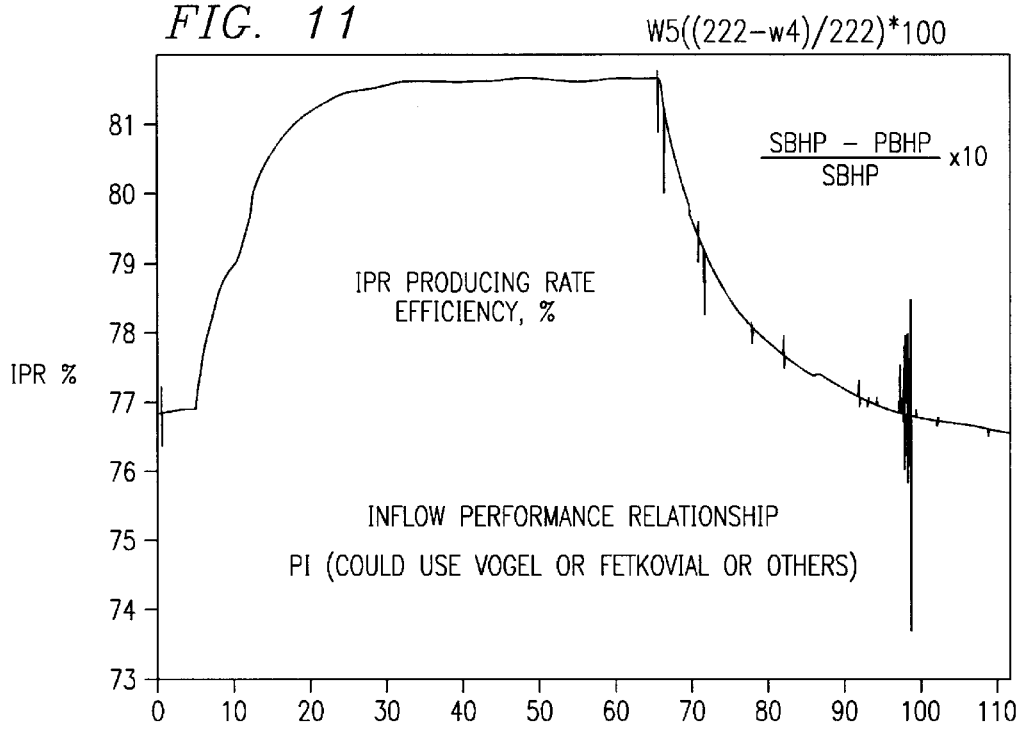
FIG. 11 is a graph of IPR (producing rate efficiency) as a function of time showing inflow performance relationship.

FIGS. 8–10 illustrate a determination of casing pressure at the bottom of the casing during the time period of a cycle of the plunger. FIG. 8 is an illustration of casing pressure as measured at the surface of the well as a function of time during the plunger cycle. FIG. 9 is a calculation of the weight of the gas column during the plunger cycle, assuming that no liquid is present in the casing annulus. FIG. 10 is a summation of the pressure and weight in FIGS. 8 and 9 for determining the producing bottom-hole pressure (PBHP)

with no liquid. FIG. 11 is a chart during the plunger cycle illustrating the inflow performance relationship (IPR) of the well, essentially describing the producing rate efficiency of the well during a plunger cycle. As shown in FIG. 11, the inflow performance has a low of 77% at the start of the plunger cycle and rises to a level just over 81% and then drops back down at the latter portion of the cycle. This is an important production number that is needed by an operator to determine the efficiency of producing product from the well.

Figure 12:
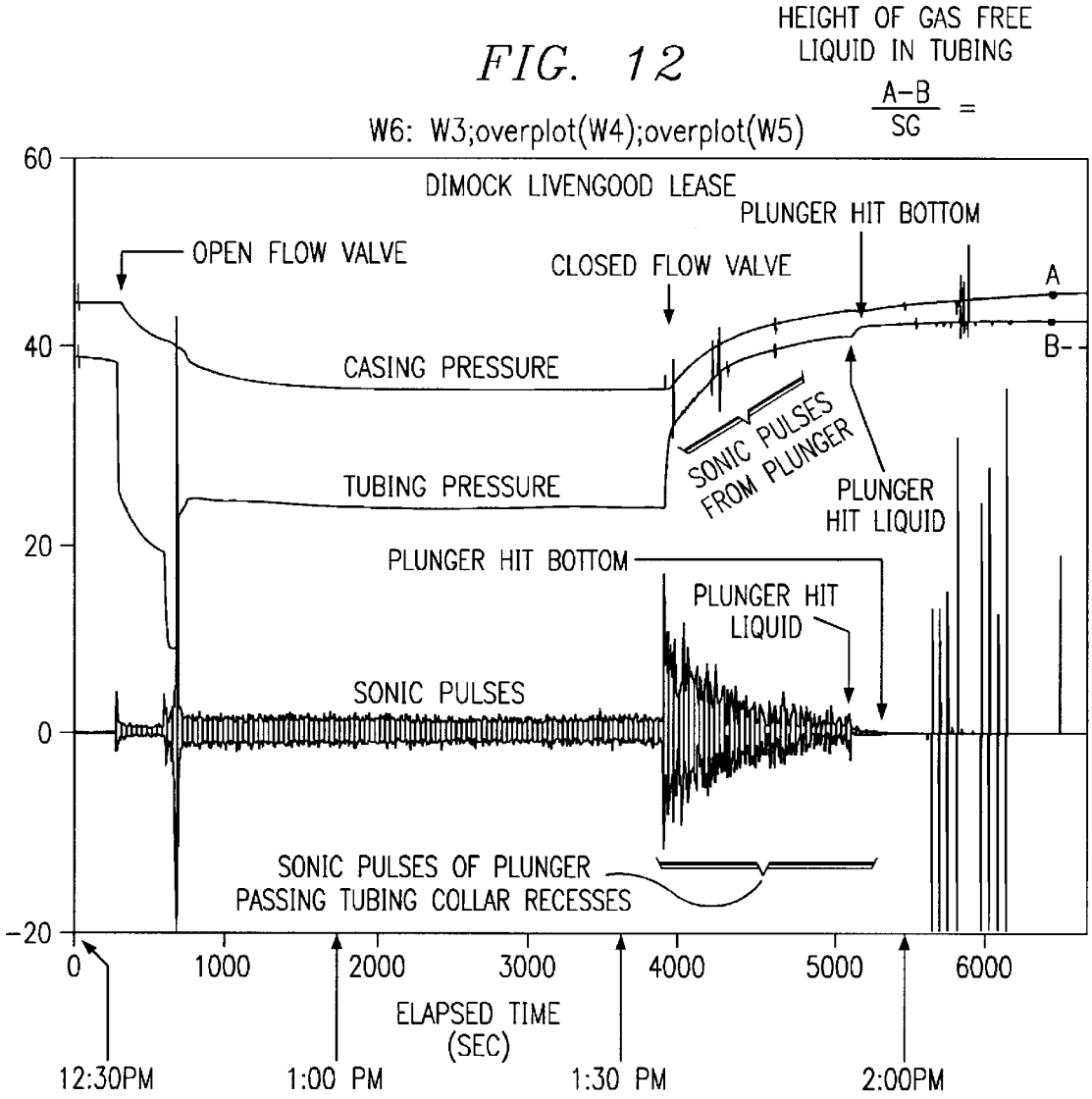
FIG. 12 is a graph of casing pressure, tubing pressure and sonic signal from tubing as a function of time.

Referring to FIG. 12, there is an illustration of multiple parameters including casing pressure, tubing pressure and an illustration of an acoustic signal, all as a function of time. This is the beginning of the unloading period. The flow valve 122 is opened as indicated at the left side of the graph and immediately the casing pressure and the tubing pressure drop. The microphone 132 monitors the acoustic signal within the tubing 104 and a spike is produced at the time that the valve 122 is opened. At the time that the valve 122 is opened, the plunger 106 begins to ascend from the bottom of the tubing upward through the tubing 104. At a time of about 600 seconds there is a dramatic decrease in tubing pressure. A surface valve was opened to an open tank to reduce the surface tubing pressure. This drop in tubing pressure allowed the pressure below the plunger to lift the liquid to the surface which caused a sudden increase in tubing pressure. There is also a corresponding increase in sonic energy. This is due to the restriction in the flow line to liquid flow. During the open valve period (afterflow) from approximately 800 seconds to approximately 3,900 seconds, the casing pressure steadily decreases and the tubing pressure decreases slightly. During this time gas flows from the well through the flow line 120. At approximately the 3,900 second time mark, the flow valve 122 is closed which results in an increase in both the casing pressure and tubing pressure. At this point the plunger is released from the catcher 112 and begins to descend through the tubing 104. As it descends, a sonic pulse is generated each time the plunger passes a collar recess. This pulse is due to both the physical impact of the plunger with the recess and the release of gas around the plunger. A sonic pulse is created for each pass of a collar recess as shown in the acoustic waveform. At approximately the 5,200 second point it is noted that the plunger hits the liquid and there is a noticeable increase in the tubing pressure over a short period of time. This is a pressure increase of approximately 1.0 psi over a time of 50 sec. There is a corresponding spike of noise in the acoustic waveform when the plunger hits the liquid.

When the plunger hits bottom, the increase in tubing pressure reduces and the tubing pressure becomes essentially constant. At the time that the plunger hits the bottom, that is meets the spring 108, the energy, that is noise, monitored within the tubing 104 is dramatically decreased. Thus, the reduction of the noise indicates that the plunger 106 has reached the bottom of the wellbore and is resting on the spring 108. The detection of the termination of the noise can therefore be used to generate an indicator that the flow valve 122 should be opened to permit the plunger 106 and a liquid slug to be elevated to the top of the wellbore due to the gas pressure within the casing. As further indicated in FIG. 12, the height of the liquid in the slug can be determined by the difference between the casing and tubing pressure divided by the specific gravity of the gas at the end of the shut-in period.

Figure 13:
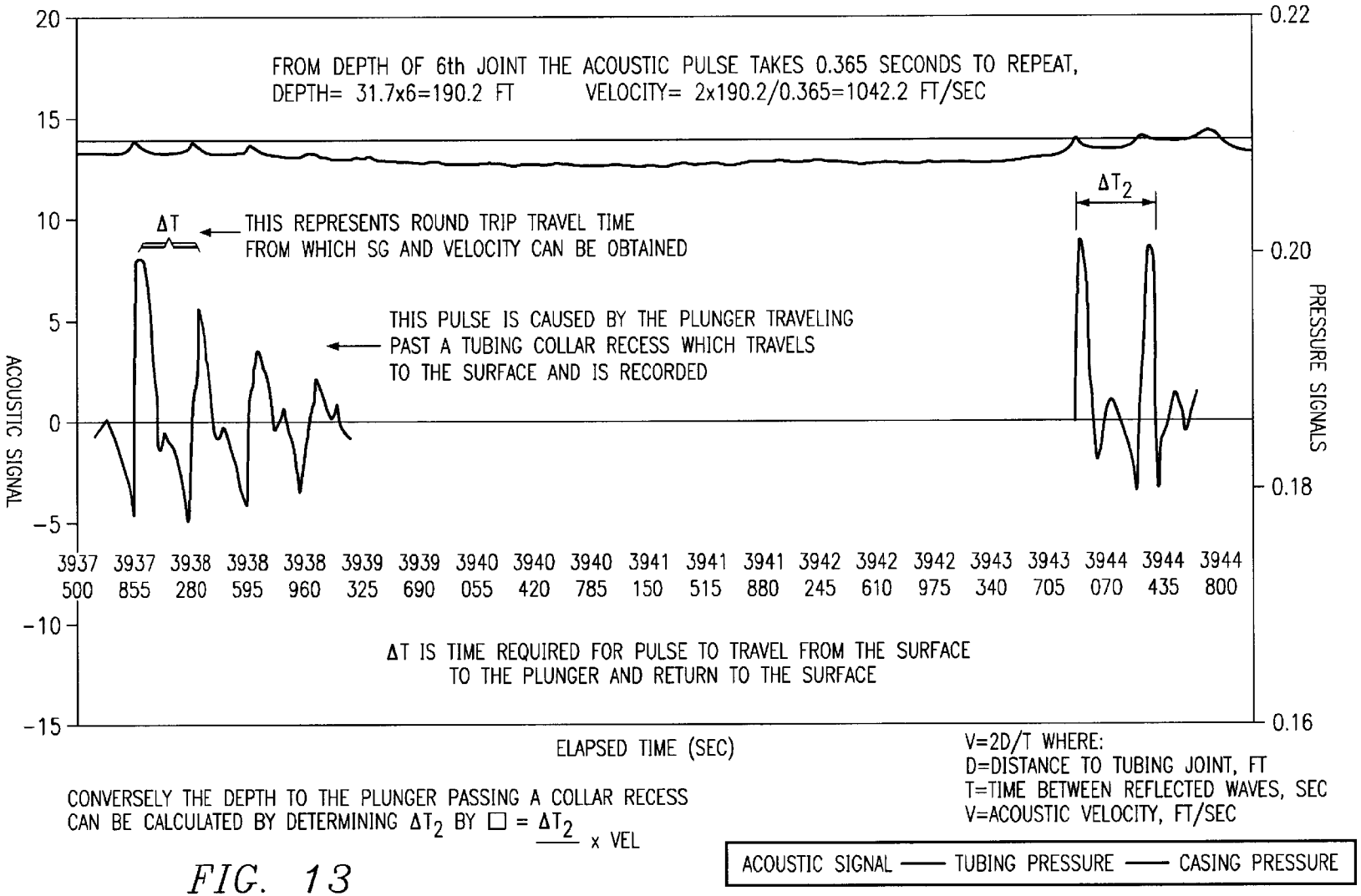
FIG. 13 is a graph of an acoustic signal monitored within the tubing as a function of time.

Referring to FIG. 13, there is shown an acoustic trace which is a signal produced by monitoring with a microphone 132 the sounds produced within the interior of the tubing 104 (referring to FIG. 1). The amplitude of the acoustic signal is indicated by the vertical axis on the left side and the pressure signals are indicated by the vertical axis on the right-hand side. The first pulse on the left-hand side has four cycles in descending amplitude. When the plunger 106 passes a collar recess a sudden acoustic pulse is generated and this pulse is transmitted upwards through the tubing 104 to the microphone 132. This pulse is indicated by the first cycle of the waveform on the left-hand side of the chart shown in FIG. 13. This pulse is then reflected at the top of the tubing 104 and travels down in the tubing until it again encounters the plunger 106 where it reflects and then travels upward through the tubing 104 back to the microphone 136. The second occurrence of the pulse is the second cycle in the waveform. The difference between the receipt times for the first time of occurrence and the second time of occurrence is indicated by the symbol $\Delta T$. The depth to the plunger can be determined by taking one half of the travel time and multiplying it by the velocity of sound in the tubing. The time $\Delta T$ is the time required for the pulse to travel from the surface to the plunger and return to the surface. Acoustic velocity can be determined in many ways or it can be entered by the operator based upon the characteristics of the particular well. Acoustic velocity can be determined by actively generating an acoustic pulse by the gas gun 136 and collecting echo returns from the collars that are exposed within the annulus of the casing 102. By knowing the average joint length and the rate of receipt of collar echos, the acoustic velocity of the sound within the casing annulus can be determined. This acoustic velocity can then be multiplied by one half of the round trip travel time to determine the depth of the plunger from the surface.

Further referring to FIG. 13, a second group of pulses are shown at the right-hand side of the figure. These indicate the next occurrence of sound being generated when the plunger passes the next succeeding collar recess. The time determination of $\Delta T_2$ is the roundtrip travel time between the surface and the plunger. Since the plunger is at a deeper portion in the well, the time $\Delta T_2$ will be a larger time difference. When this time difference is likewise multiplied by acoustic velocity with adjustment for the roundtrip aspect, the position of the plunger can again be determined from this time difference.

In referring to FIG. 13, the specific points for making the $\Delta T$ time measurements can be the zero crossovers or peaks in the signals, or any common point on the cycles can be used. The rate of plunger fall can be determined by the difference in time between the two pulses which represent a distance of a joint of tubing (30 ft.).

Figure 14:
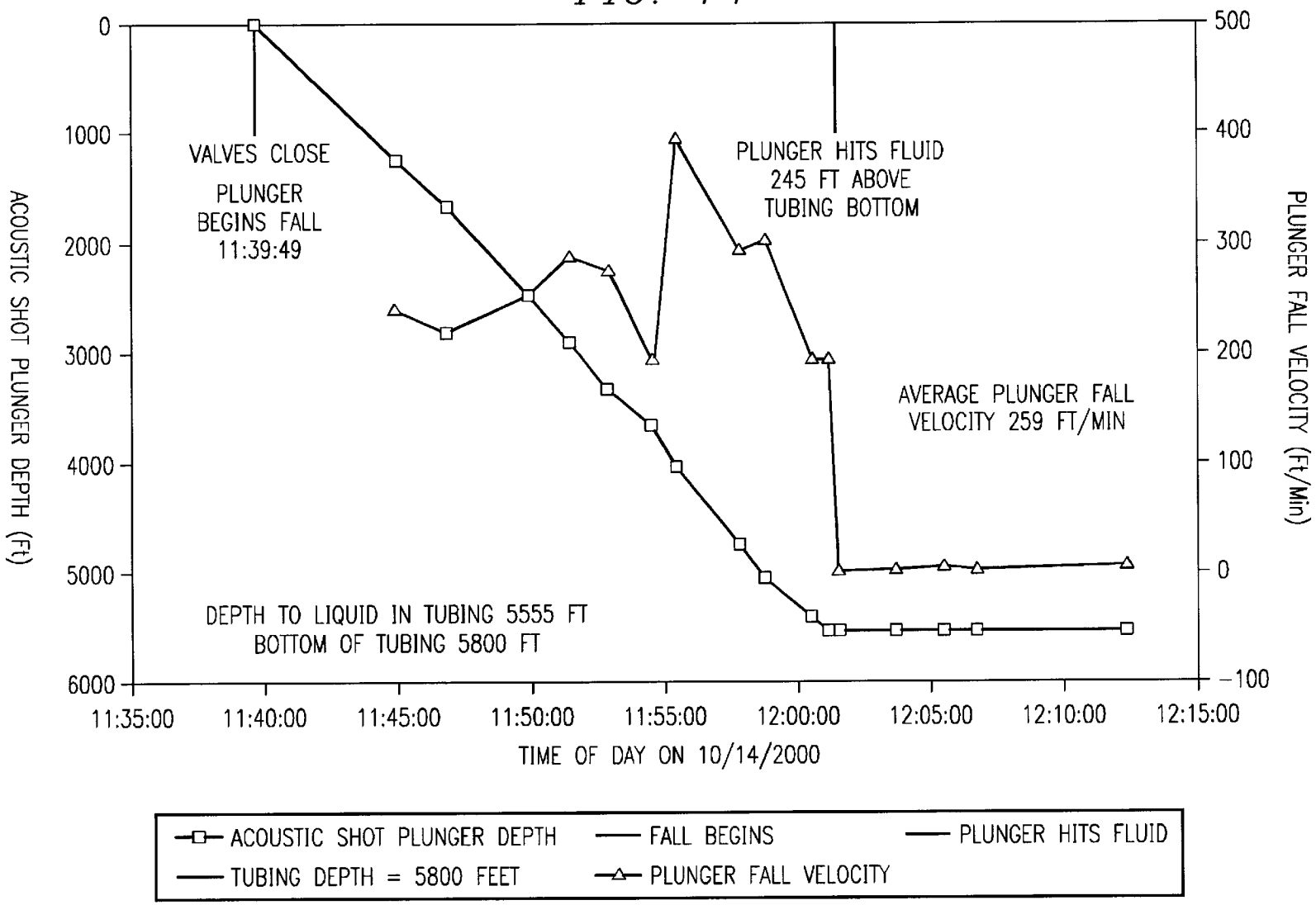
FIG. 14 is a graph of plunger fall trace having plunger depth on the vertical axis and time along the horizontal axis.

FIG. 14 is a plunger fall trace measured by taking active acoustic shots generated by the gas gun 136 and measured by the well analyzer 128. The flow valve 122 is closed at time 11:39:49 and the plunger depth is measured as shown as a function of time until the plunger hits the fluid at a depth of approximately 5,555 feet. The plunger velocity is indicated by the vertical scale on the right in the triangular data points. Note that the plunger velocity reaches essentially zero when it encounters the fluid in the well. The plunger hits the fluid at a point approximately 245 feet above the bottom of the tubing.

Figure 15:
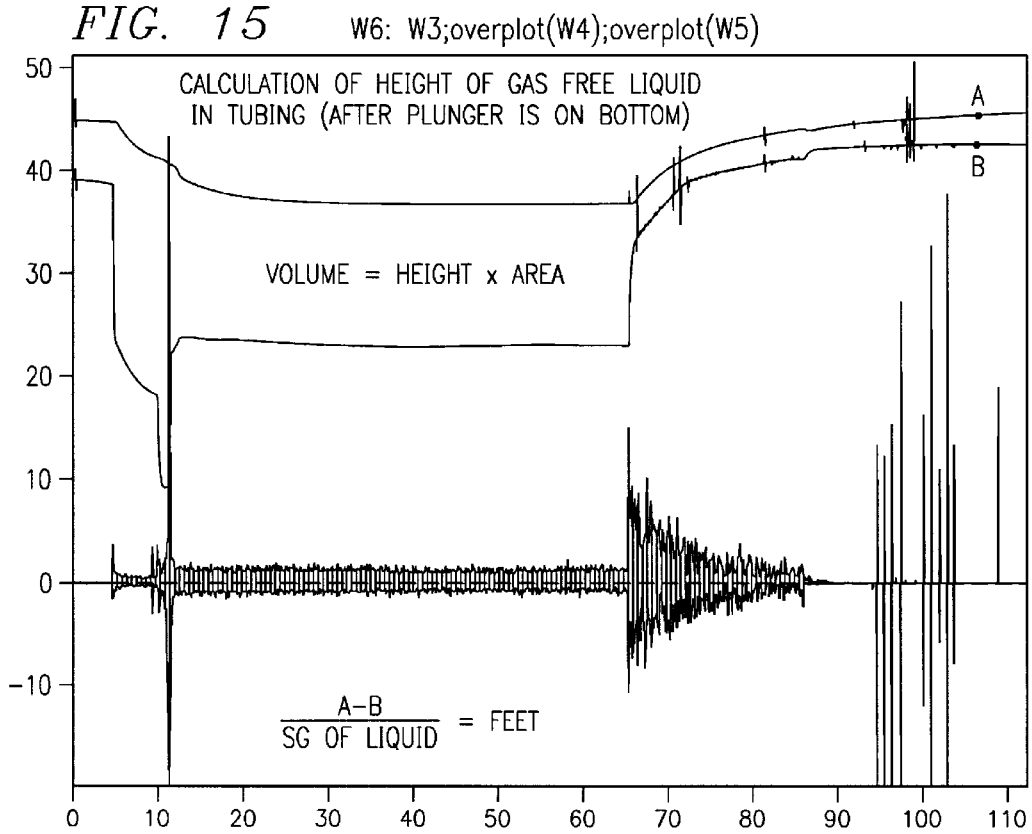
FIG. 15 is a graph of casing pressure and tubing pressure as a function of time together with a display of an acoustic waveform monitored within the tubing during a plunger cycle.

Referring now to FIG. 15 there is illustrated a calculation of the height of the gas-free liquid in the tubing after the plunger is on the bottom. The volume is determined by the product of the height and area within the tubing. The height of the liquid level is determined by the difference in the casing and tubing pressures at points A and B divided by the specific gravity of the liquid. The acoustic waveform indicates the sound being produced within the tubing. The plunger is released at approximately the 65 minute time point and as it descends through the tubing 104, the acoustic pulses are generated as the plunger passes the collar recesses. At approximately the 87 minute time the plunger 106 enters the fluid, thereby producing a sudden increase in tubing pressure and a termination of noise generation within the tubing. Both the termination of noise measured by the microphone 132 and the sudden increase in tubing pressure are indicators that the plunger 106 has entered within the fluid at the bottom of the tubing 104. A lack of noise for a time of a few seconds can be an indication that the plunger has entered the fluid or has ceased to fall.

Figure 22:
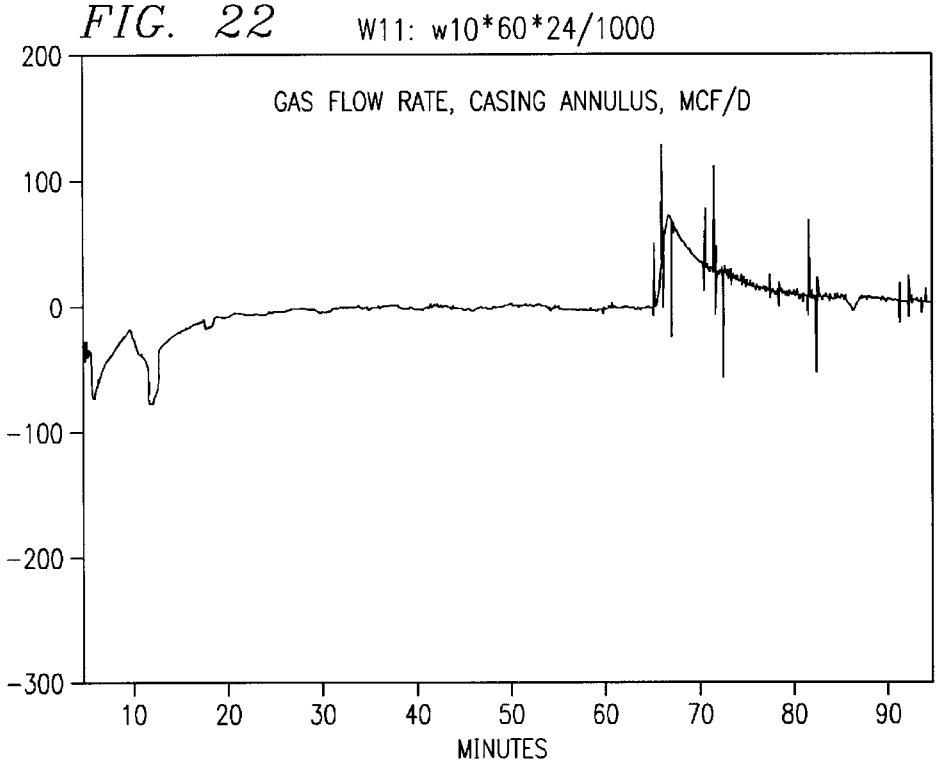
FIG. 22 is a graph of gas flow rate in the casing annulus as a function of time (in units of MCF)

The FIGS. 16–22 represent the measurement of well parameters during a time period for a plunger lift cycle. This set of figures represents a measurement of the gas flow into and out of the casing annulus of the well. FIG. 16 is a graph of casing pressure transducer output versus time for a plunger lift cycle. FIG. 17 is casing pressure plotted versus time for values of casing pressure as opposed to raw data as shown in FIG. 16. FIG. 18 is a showing of one cycle of data per casing pressure. FIG. 19 is a smooth data shape for the data from FIG. 18. FIG. 20 is a graph of the volume of gas in the casing annulus as a function of the cycle of the plunger. FIG. 21 is a graph of the gas flow rate from and into the casing annulus shown in cubic feet per minute. A negative valve is gas outflow and the positive valve is gas inflow. FIG. 22 is an illustration of the gas flow rate converted to million cubic feet per day.

Figure 23:
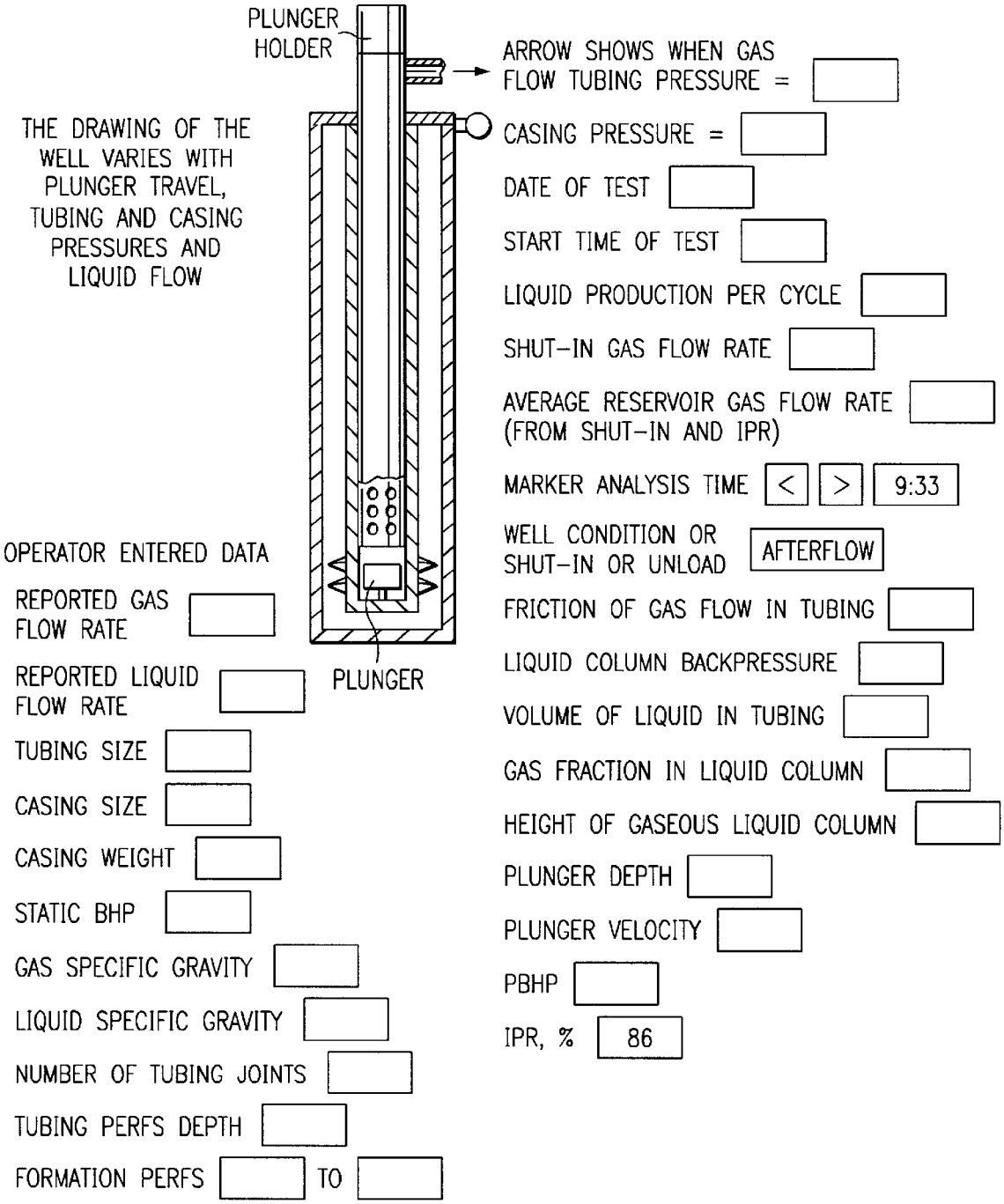
FIG. 23 is a screen illustration of a schematic elevation view of a wellbore with a plunger and liquid slug together with specific parameters related to well and plunger lift operation.

FIG. 23 is a further screen illustration showing a schematic of a wellbore with the plunger 106 and the liquid slug together with parameters associated with the wellbore.

FIG. 24 is a further illustration of the information described in reference to AS FIG. 4.

FIG. 25 is a still further illustration of the information shown in FIG. 4 with further information noting that this data can be used to set automatic controllers. Plunger lift systems are frequently operated by an automatic controller and by use of the information shown in FIG. 25, this automatic operation can be optimized. FIG. 25 further includes a measurement of inflow performance as a percentage of maximum based on producing bottom-hole pressure and static bottom-hole pressure.

Figure 26:
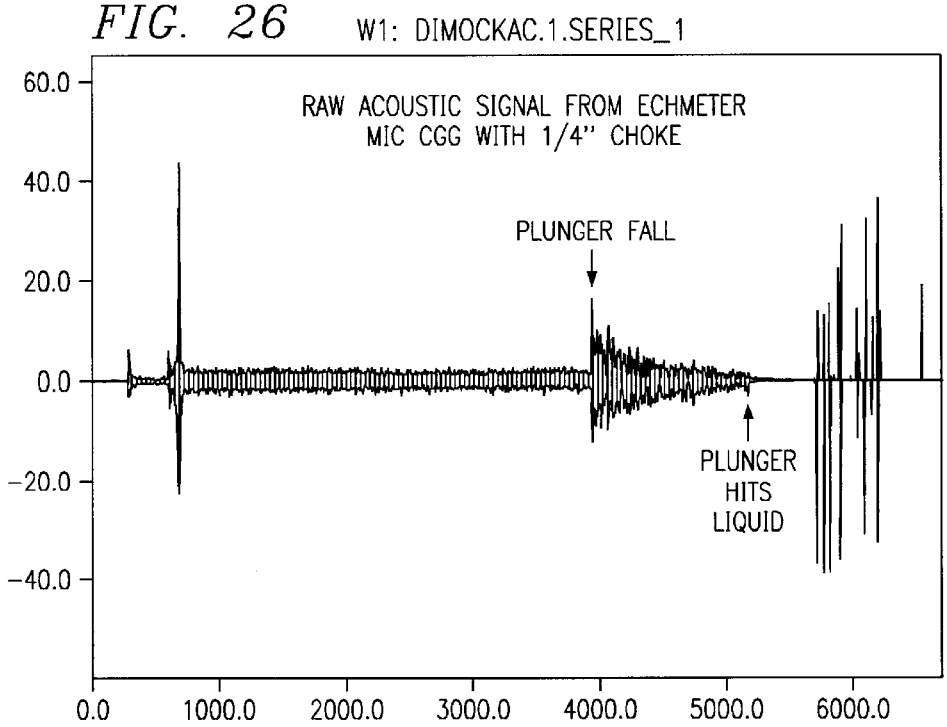
FIG. 26 is a graph of an acoustic signal as a function of time illustrating the signal received from within the tubing as the plunger falls through the tubing and reaches the liquid.

FIG. 26 is a raw acoustic signal from the microphone of an Echometer compact gas gun with a ¼ inch choke. The acoustic signal is plotted as a function of time showing the background noise up to shortly before 4,000 seconds when the plunger fall is initiated and indicating when the plunger hits the liquid at shortly after 5,000 seconds. Note that the noise level suddenly decreases after the plunger hits the liquid. This sudden decrease of the average noise level over a short period of time can be utilized to indicate when the plunger has reached the liquid. This silent time can be a few seconds.

Figure 27:
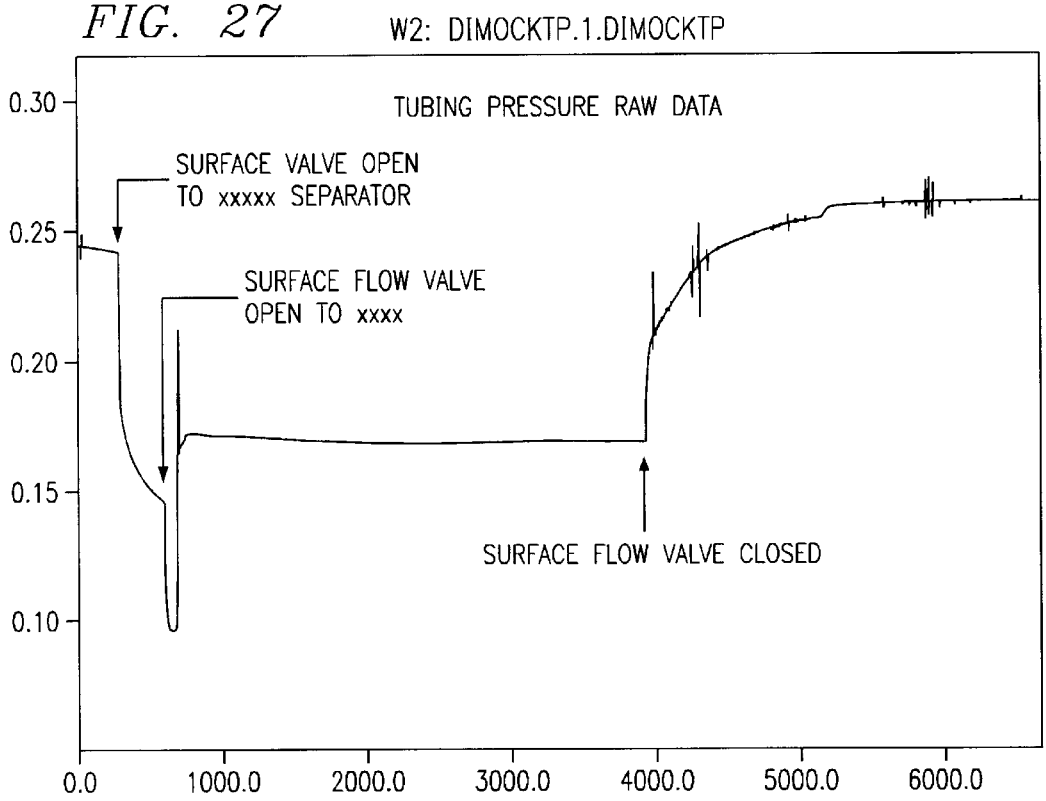
FIG. 27 is a graph of tubing pressure transducer raw data as a function of time for the descent of a plunger through the tubing.

FIG. 27 is a plot of tubing pressure as a function of time during which the plunger is operated. At the left-hand side of the graph there is shown the point at which the surface valve 122 is opened to allow flow of product to the sales separator. At a shortly later point in time, the surface flow valve 122 is opened to the atmosphere resulting in a sudden drop of tubing pressure. Shortly before the 4,000 second point, the surface flow valve 122 is closed, thereby producing an increase in tubing pressure.

Figure 28:
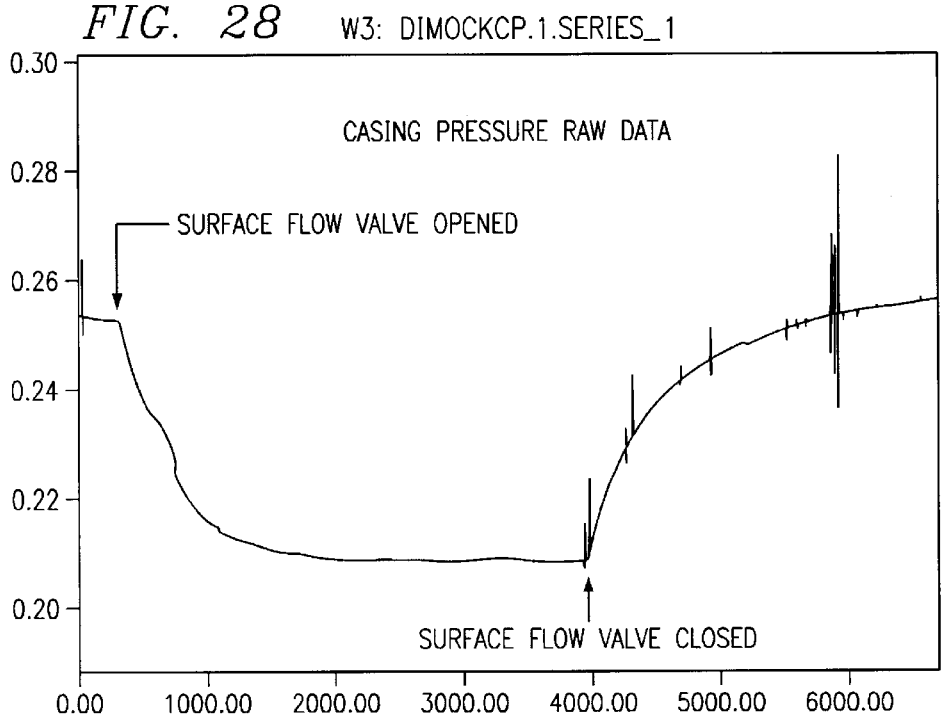
FIG. 28 is a graph illustrating casing pressure transducer raw data as a function of time with markers indicating when the surface flow valve is open and closed.
Figure 29:
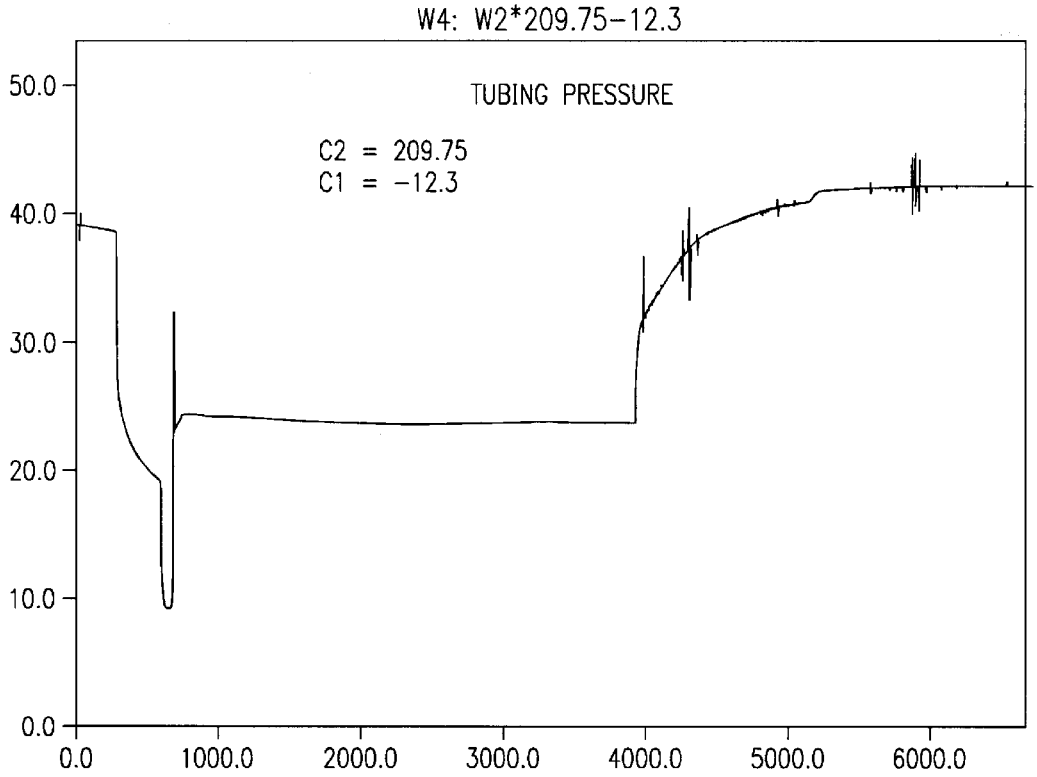
FIG. 29 is a graph of tubing pressure vs. time.
Figure 30:
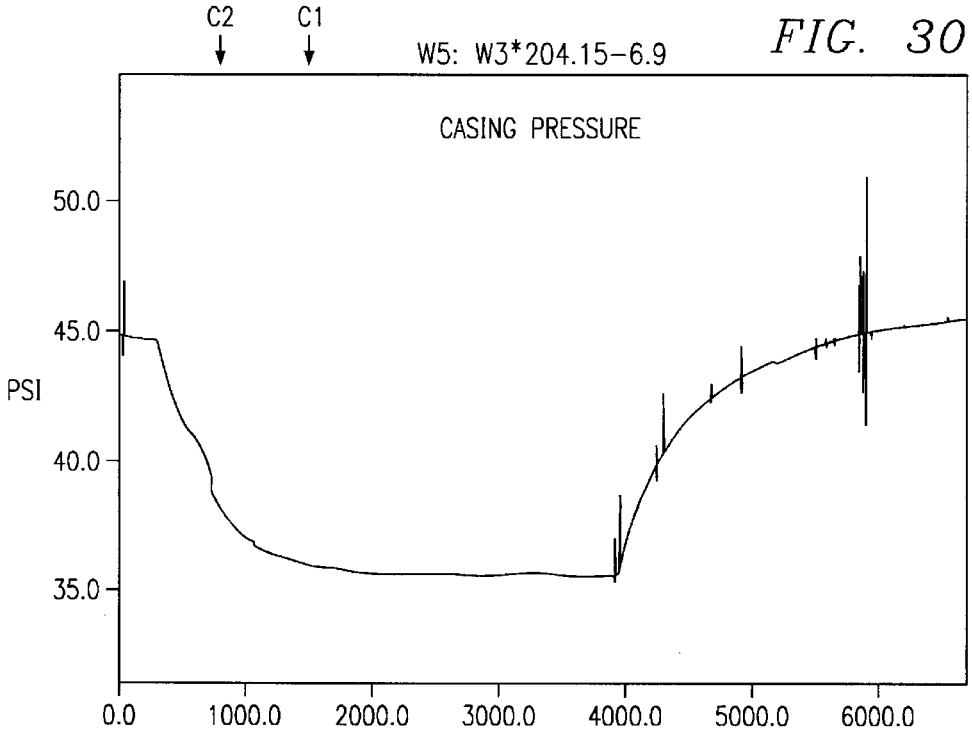
FIG. 30 is a graph of casing pressure vs. time.

FIG. 28 is an illustration of the raw data representing casing pressure with arrows indicating points in time at which the surface flow valve 122 is opened and the surface flow valve 122 is closed. FIG. 29 illustrates tubing pressure as a function of time based on the information shown in FIG. 27. FIG. 30 is a graph of casing pressure as a function of time based upon the information derived in FIG. 28.

Figure 31:
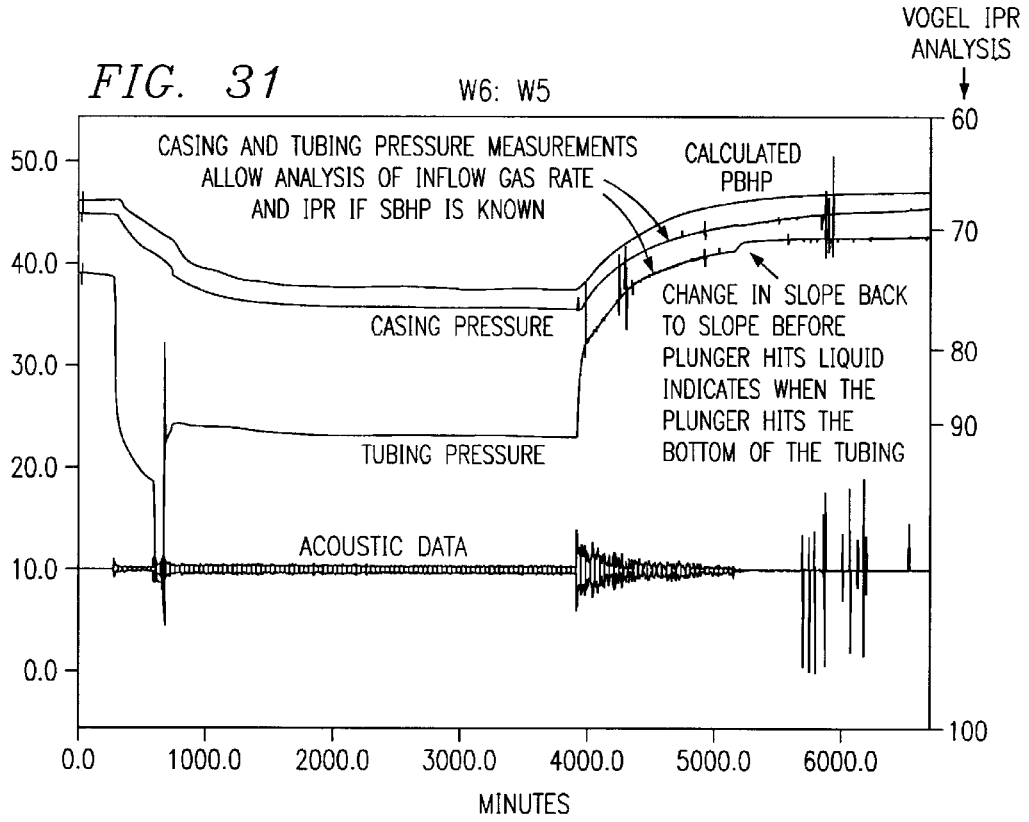
FIG. 31 is a graph of casing pressure, tubing pressure, an acoustic waveform and calculated producing bottomhole pressure as a function of time in which a plunger ascends and descends within the tubing string.

FIG. 31 is a chart which is a function of time for multiple parameters including casing pressure and tubing pressure and further including acoustic data collected by a microphone for receiving sound within the tubing 104. Measurement of the casing and tubing pressure allows analysis of in flow gas rate and IPR (efficiency) if the static bottom-hole pressure (SDBP) is known. The Vogel IPR analysis is indicated in the vertical scale on the right side of the drawing. The upper line across the graph is the calculated production bottom-hole pressure (PBHP). An arrow shortly after the 5,000 second point indicates a change in slope back to the initial slope before the change in slope indicates when the plunger hits the bottom of the tubing. Note also that at approximately the same time the noise level within the acoustic data trace substantially reduces. Both the tubing pressure change and the termination of the acoustic noise indicates that the plunger has reached the liquid within the lower portion of the tubing.

Figure 32:
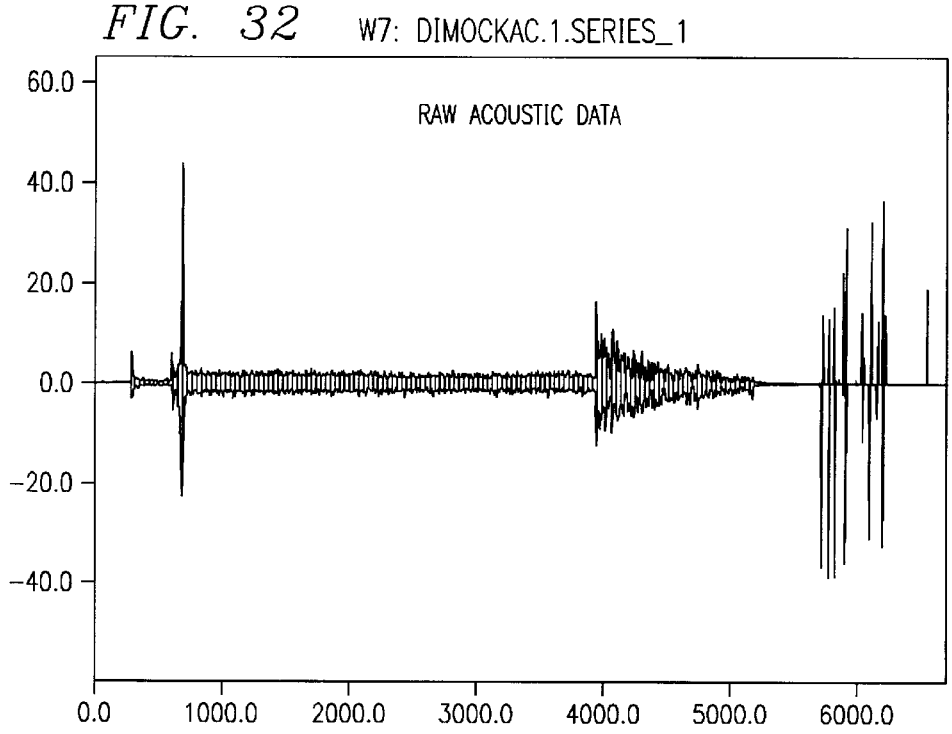
FIG. 32 is a graph illustrating an acoustic signal waveform as a function of time for a plunger ascending and descending in the tubing string.
Figure 33:
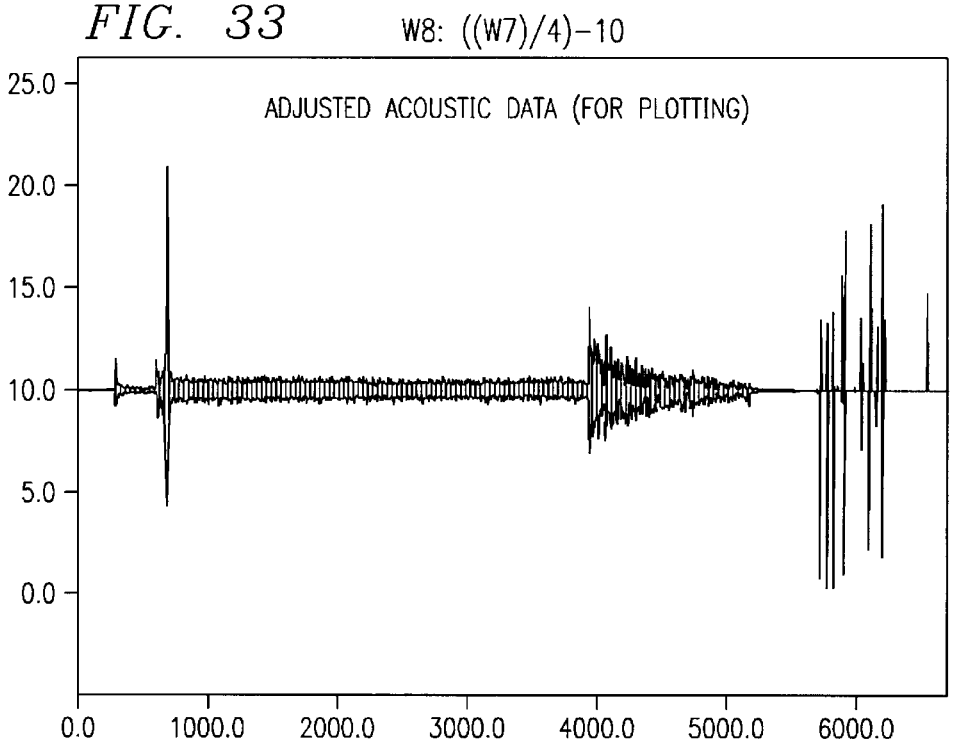
FIG. 33 is an adjusted acoustic data graph as a function of time for an acoustic signal monitored within the tubing for the ascent and descent of a plunger in the tubing.
Figure 34:
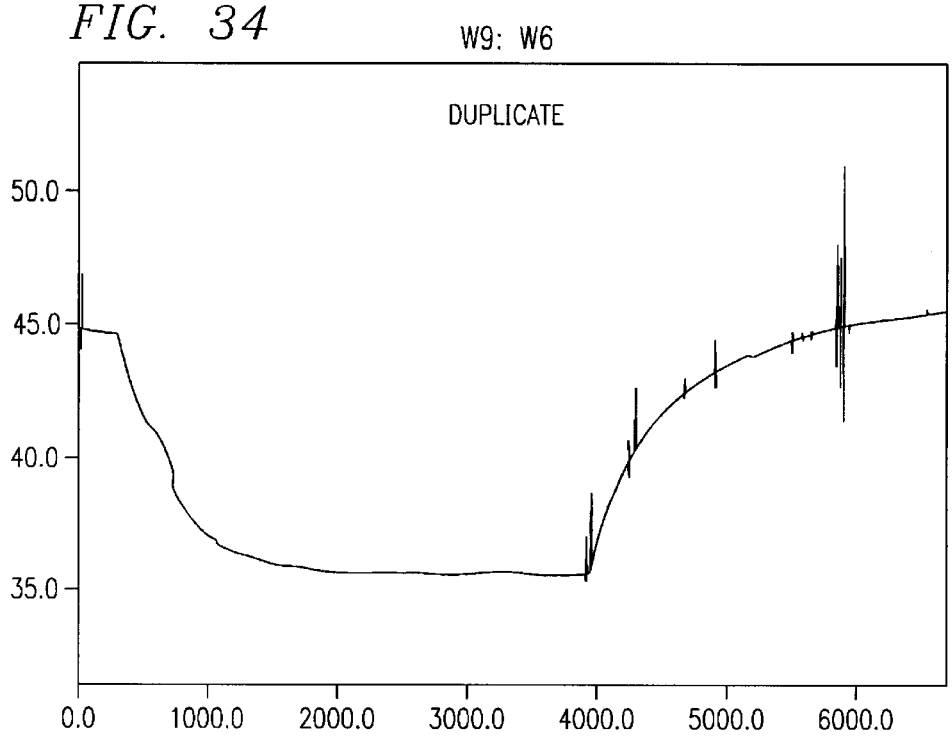
FIG. 34 is a graph of casing pressure as a function of time.

The raw acoustic data shown in FIG. 31 is illustrated in greater detail in FIG. 32. The raw acoustic data is also shown in FIG. 33 and is adjusted for plotting. FIG. 34 is a duplicate of FIG. 30.

Figure 35:
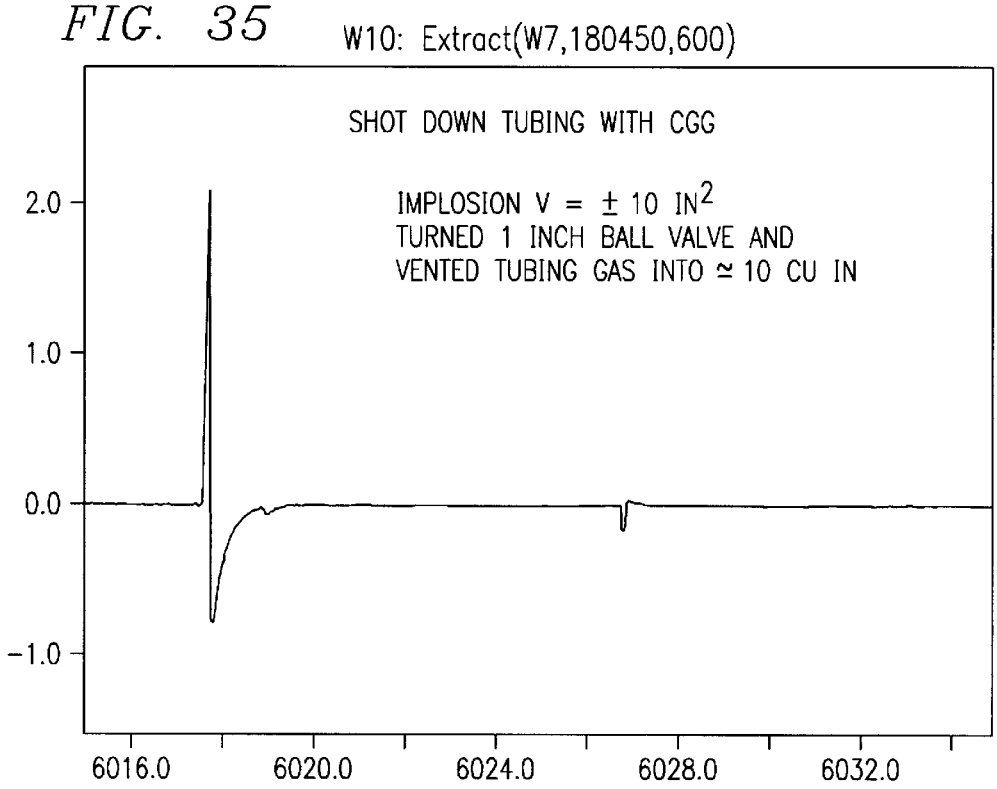
FIG. 35 is a graph of an acoustic signal as a function of time for transmission of an acoustic pulse down tubing having a plunger therein.

FIG. 35 is an illustration of generating an acoustic shot (pulse) which is transmitted down to tubing 104 by operation of the well analyzer 128 through activation of the gas gun 136. The initial sudden pulse is shown as a rising waveform at the left side of the graph between 6,016 and 6,020 seconds. The reflection from the plunger is shown as a downward pulse between the 6,024 and 6,028 second markers. This is an active acoustic process for measuring the location of the plunger.

Figure 36:
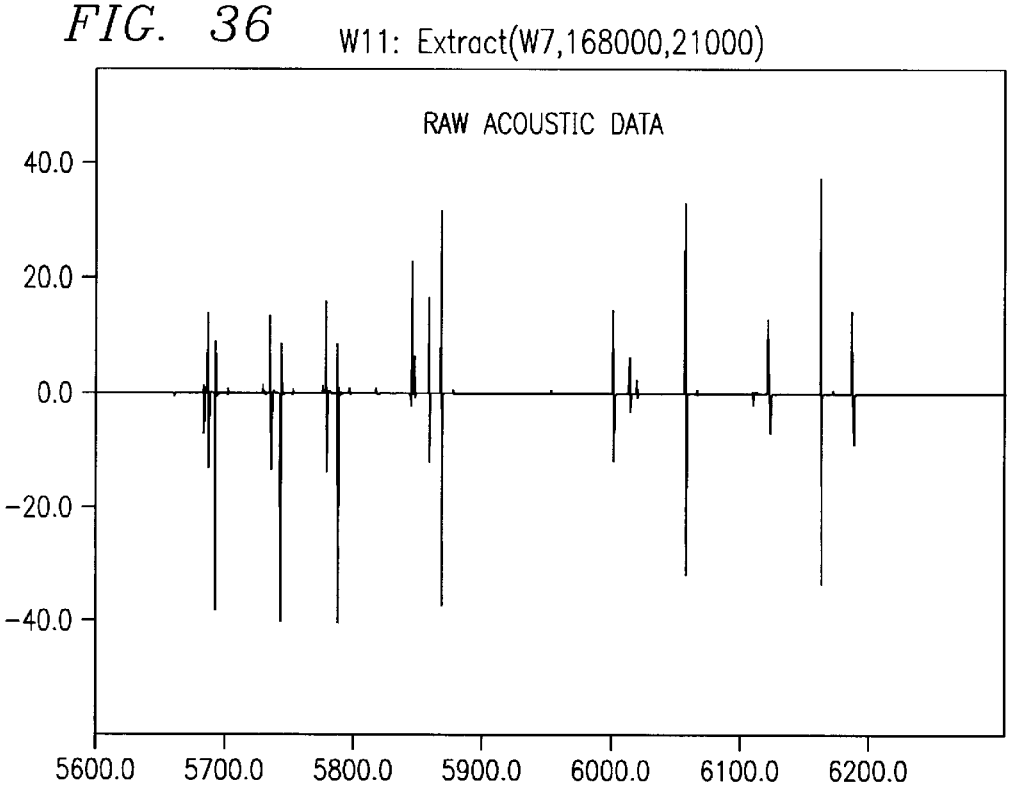
FIG. 36 is a graph of raw acoustic data as a function of time.
Figure 37:
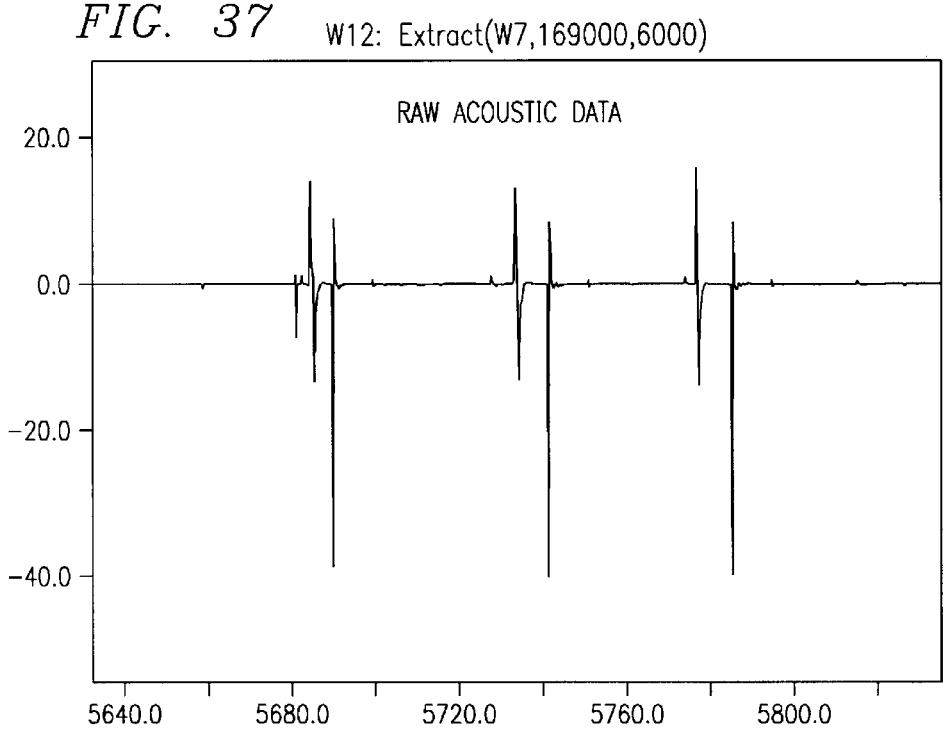
FIG. 37 is a graph of raw acoustic data as a function of time.

FIG. 36 is an illustration of raw acoustic data collected over the time frame shown in the horizontal scale. FIG. 37 is a further is a further illustration of raw acoustic data collected by the microphone 132 from sounds within the tubing 104 on the indicated time frame on the horizontal scale.

Figure 38:
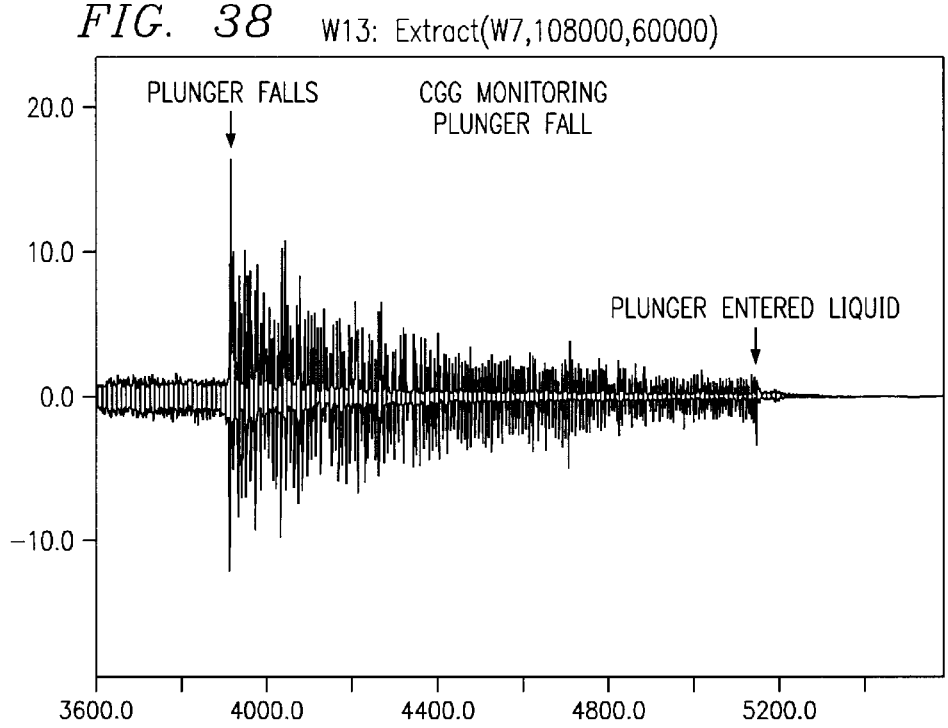
FIG. 38 is a graph of acoustic data as a function of time for a signal monitored within the tubing as a plunger descends through the tubing and enters into the liquid.

FIG. 38 is a detailed and expanded view of an acoustic signal collected within the tubing 104 by the microphone 132 indicating the passage of the plunger from the upper end of the tubing 104 downward until the plunger enters into the liquid. Each of the discrete pulses shown in this waveform represents an acoustic pulse generated when the plunger passes a collar recess. By counting each of these pulses and knowing the length of the tubing joints, the location (depth) of the plunger can be determined at any given time. It can further be determined when the plunger enters the liquid by the sudden stop of the acoustic pulses that are produced when the plunger passes the collar recesses. This information is collected by a microphone that is used within a compact gas gun (CGG).

Figure 39:
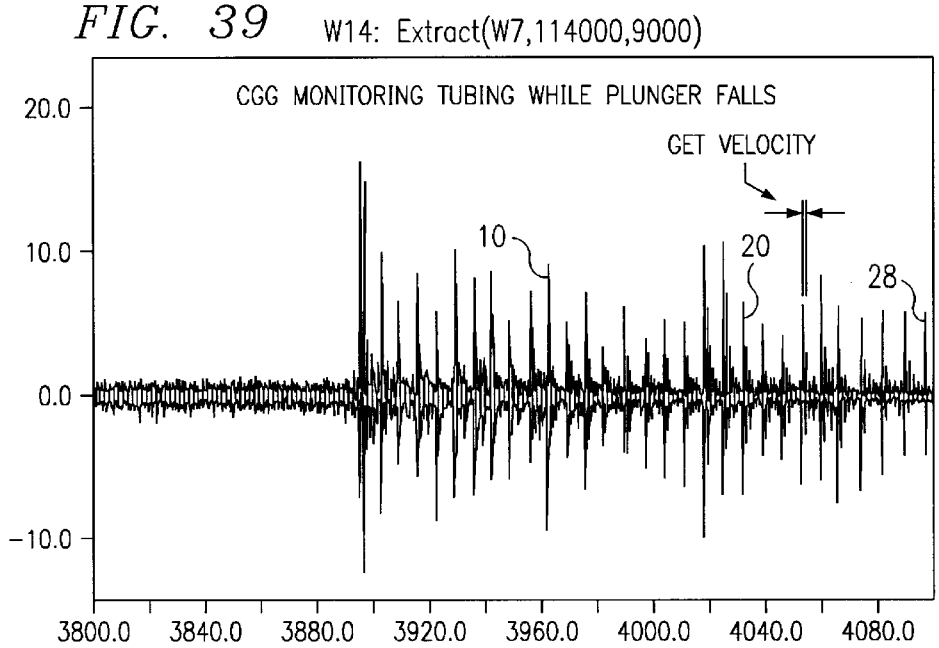
FIG. 39 is graph of an acoustic waveform as a function of time wherein the waveform is a monitored acoustic signal from within the tubing showing the sounds generated by the plunger when it passes casing recesses.

Referring now to FIG. 39, there is an expanded acoustic waveform which is previously shown in FIG. 38. The waveform shown in FIG. 39 also includes a count of the received acoustic pulses produced when the plunger passes collar recesses. The count of acoustic pulses is shown at the top, indicated as 10, 20 and 28. For a typical tubing joint length of 30 feet, the 10 count would indicate a depth location of 300 feet, the 20 count would indicate a depth location of 600 feet, and the 28 count would indicate a depth location of 840 feet. For each acoustic pulse there is a corresponding time, therefore the depth of the plunger within the wellbore 104 can be determined for each time.

Further referring to FIG. 39, there can be a measurement of roundtrip travel time, as previously disclosed, and this can be used together with acoustic velocity to determine the depth location of the plunger by a different technique.

Figure 40:
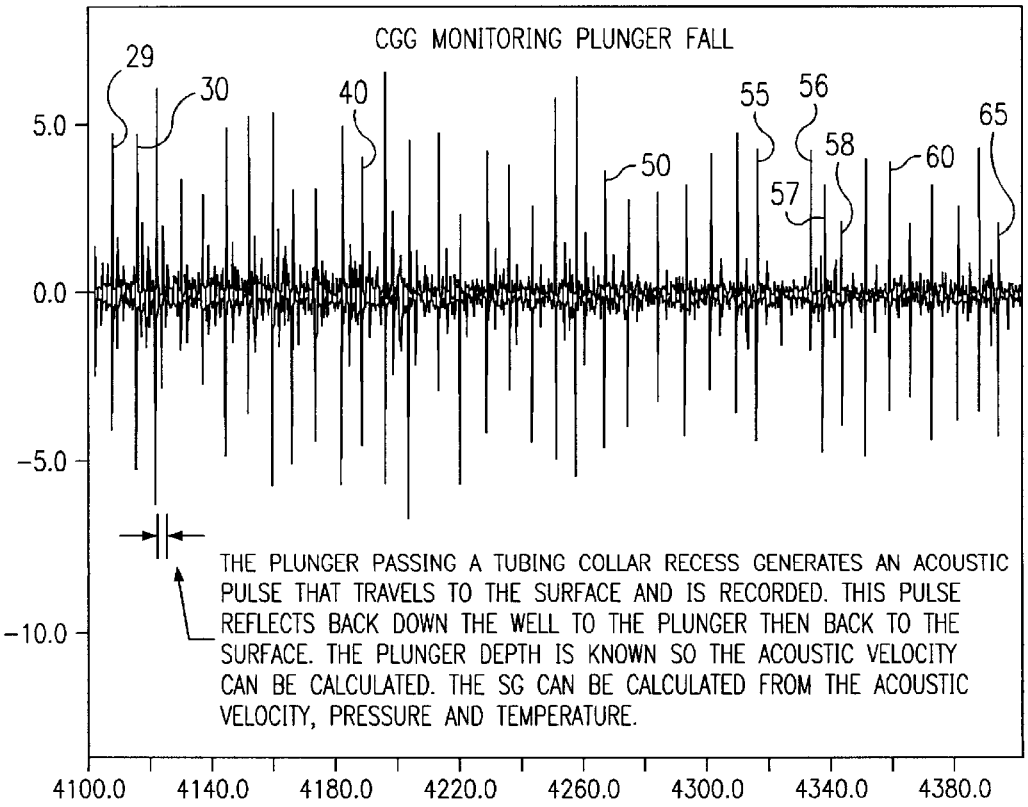
FIG. 40 is a graph of an acoustic waveform as a function of time illustrating the acoustic signal generated by the plunger as it descends through the tubing and passes collar recesses.

Referring to FIG. 40, there is a continuation of the expanded acoustic waveform shown in FIG. 39 representing the acoustic signal recorded during the fall of the plunger through the tubing 104. The plunger depth is known by a count of the number of acoustic signals which have been received and from this the acoustic velocity can be calculated because the roundtrip travel time can be measured from the waveform, and the depth is known by the count. The specific gravity (SG) of the gas can be calculated from the acoustic velocity, pressure and temperature.

Figure 41:
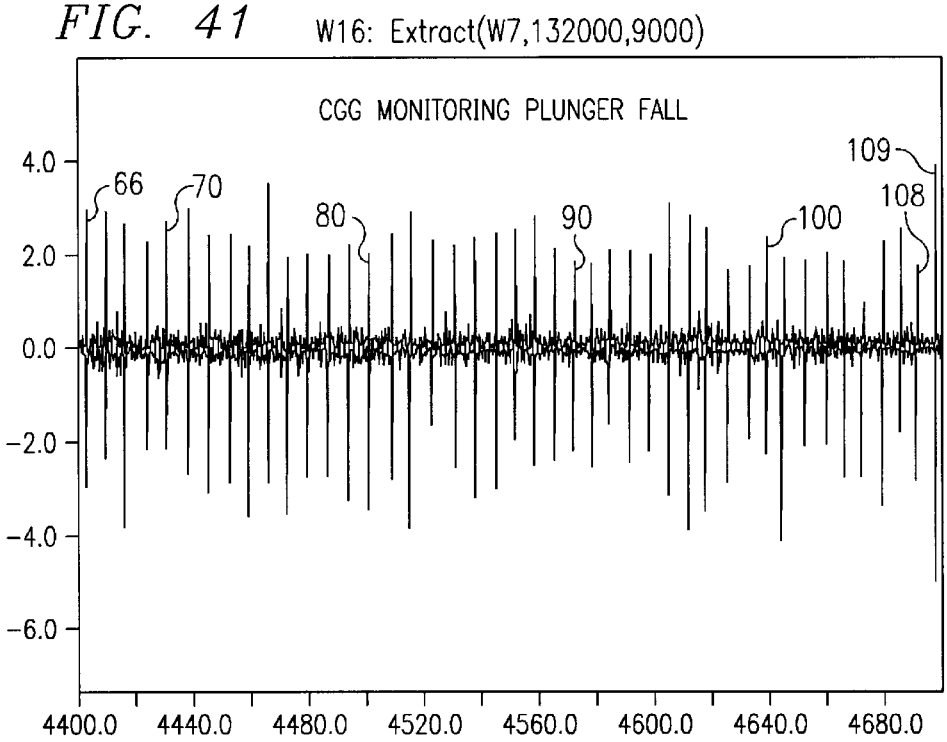
FIG. 41 is a graph of an acoustic signal as a function of time illustrating the acoustic signal received as the plunger falls through the tubing and counting the received sounds.
Figure 42:
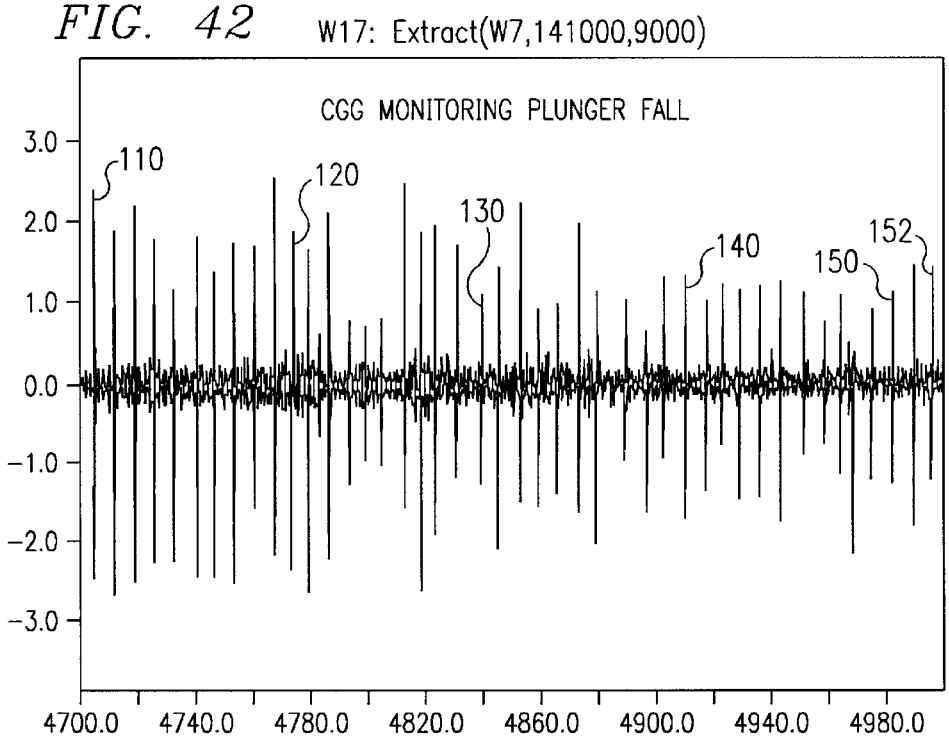
FIG. 42 is a graph of an acoustic waveform as a function of time illustrating the acoustic signal produced as a plunger falls through the tubing.

Referring to FIG. 41, there is a further continuation of the acoustic waveform previously shown in FIGS. 38–40 with further counts of acoustic pulses generated when the plunger passes collar recesses in the tubing. This is a count up through the $109^{th}$ collar recess. FIG. 42 is a continuation of the waveform with a count up through the $152^{nd}$ collar recess.

Figure 43:
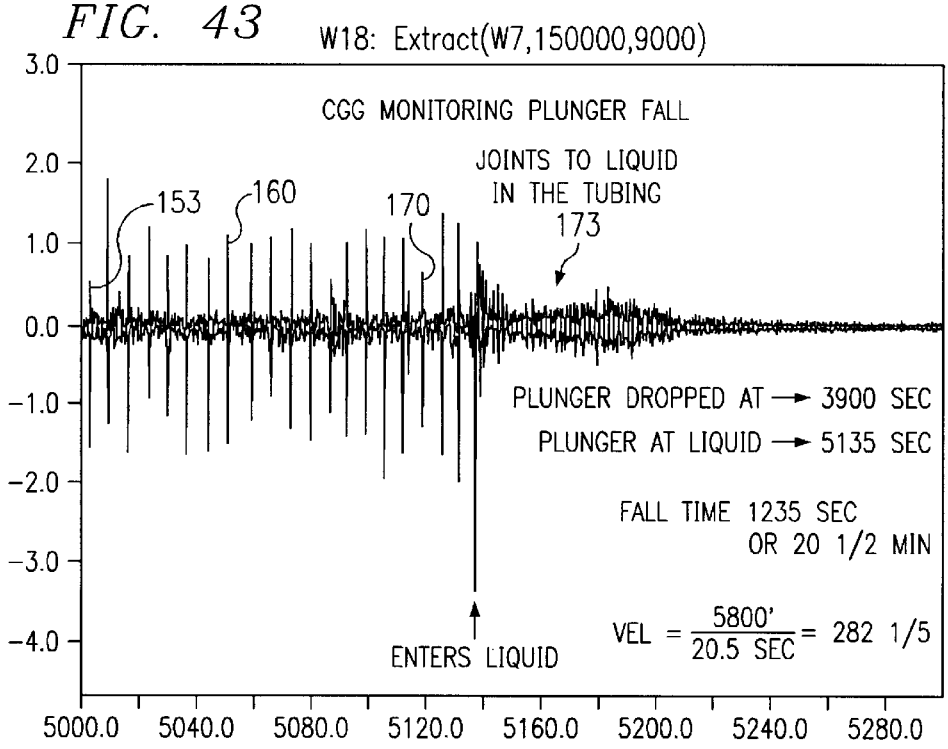
FIG. 43 is a graph of an acoustic waveform as a function of time for an acoustic signal monitored within a tubing string as the plunger descends through the tubing string and enters into the liquid at the lower end of the tubing.

FIG. 43 is a still further illustration of the acoustic waveform with a count of 173 joints to the liquid and further indicating where the plunger enters the liquid. By review of theses series of graphs illustrating the acoustic signal monitored within the tubing, it can be determined that the plunger was dropped at the 3,900 second time. The fall time was therefor 1,235 seconds (20 and ½ minutes). The average velocity was approximately 282 feet per second.

Figure 44:
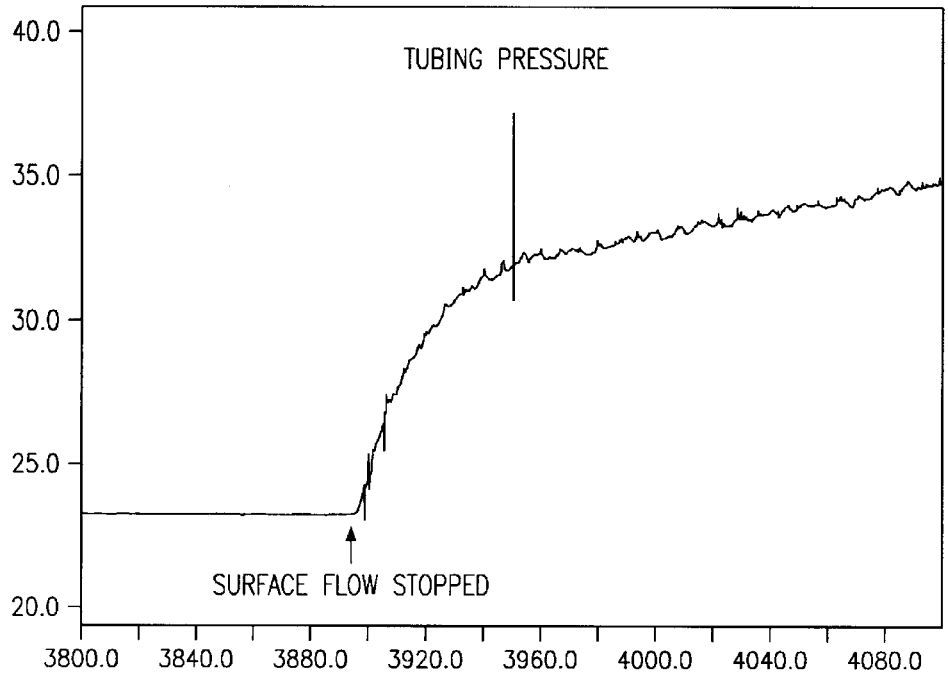
FIG. 44 is a graph of tubing pressure as a function of time illustrating the change in pressure when the surface flow of liquid from the well is stopped.

Referring to FIG. 44 there is shown tubing pressure during the time period when the surface flow through the line 120 terminates. When the flow ends, the tubing pressure increases.

Figure 45:
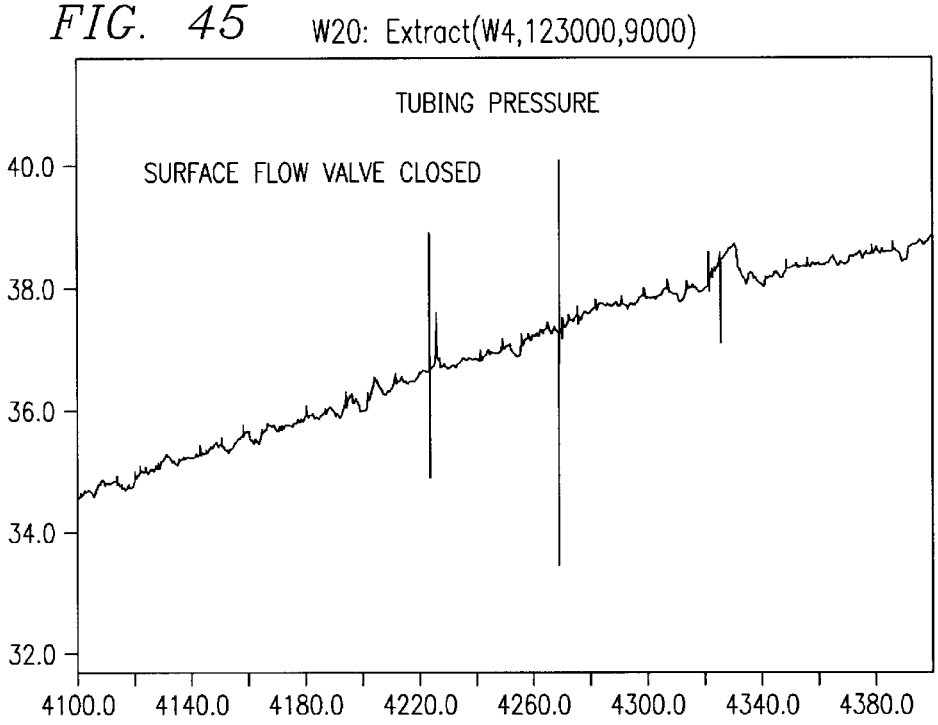
FIG. 45 is a graph of tubing pressure as a function of time showing the effect on the tubing pressure when the surface flow valve is closed.

Referring to FIG. 45, there is illustrated the tubing pressure as a function of time when the surface flow valve 122 is closed. Note initially that there is a uniform increase in pressure over time.

Figure 46:
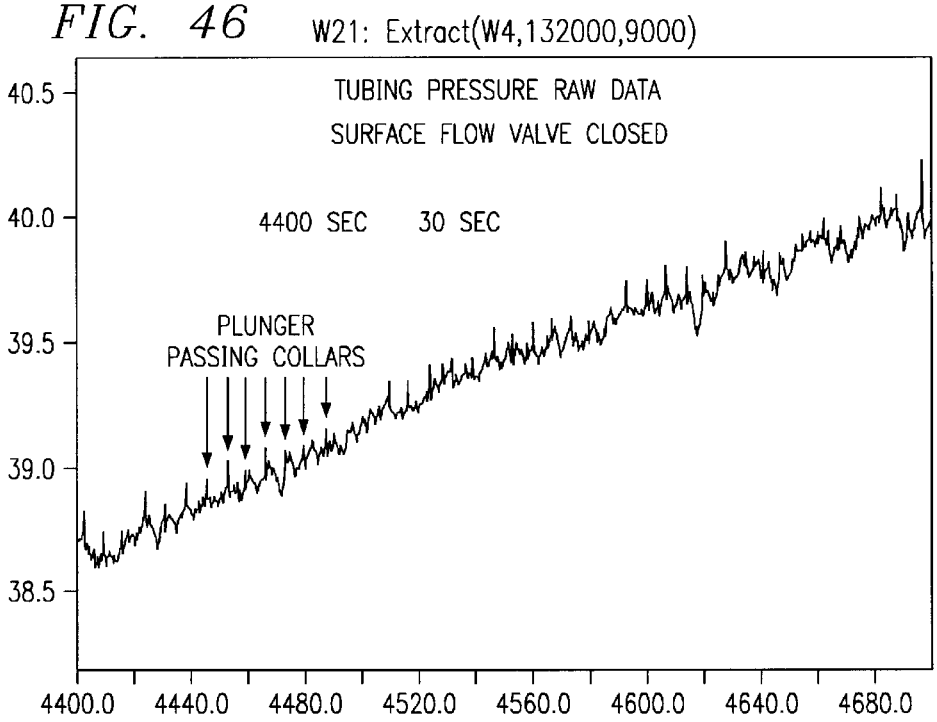
FIG. 46 is a graph of pressure waveform representing the pressure monitored within the tubing as a plunger descends through the tubing and passes collar recesses.

In FIG. 46 there is shown tubing pressure in a raw data form when the surface flow valve 122 is closed. It is during this time that the plunger 106 is dropping downward through the tubing 104. As the plunger 106 passes collar recesses, a pressure variation is generated which is received at the surface by operation of the transducer 134. Representative pressure variation pulses are indicated by the downward facing arrows in FIG. 46.

Figure 47:
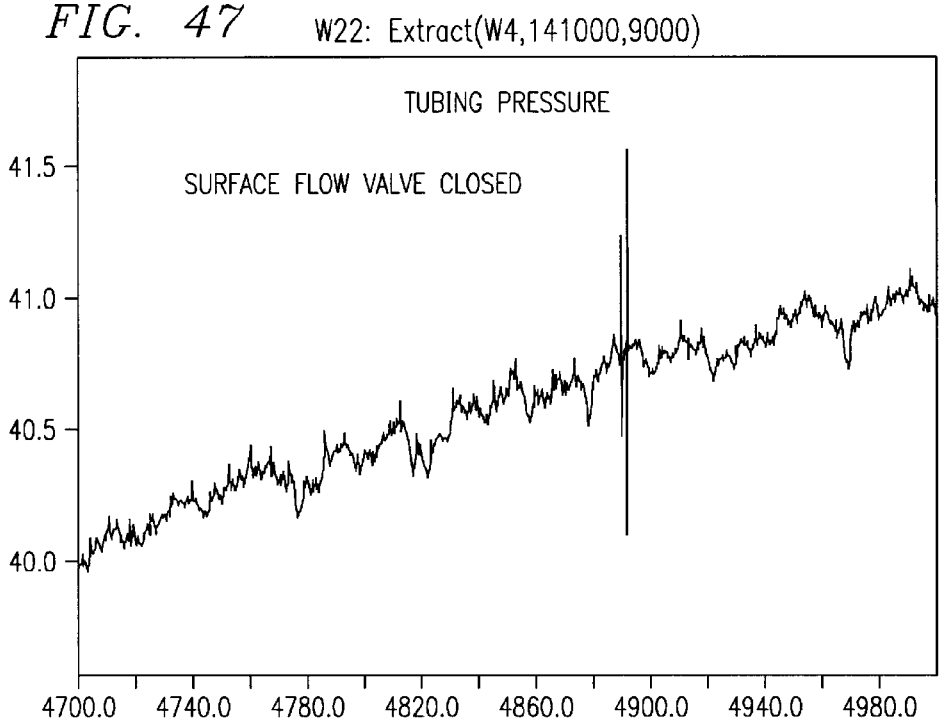
FIG. 47 is a graph of tubing pressure as a function of time with the surface flow valve closed for the plunger descending through the tubing.

In FIG. 47 there is shown tubing pressure when the surface valve is closed. It is during this time that the plunger 106 is descending in a tubing 104. Note that there is a steady, although somewhat erratic increase in tubing pressure during this time period.

Figure 48:
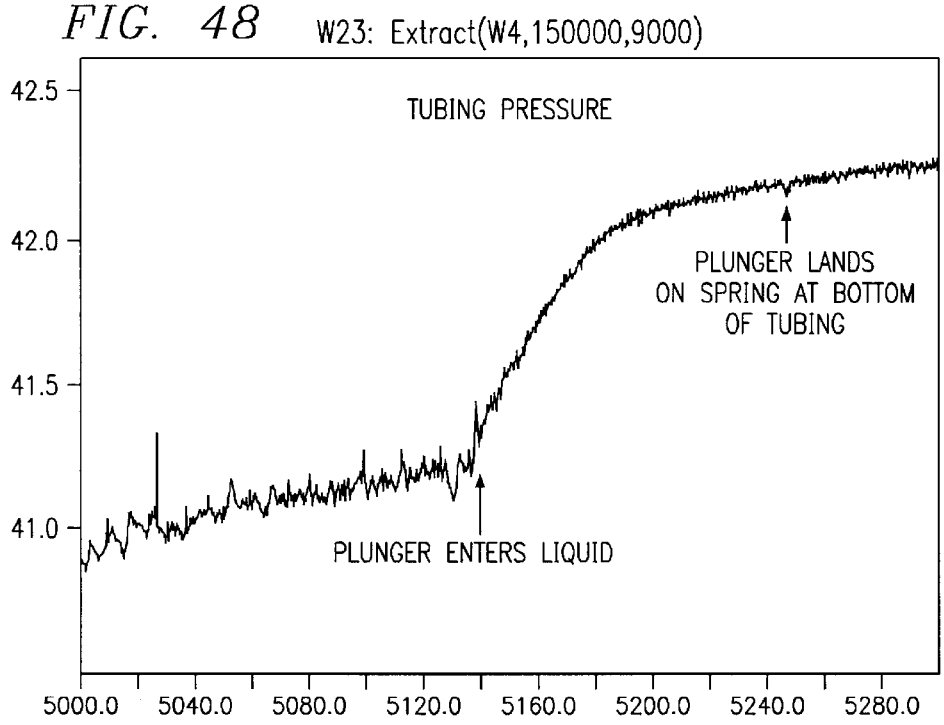
FIG. 48 is a graph of tubing pressure as a function of time illustrating the change in tubing pressure when the plunger descends through the tubing and enters into the liquid and finally rest on the lower spring at the bottom of the tubing.

Referring to FIG. 48, there is shown tubing pressure measured as a function of time when the plunger has reached the bottom of the tubing 104. Note the point when the plunger enters the liquid. At this point the tubing pressure increases over a short period of time by at least a measurable magnitude. A point is noted in the waveform when the plunger apparently lands on the spring at the bottom of the tubing. The tubing pressure increases apparently due to the entering of the plunger into the fluid wherein there is less differential pressure across the plunger and this loss of pressure differential results in an increase of tubing pressure which is measured at the surface.

Figure 49:
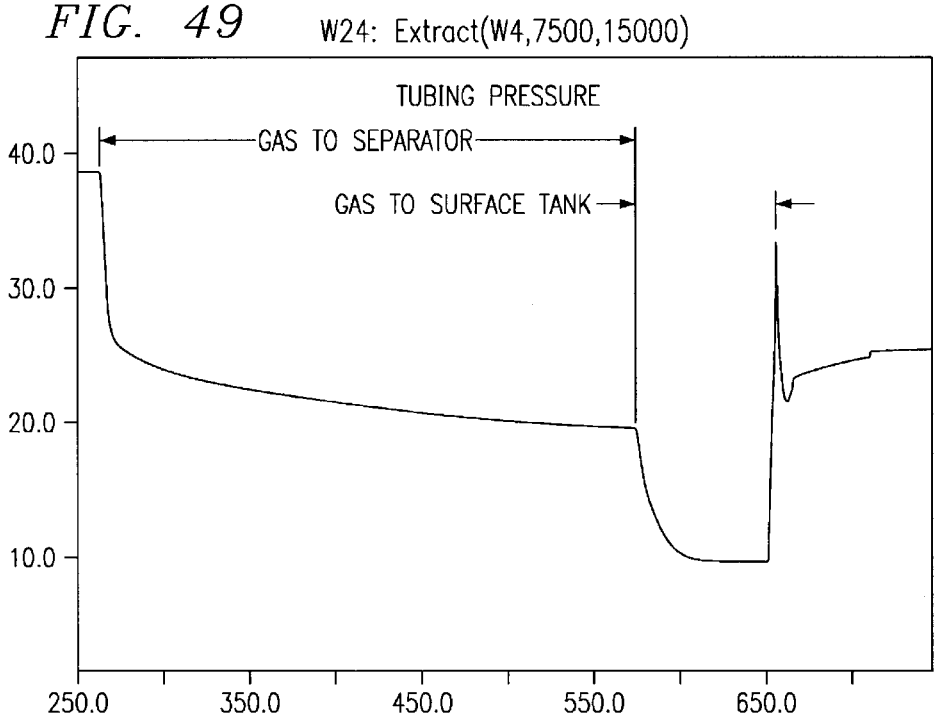
FIG. 49 is a graph of tubing pressure as a function of time with respect to gas flow.

Referring to FIG. 49, there is shown a graph of tubing pressure over a given time period wherein gas from the tubing goes to a separator and over a different time gas from the tubing goes to a surface tank.

Figure 50:
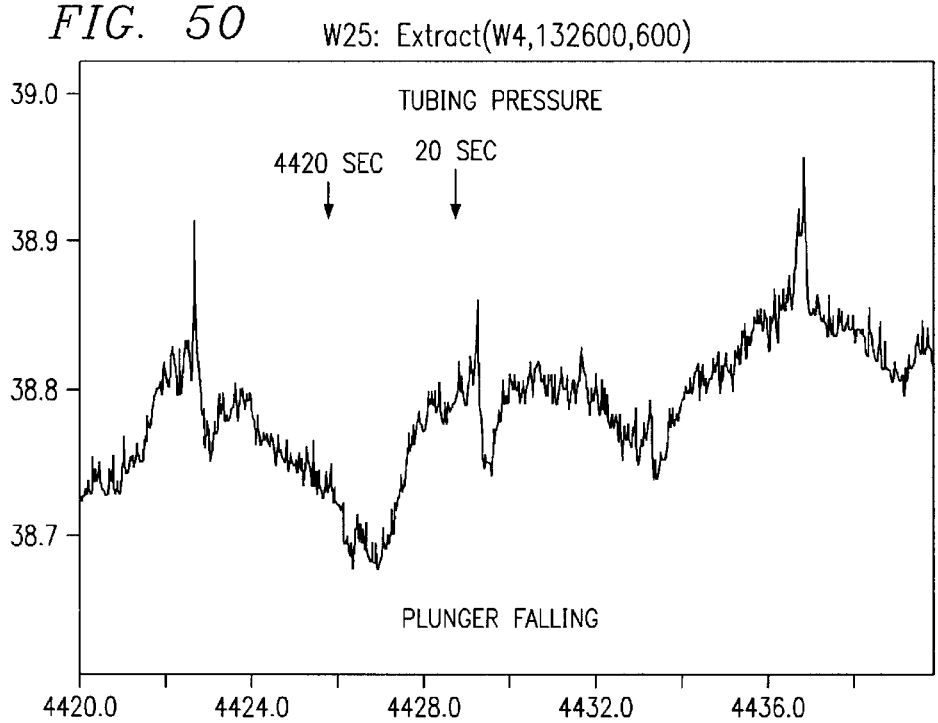
FIG. 50 is a graph of tubing pressure as a function of time for a plunger falling through the tubing string.

Referring to FIG. 50, there is shown a graph of tubing pressure while the plunger falls through the tubing 104. Note that there are spikes showing increases of pressure at an average of approximately 5–7 seconds, which corresponds to the time of travel between collar recesses for the plunger 106.

Figure 51:
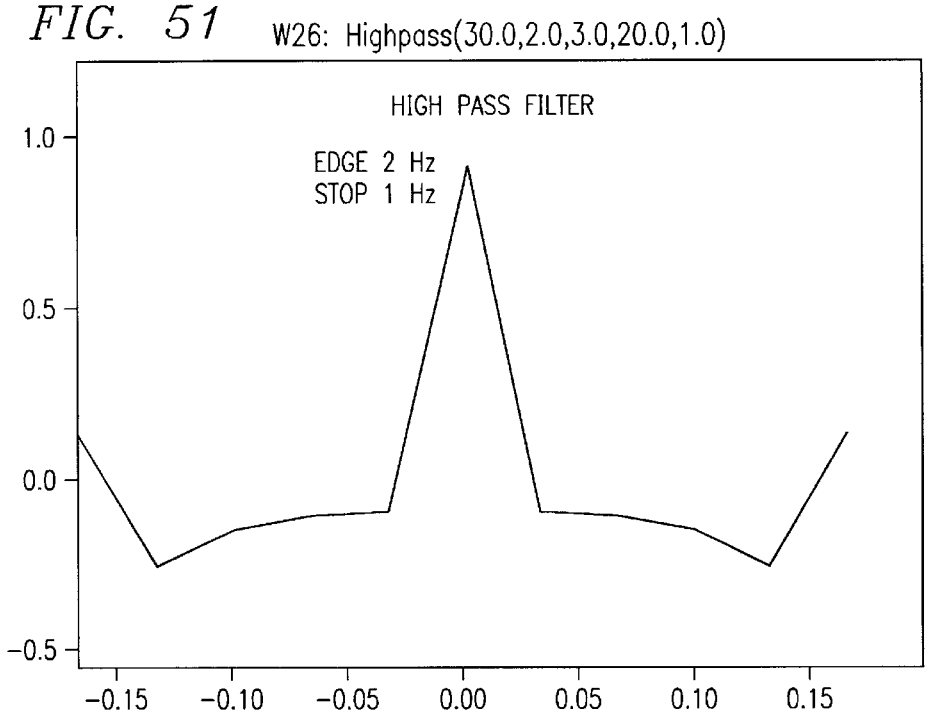
FIG. 51 is a graph of a high pass filter for filtering of an acoustic and pressure waveform.
Figure 52:
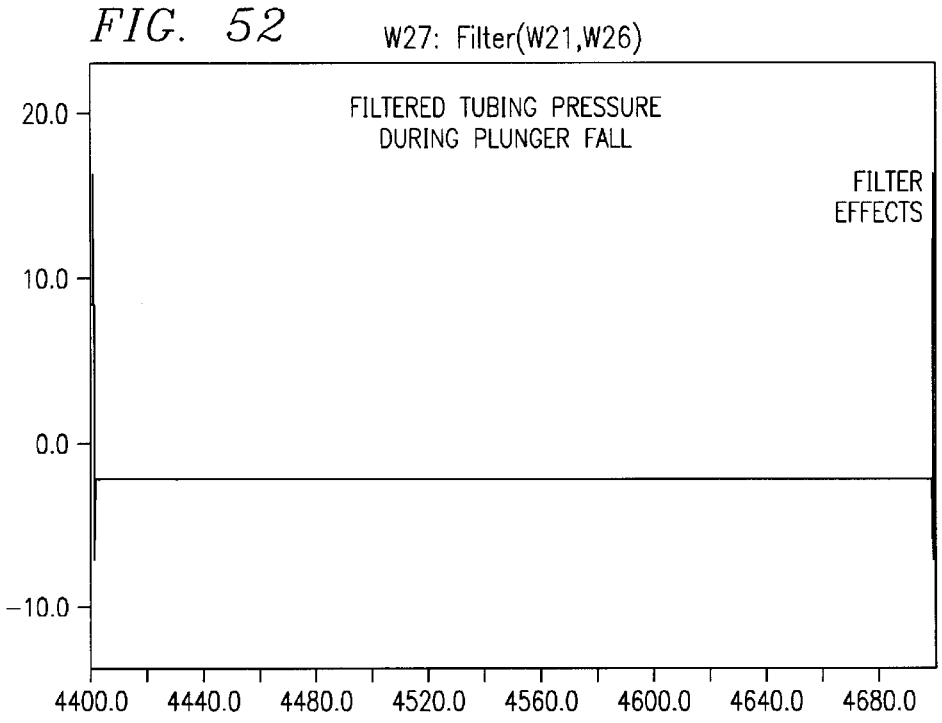
FIG. 52 is a graph of tubing pressure which has been filtered and represents the pressure during the plunger fall through the tubing.

FIG. 51 is a graph of a high pass filter. FIG. 52 is an illustration of tubing pressure in a waveform which has been filtered by use of the filter shown in FIG. 51 for the time period during which the plunger 106 is falling through the tubing 104.

Figure 53:
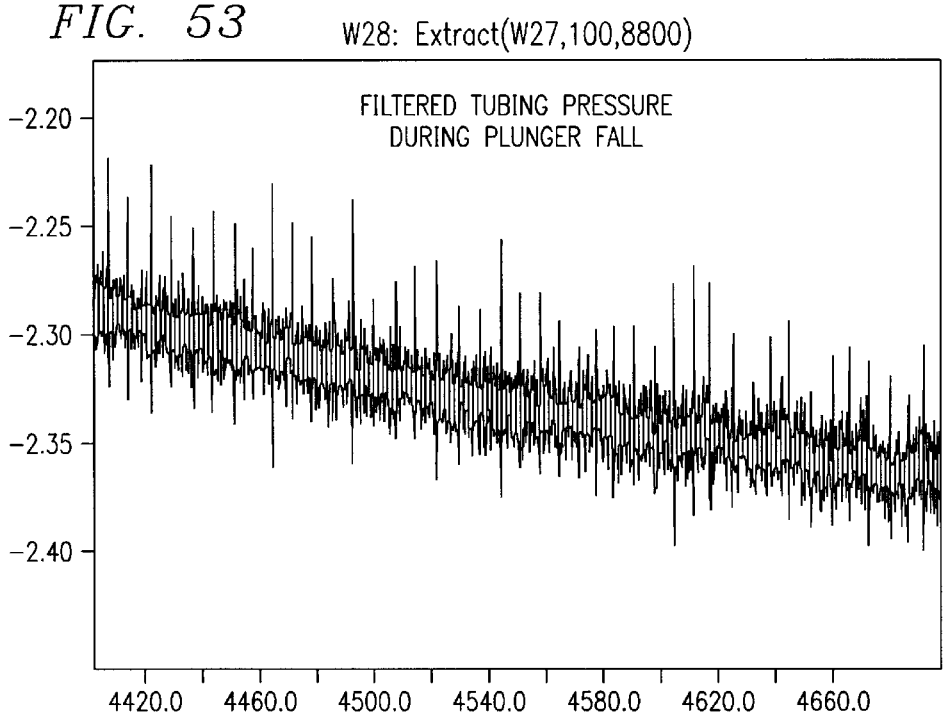
FIG. 53 is a graph of tubing pressure as a function of time with the tubing pressure signal being filtered in the time during the plunger fall through the tubing.
Figure 54:
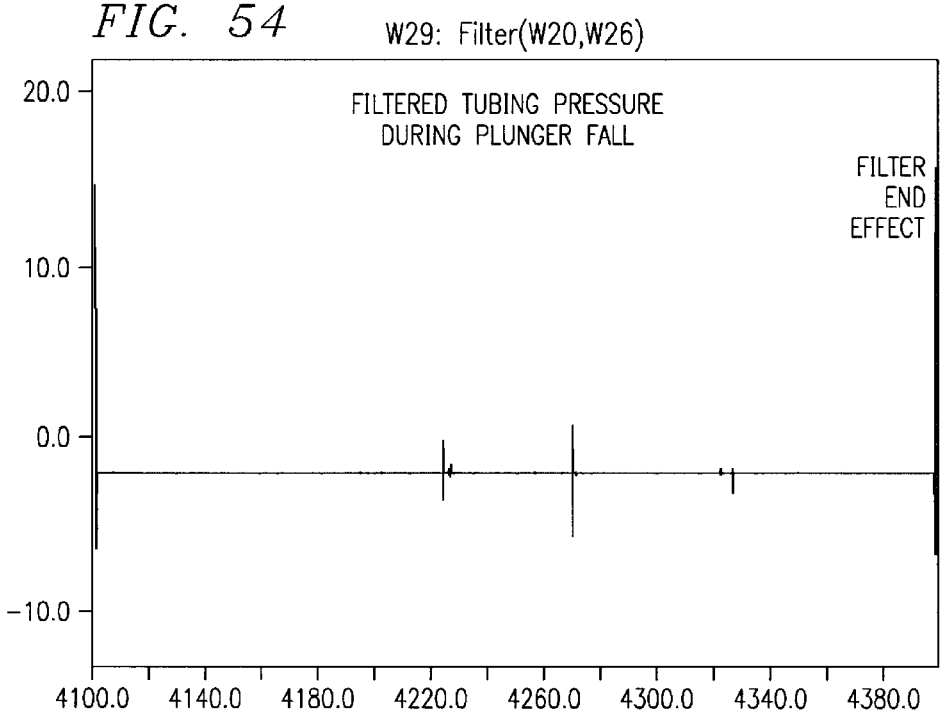
FIG. 54 is a graph of tubing pressure as a function of time with a filter and showing the pressure during the plunger fall through the tubing.

FIG. 53 is a further plot of tubing pressure data which has been filtered but which represents a different period of time from that shown in FIG. 52. Note that there are spikes in tubing pressure and these correspond to the passage of the plunger 108 past recesses in the collars of tubing 104. FIG. 54 is a further filtered tubing pressure graph for a further time segment of the plunger fall.

Figure 55:
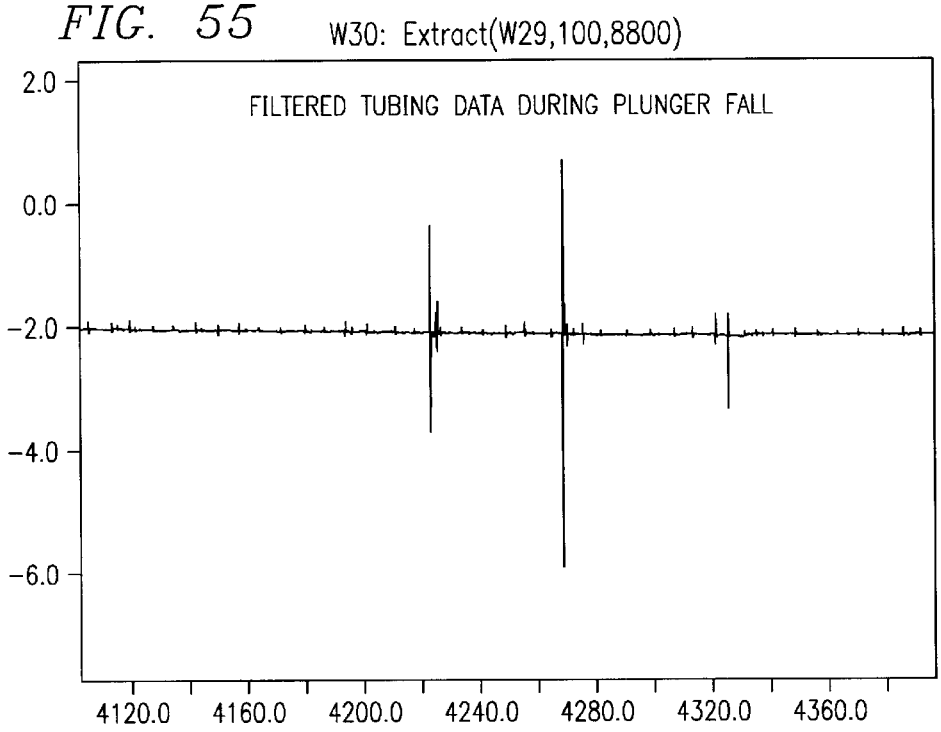
FIG. 55 is a graph of tubing pressure as a function of time during plunger fall with filtered data.

FIG. 55 is a further illustration of filtered tubing data during the plunger fall with particular spikes in pressure change representing pressure changes produced when the plunger 106 passes collar recesses in the tubing 104.

Figure 56:
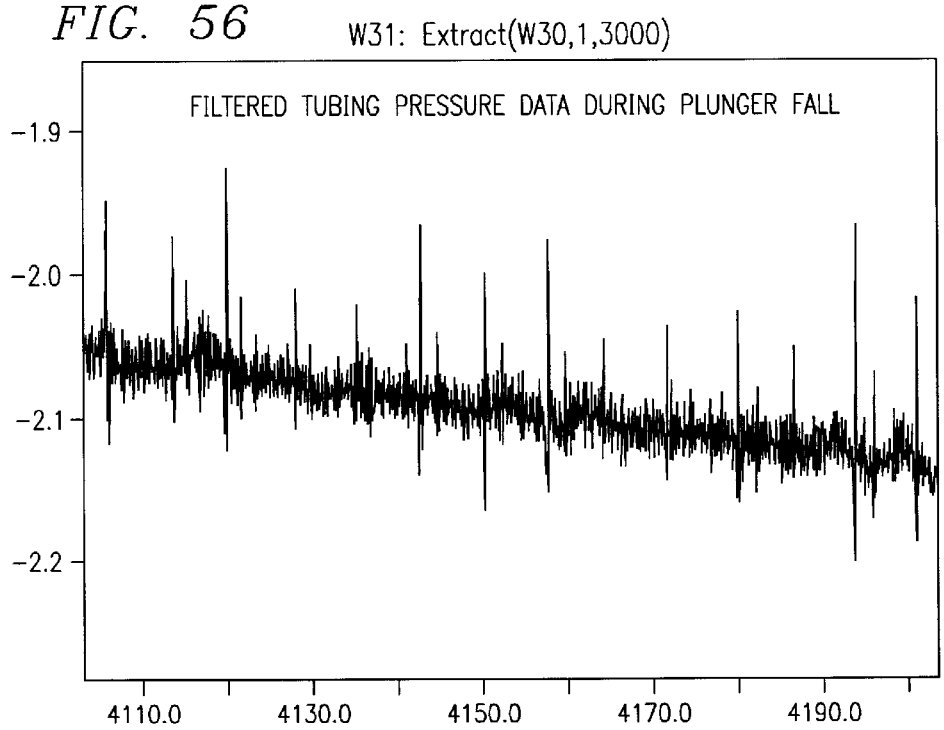
FIG. 56 is a graph of tubing pressure as a function of time with a filter applied to the pressure data illustrating the pressure during plunger fall through the tubing.

FIG. 56 is a further graph of tubing pressure data which has been filtered and represents the signal produced from the tubing pressure transducer 134 during a given time interval of the plunger fall through the tubing 104. Note that in this graph the spikes of tubing pressure are very distinct and can be counted and measured.

Figure 57:
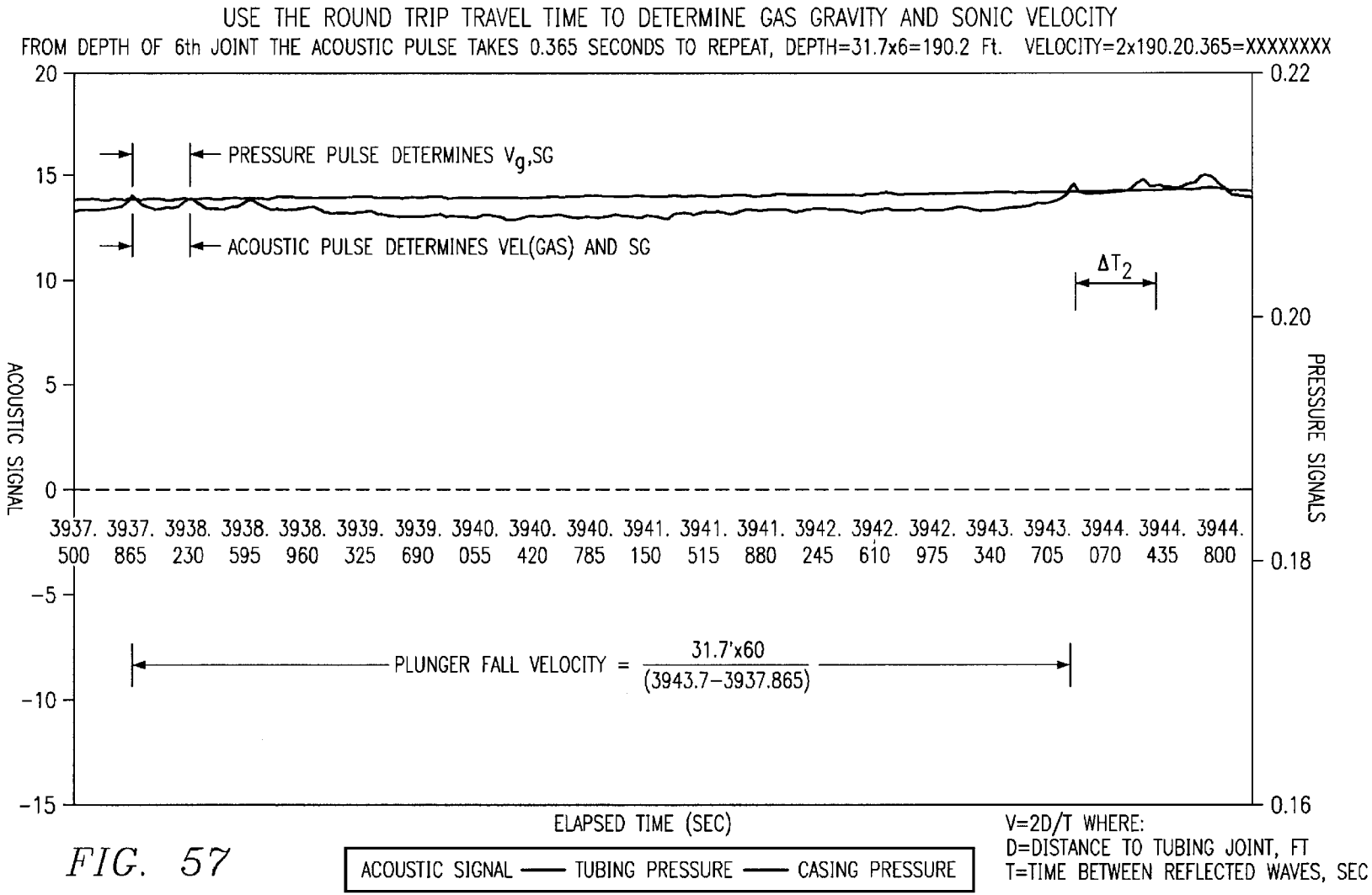
FIG. 57 is a graph of an acoustic signal monitored within tubing during the descent of a plunger in the tubing wherein the plunger generates sounds that are reflected between the plunger and the wellbore surface and can be used to measure travel time and therefore depth of the plunger in the wellbore.

Referring to FIG. 57, there is shown a further example of sound pulses received from plunger 106 as it passes downward through the tubing 104 and generates sound pulses that are transmitted to the surface, reflected and transmitted down to the plunger, again reflected and returned to the surface. In this example, a measurement is made between the first in a group of the pulses at the left-hand side of the page and a second in a group of the pulses at the right-hand side of the page. This represents the travel time of the plunger between collar recesses. In this case the time difference between the two points can be determined, and this divided into the joint length (31.7 feet) for determining the velocity of the plunger. The specific example shown produces a plunger speed of approximately 5.4 feet per second.

Figure 58:
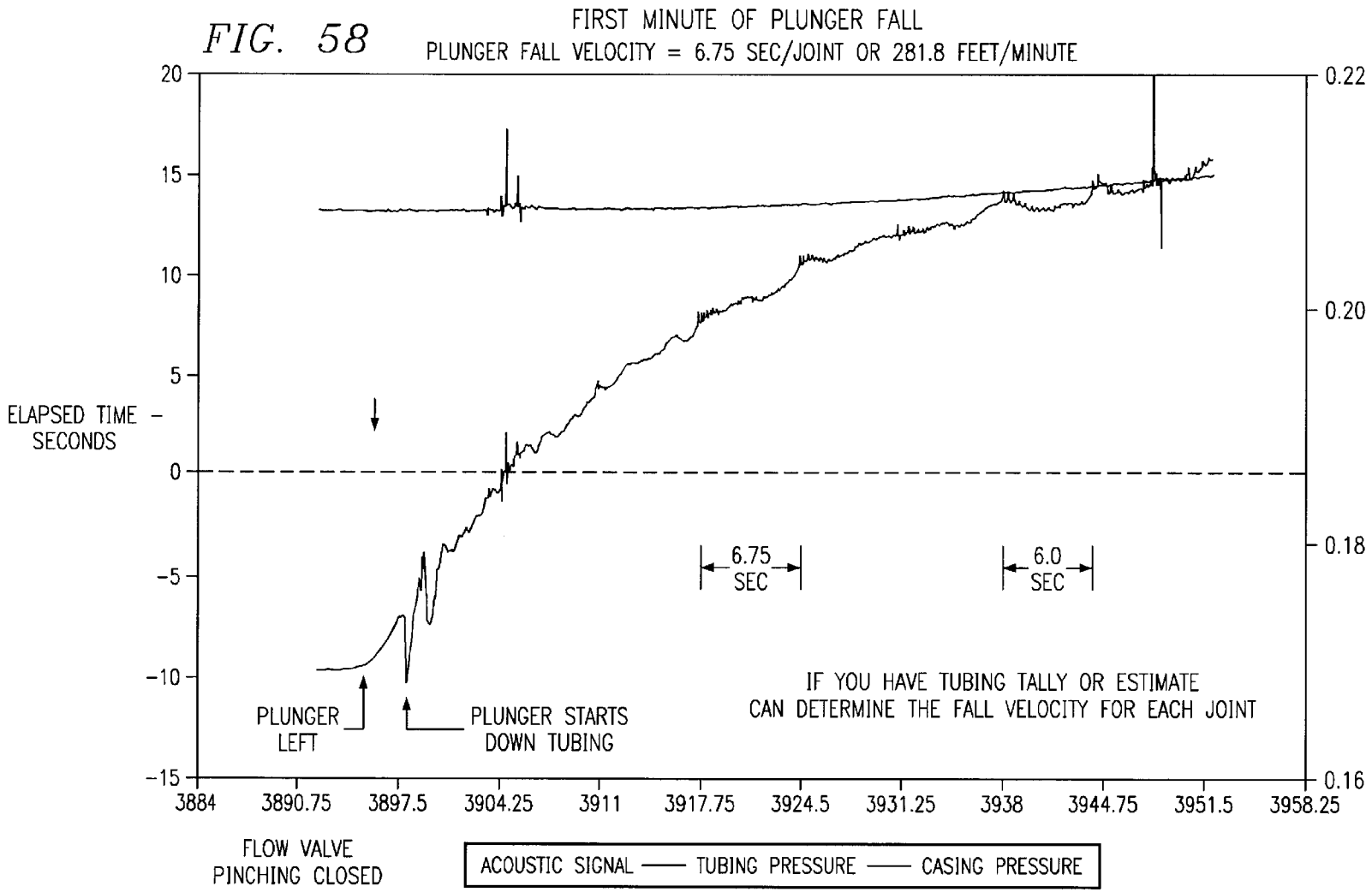
FIG. 58 is a further illustration of pressure measured within the tubing during the descent of a plunger down the tubing wherein the plunger generates a pressure pulse as it passes a collar recess, and the difference in time between pressure pulses is used to determine the plunger fall velocity.

Referring now to FIG. 58, there is shown an acoustic signal measured as a plunger descends in a well together with corresponding measurements of casing pressure and tubing pressure during the same time interval. The points in the waveform when the plunger starts down the tubing are marked. By measuring the differences between the groups of pulses, such as the measurement of 6.75 seconds at the center of the graph, and by knowing a tally of the actual tubing joints installed in the well, or an estimate of tubing joint lengths, the fall velocity can be determined for the plunger 106 for each joint in the tubing.

Figure 59:
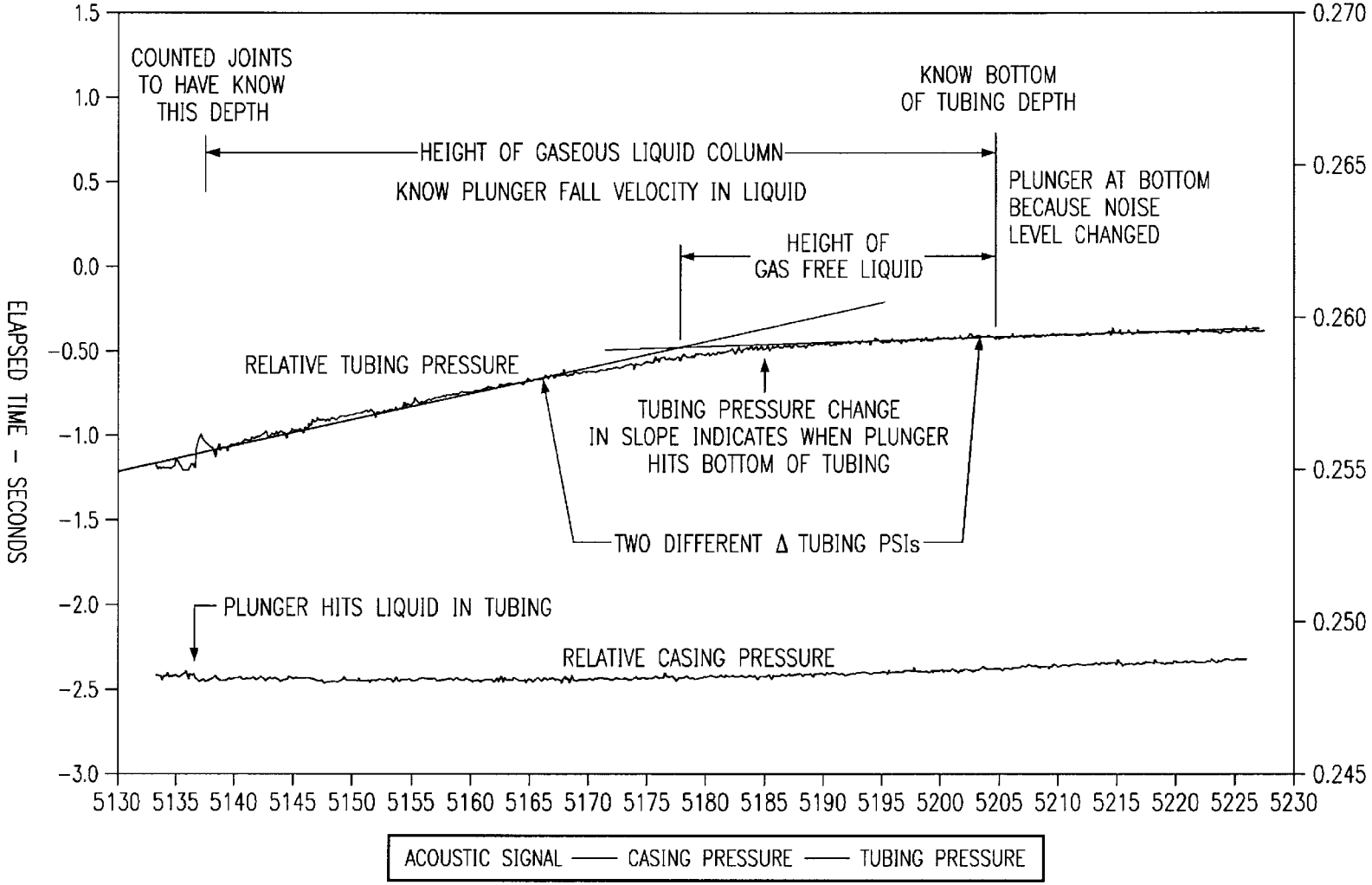
FIG. 59 is an illustration of a pressure waveform monitored within tubing illustrating that the change in rate of tubing pressure buildup indicates when the plunger hits bottom.

Referring to FIG. 59, there is shown an acoustic trace recorded during a plunger fall through liquid with relative casing pressure and relative tubing pressure. The impact of the plunger with the liquid is indicated at the left-hand side with the large amplitude signal at 5137 seconds. Note at the 5205 second point that the amplitude of the acoustic energy suddenly decreases, therefore indicating that the plunger has landed at the bottom of the liquid column on the spring 108. Note that the relative tubing pressure has a change in slope between the 5175 and 5180 time points. This is the point at which the plunger enters some gas. The point at which the plunger enters the liquid is further indicated by the sudden transient of the tubing pressure just after the 5135 second mark. The time between the 5175 and 5180 point and the marker at the 5205 point indicates the height of a gaseous liquid column in the well. The distance between the initial entry at the fluid just after 5135 point and the change in slope of the tubing pressure between the 5175 and 5180 points indicates a transition from the fluid to the gaseous column.

Figure 60:
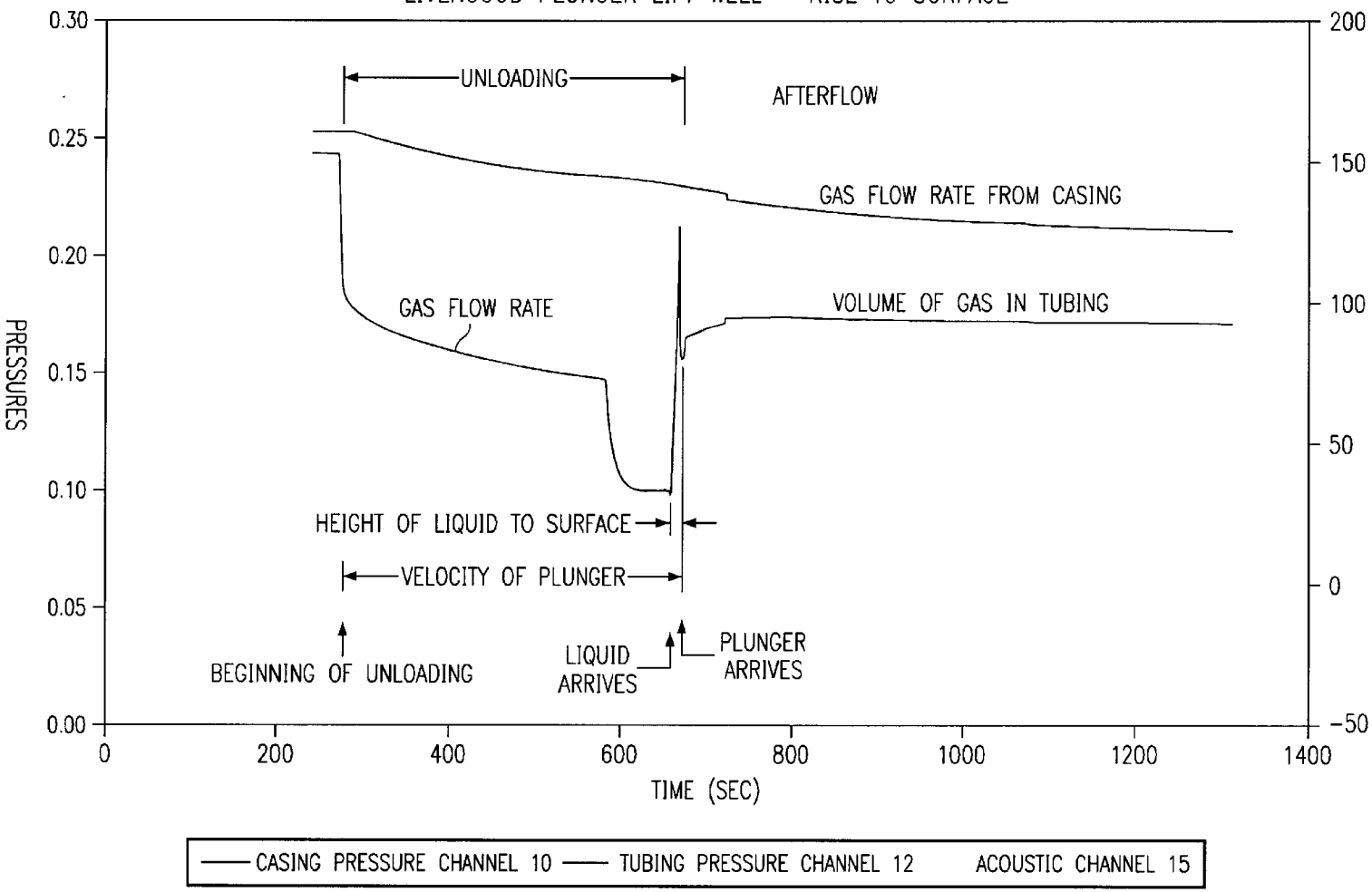
FIG. 60 is an illustration of pressure measured within tubing during the rise of a plunger in the tubing from which the rise velocity of the plunger can be calculated.

Referring to FIG. 60, there is shown tubing pressure, casing pressure and an acoustic signal representing the rise of the plunger 106 to the surface through the tubing 104. The left-hand point is the beginning of the unloading and the center spike in the acoustic waveform and the tubing pressure represents the arrival of liquid above the plunger to the surface of the borehole. The after flow follows this transition.

Figure 61:
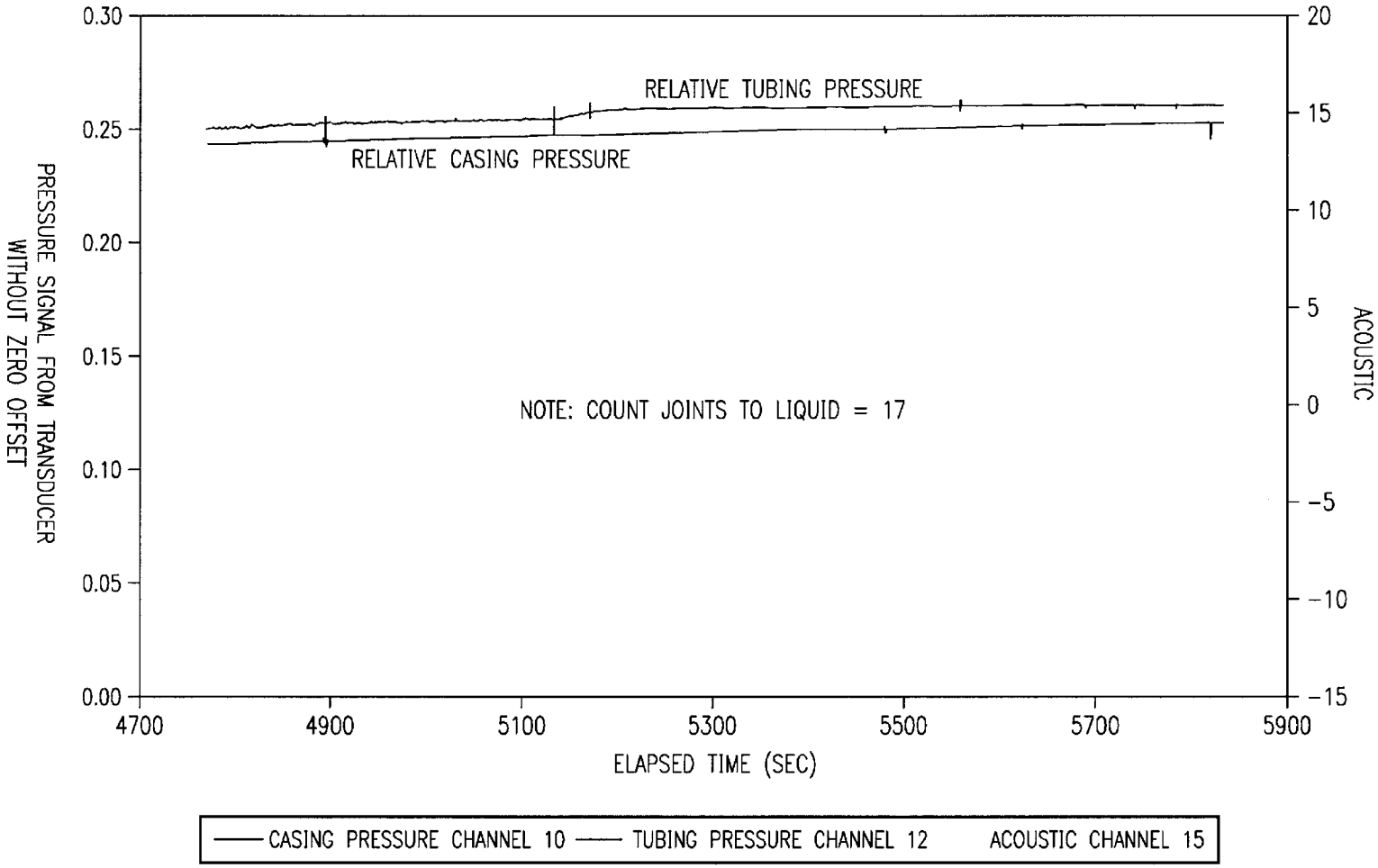
FIG. 61 is a plot relative to bring pressure and relative casing pressure which indicates that the plunger entered the liquid of approximately 5150 sec.

Referring to FIG. 61, there is shown tubing pressure, casing pressure and an acoustic waveform monitored in the tubing for the fall of the plunger. This clearly illustrates the ability to count the number of joints that were passed by the plunger 106 as it descended through the tubing 104. A count of 17 joints is shown.

Figure 62:
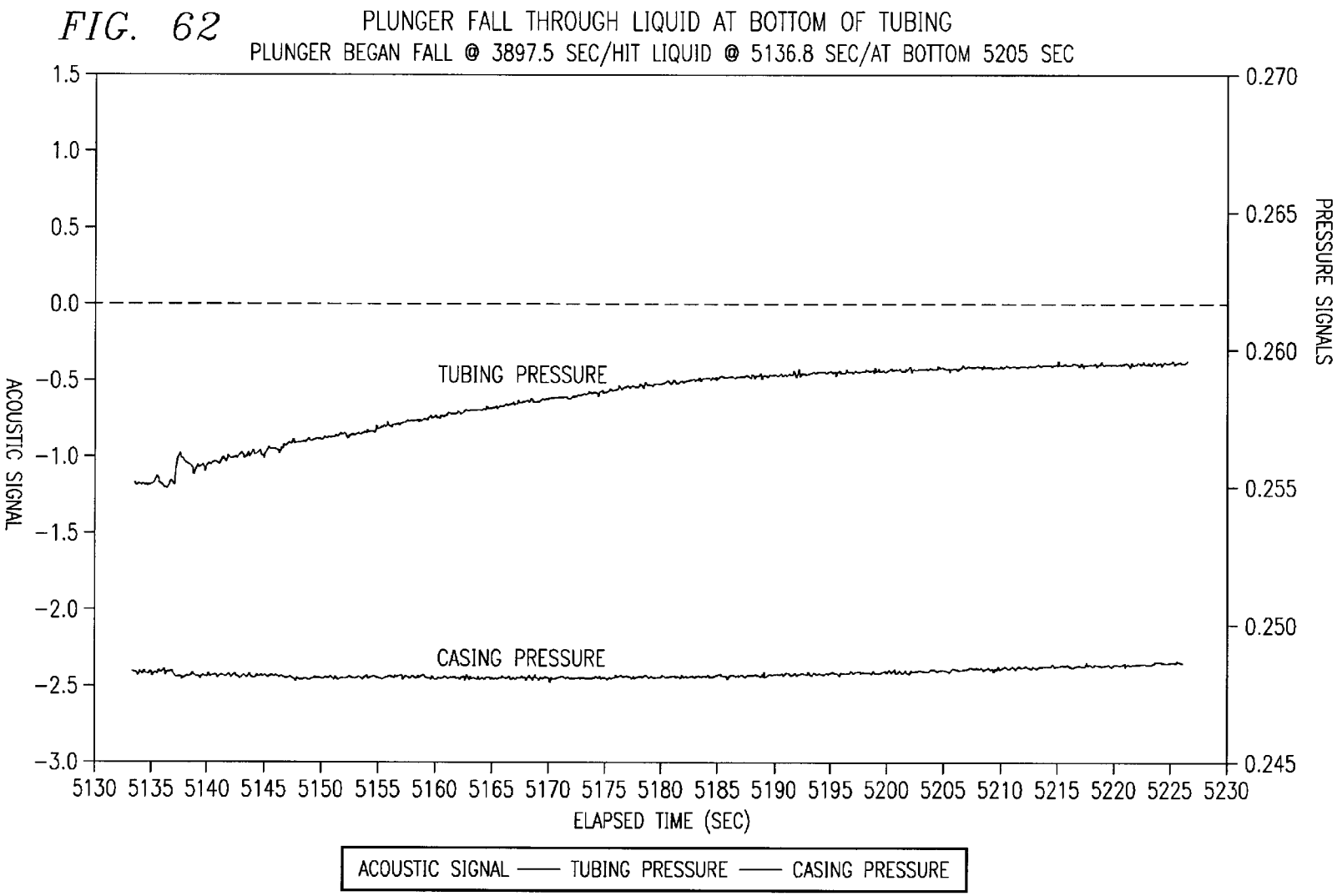
FIG. 62 is a plot of tubing pressure and casing pressure versus time with an indication that the plunger entered the liquid of 5136.8 sec and hit bottom at 5025 sec.

Referring to FIG. 62, there is shown an acoustic waveform together with tubing and casing pressure for a plunger that falls through the liquid at the bottom of the tubing. At the far left side is shown the entry into the liquid with the sudden transition of the tubing pressure and the generation of a loud noise event. The plunger hit the liquid at 5136.8 seconds and reached bottom at 5205 seconds. The velocity of plunger fall in liquid can be calculated from this data.

Figure 63:
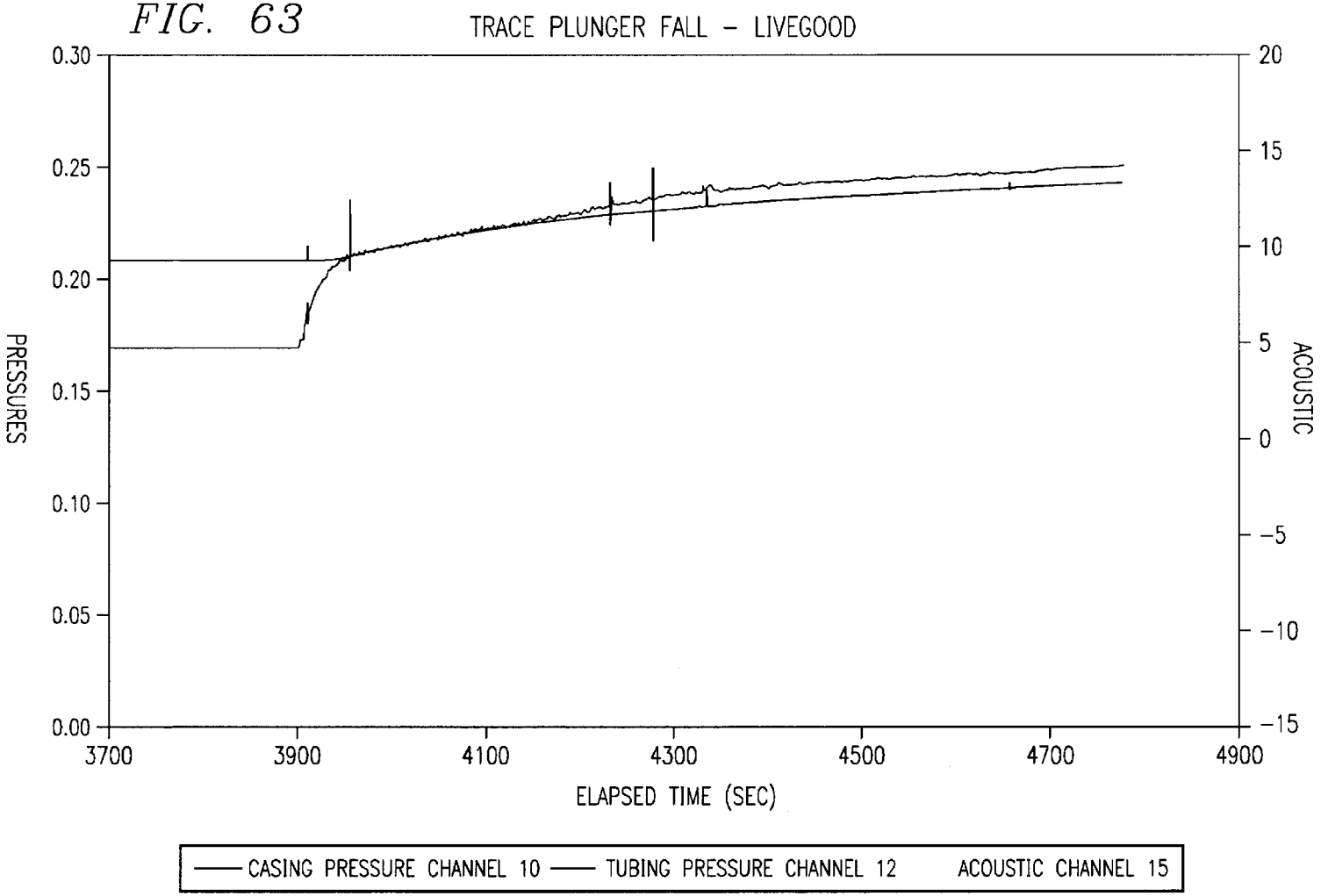
FIG. 63 is a combined graph of an acoustic waveform, casing pressure and tubing pressure as a function of time for a plunger fall through the tubing.

Referring to FIG. 63, there is shown an acoustic waveform together with casing and tubing pressure for a plunger fall with very clearly ascertainable acoustic noise events being recorded at the surface of the tubing 104 wherein each event represents the passage of the plunger past a collar recess. These can be counted to determine the depth of the plunger from the surface.

During plunger lift operations, knowledge of the location of the plunger is desired. Presently, after the plunger is released at the top of the well and the plunger is falling down the tubing, an acoustic test can be performed to determine the plunger depth. An acoustic test consists of generating an acoustic pulse at the top of the well. This acoustic pulse travels through the gas in the tubing and is reflected from the top of the plunger. A microphone receives these acoustic pulses. The distance to the plunger can be obtained by counting the number of tubing collar reflections from to the surface to the plunger or by calculating the distance from the surface to the plunger with knowledge of the round trip travel time and a calculated or measured acoustic velocity determined from gas properties. On a limited basis, this technique has been used to locate the plunger during plunger lift operations.

Plunger lift operations can be improved by using a computer well monitoring and analysis unit such as the Echometer Company Well Analyzer (Model E) (see analyzer 128 in FIG. 1) or similar instrument to monitor the casing pressure and the tubing pressure. Liquid normally does not occur in the casing annulus since the liquid is forced into the tubing by gas that has accumulated in the casing annulus. The gas liquid interface in the casing annulus is normally located at the tubing inlet. With knowledge of the surface pressure and gas properties, a producing bottomhole pressure can be calculated. This can be compared to the reservoir pressure instantaneously or over a period of time to monitor the flow rate efficiency of both gas and liquid from the formation. Monitoring can be performed on a continuous basis or during one cycle of operation in order to better understand the overall performance and the producing rate efficiency of the well. If the tubing pressure is acquired at a rate of 10 to 250 hertz, the location of the plunger can be monitored also. The pressure transducer 134 is monitored at a high rate so that the pressure transducer is used as a microphone and also as a pressure transducer. Thus, the actual tubing pressure is measured, and also small variations in tubing pressure are recorded.

When the surface valve is closed, the plunger 106 falls. The weight of the plunger causes the plunger to fall, but the plunger fall rate is restricted by the pressure below the plunger and by friction between the plunger and the tubing wall. A typical fall rate is 500 feet per minute. As the plunger passes a tubing collar recess, a disturbance or change in the plunger fall rate and the gas flow leakage rate will occur which will be indicated at the surface tubing pressure. Thus, monitoring the surface tubing pressure allows the operator to monitor the plunger movement and thus enable the operator to know the plunger location as well as the rate at which the plunger is falling. The plunger can be monitored until it hits the liquid. Normally, gas will be flowing upward in the liquid that is present in the tubing and will aerate the liquid column. Also, some gas may accumulate below the plunger as the plunger is falling through the aerated liquid column.

The operator desires to know if the plunger falls to the bottom of the tubing. After a predetermined time, the surface flow valve is opened which reduces the pressure above the liquid column and causes the pressure below the plunger to lift the plunger and the liquid above the plunger to the surface. By knowing when the surface flow valve is opened and when the plunger hits the surface, the movement and velocity of the plunger when the plunger is traveling upwards can be determined. When the plunger hits the top of the well, the pressure in the casing will be almost equal to the pressure in the tubing if all of the liquid in the tubing is removed and if the gas flow friction is low. By calculation of the gas flow rate friction and measurement of the casing pressure and tubing pressure, the amount of liquid and backpressure remaining in the tubing can be calculated reasonably accurately. Thus it can be estimated as to whether the plunger traveled completely to the bottom or not and other factors of operation.

This process can be monitored using the portable Well Analyzer or other electronic device to measure the casing pressure and tubing pressure. A software program can be run to monitor and analyze the performance of the plunger lift operation. This can tell the operator the location of the plunger (at least while above the liquid level in the tubing), the efficiency of the lift system, the producing rate efficiency of the gas from the formation and the producing bottomhole pressure. Desired changes in cycle times, equipment and other factors can be determined to optimize production rates. Plots of plunger depth versus time and producing bottomhole pressure versus time aid in analyzing the plunger lift system. Schematic displays of the well showing the casing, tubing, plunger, downhole pressures, surface pressures and the liquid levels, at periodic intervals (one minute), can be shown that are extremely useful in helping the operator to understand the behavior of the system and can help the operator to improve gas and liquid production, cycle times and other factors affecting the operation of the system.

An automated electronic system, including tubing pressure and/or casing pressure measurement, can be permanently installed at the well to monitor and display this data and analysis and possibly control the opening and closing of the surface flow valve. This data can be downloaded to a computer if desired.

The process of the present invention monitors signals and parameters and this monitoring can be performed by sensors such as shown in FIG. 1 connected to an electronic well analyzer 128. The operations of collecting the data and digitizing the signal followed by performing operations such as counting the sounds returned from the plunger as it descends through the tubing are performed by software within the well analyzer 128. This software further performs the functions such as counting the sounds and multiplying by the joint length to determine the depth of the plunger in the tubing. This can then be displayed to the operator on the screen of the analyzer. Further, the software can perform the function of determining the receipt of acoustic sounds and tubing pressure variations created when the plunger passes recesses in the tubing. When a predetermined time has passed without receiving these responses, the software can determine that the plunger has reached the fluid and display a response indicating such to the operator, such as a specific display on the screen. Each of the indicators described herein can be displayed on the screen of the well analyzer 128, or any other computer system, or can be produced by other indicators such as lights or sounds. These indicators can also be electronic signals which are connected to a controller for a plunger lift system and used by that controller to operate valves in the plunger lift system.

The animation described in respect to FIGS. 6 and 7 can be generated by the well analyzer 128 by operation of software therein. The animation shows multiple positions of the plunger, together with any liquid slug, within the wellbore such that the operator can visually see the location of the plunger within the well schematic, which is displayed on the screen of the well analyzer 128. This animation is controlled by the measurements and calculations described above for determining the location of the plunger in the tubing. The parameters displayed in conjunction with the display of the well bore schematic can be updated as these parameters are measured in real time by the sensors connected to the well analyzer 128.

Although several embodiments of the invention have been illustrated in the accompanying drawings and described in the foregoing Detailed Description, it will be understood that the invention is not limited to the embodiments disclosed, but is capable of numerous rearrangements, modifications and substitutions without departing from the scope of the invention.

What is claimed is:

1. A method for determining a depth of a plunger positioned within a tubing string which is located in a wellbore, comprising the steps of:

acoustically monitoring the interior of said tubing string to detect sounds produced by said plunger as said plunger passes tubing collar recesses of said tubing string, wherein each sound is associated with one of said tubing collar recesses, counting a plurality of said sounds produced by said plunger to produce a count number, and determining the depth of said plunger in said tubing string as a function of said count number and a length of tubing joints in said tubing string.

2. The method recited in claim 1 including the step of providing said depth to a plunger lift controller for optimizing production from said wellbore.

3. The method recited in claim 1 including the step of providing said depth to a plunger lift controller for determining a time of operation of a flow control valve connected to regulate flow from said tubing string.

4. A method for determining a position of a plunger, which is positioned in a tubing string that is located in a wellbore, with respect to fluid in the wellbore, comprising the steps of:

acoustically monitoring the interior of said tubing string, as said plunger descends through said tubing string, to produce a monitored signal, determining an acoustic amplitude of said monitored signal, comparing a present value of said acoustic amplitude with a previous amplitude to determine when the present value is less than said previous amplitude by a predetermined amount, and generating an indicator that said plunger has reached said fluid when it has been determined that said present value of said acoustic amplitude is less than said previous acoustic amplitude by said predetermined amount.

5. The method recited in claim 4 including the step of providing said indicator to a plunger lift controller for optimizing production from said wellbore.

6. The method recited in claim 4 including the step of providing said indicator to a plunger lift controller for determining a time of operation of a flow control valve connected to regulate flow from said tubing string.

7. A method for determining a position of a plunger, which is positioned in a tubing string that is located in a wellbore, with respect to fluid in the wellbore, comprising the steps of:

monitoring gas pressure in said tubing string at the surface of said wellbore as said plunger descends through said tubing string toward said fluid in said wellbore, detecting changes in said gas pressure, determining when said gas pressure has increased by a predetermined amount within a predetermined time, and generating an indicator that said plunger has reached said fluid when it has been determined that said gas pressure has increased by said predetermined amount within said predetermined time.

8. The method recited in claim 7 including the step of providing said indicator to a plunger lift controller for optimizing production from said wellbore.

9. The method recited in claim 7 including the step of providing said indicator to a plunger lift controller for determining a time of operation of a flow control valve connected to regulate flow from said tubing string.

10. A method for determining a depth from the surface of a wellbore for a plunger positioned in a tubing string which is located in the wellbore, comprising the steps of:

acoustically monitoring the interior of said tubing string at the wellbore surface to detect a sound produced by said plunger as it passes a tubing collar recess of said tubing string, wherein said sound travels from the plunger to the wellbore surface and is received in a first occurrence and the sound reflects from the upper end of the tubing string and travels back to the plunger, and the sound reflects from the plunger and travels to the wellbore surface and is received in a second occurrence, measuring a time difference between the receipt of the sound in the first occurrence and the second occurrence, and determining a distance from the wellbore surface to the plunger as a function of said time difference and acoustic velocity of said sound in said wellbore.

11. The method recited in claim 10 including the step of providing said distance to a plunger lift controller for optimizing production from said wellbore.

12. The method recited in claim 10 including the step of providing said distance to a plunger lift controller for determining a time of operation of a flow control valve connected to regulate flow from said tubing string.

13. A method for determining a depth of a plunger in a tubing string which is located in a wellbore, comprising the steps of:

monitoring the gas pressure in said tubing string to produce a pressure signal as said plunger descends downward from an upper end of said tubing string, wherein said plunger causes a variation in said gas pressure within said tubing string as said plunger passes each of a plurality of tubing collar recesses in said tubing string, counting said variations in tubing gas pressure produced by said plunger in said pressure signal to produce a count number, and determining the depth of said plunger in said tubing string as a function of said count number of said variations in tubing gas pressure and the length of tubing joints in said tubing string.

14. The method recited in claim 13 including the step of providing said depth to a plunger lift controller for optimizing production from said wellbore.

15. The method recited in claim 13 including the step of providing said depth to a plunger lift controller for determining time of operation of a flow control valve connected to regulate flow from said tubing string.

16. A method for determining a depth of a plunger in a tubing string which is located in a wellbore, comprising the steps of:

sampling the gas pressure in said tubing string to collect a plurality of data samples comprising a pressure signal as said plunger descends downward from an upper end of said tubing string, wherein said plunger causes a variation in said gas pressure within said tubing string as said plunger passes each of a plurality of tubing collar recesses in said tubing string, sampling said gas pressure at a rate such that the plurality of said data samples is collected in said pressure signal for each pass of said plunger past one of said collar recesses, counting said variations in gas pressure in said pressure signal to produce a count number, and determining the depth of said plunger in said tubing string as a function of said count number of said variations in gas pressure and a length of tubing joints in said tubing string.

17. The method recited in claim 16 including the step of providing said depth to a plunger lift controller for optimizing production from said wellbore.

18. The method recited in claim 16 including the step of providing said determined depth to a plunger lift controller for determining a time of operation of a flow control valve connected to regulate flow from said tubing string.

19. A method for determining a depth of a plunger in a tubing string which is located in a wellbore, comprising the steps of:

sampling the gas pressure in said tubing string to collect a plurality of data samples comprising a pressure signal as said plunger descends downward from an upper end of said tubing string, wherein said plunger causes a variation in said gas pressure within said tubing string as said plunger passes each of a plurality of tubing collar recesses in said tubing string, sampling said gas pressure at a rate sufficiently fast to capture in said pressure signal a plurality of said data samples for each of said variations in said gas pressure produced as said plunger passes said tubing collar recesses in said tubing string, counting said variations in tubing gas pressure in said pressure signal to produce a count number, and determining the depth of said plunger in said tubing string as a function of said count number of said variations in said gas pressure and a length of tubing joints in said tubing string.

20. The method recited in claim 19 including the step of providing said depth to a plunger lift controller for optimizing production from said wellbore.

21. The method recited in claim 19 including the step of providing said depth to a plunger lift controller for determining a time of operation of a flow control valve connected to regulate flow from said tubing string.

22. A method for determining when a plunger in a tubing string, which is located in a borehole, reaches fluid at a lower end of the tubing string, comprising the steps of:

acoustically monitoring the interior of said tubing string to detect a sound produced by said plunger as it passes each of a plurality of tubing collar recesses in said tubing string, determining when a predetermined period of time has passed without receiving one of said sounds produced by said plunger as it passes said collar recesses, and generating an indication that said plunger has reached said fluid when said predetermined period of time has passed without receiving one of said sounds produced by said plunger as it passes said collar recesses.

23. The method recited in claim 22 including the step of providing said indication to a plunger lift controller for optimizing production from said wellbore.

24. The method recited in claim 22 including the step of providing said indication to a plunger lift controller for determining a time of operation of a flow control valve connected to regulate flow from said tubing string.

25. A method for determining when a plunger in a tubing string, which is located in a borehole, reaches fluid at the lower end of the tubing string, comprising the steps of:

monitoring gas pressure in the interior of said tubing string to produce a pressure signal as said plunger descends downward from an upper end of said tubing string, wherein said plunger causes a variation in said gas pressure within said tubing string as said plunger passes each of a plurality of tubing collar recesses in said tubing string, determining when a predetermined period of time has passed without receiving one of said pressure variations produced by said plunger as it passes said collar recesses, and generating an indication that said plunger has reached said fluid when said predetermined period of time has passed without receiving one of said pressure variations produced by said plunger as it passes said collar recesses.

26. The method recited in claim 25 including the step of providing said indication to a plunger lift controller for optimizing production from said wellbore.

27. The method recited in claim 25 including the step of providing said indication to a plunger lift controller for determining a time of operation of a flow control valve connected to regulate flow from said tubing string.

28. A method for producing a display for indicating performance of a plunger lift system for a wellbore which has a tubing string installed therein, and a plunger is located in the tubing string, comprising the steps of:

producing on a display screen a schematic of said wellbore and including a representation of said plunger in said tubing string, monitoring gas pressure in said tubing string to produce a pressure signal which includes therein gas pressure variations caused by said plunger passing tubing collar recess in said tubing string, counting said tubing pressure variations in said pressure signal to produce a count number, determining depths of said plunger in said tubing string as a function of said count number and tubing joint length for tubing joints comprising said tubing string, and positioning said plunger representation in said wellbore schematic at a plurality of positions which are a function of said depths determined for said plunger in said tubing string.

29. A method for producing a display for indicating performance of a plunger lift system for a wellbore which has a tubing string installed therein, and a plunger is located in the tubing string, comprising the steps of:

producing on a display screen a schematic of said wellbore and including a representation of said plunger in said tubing string, acoustically monitoring the interior of said tubing string to detect sounds produced by said plunger as said plunger passes tubing collar recesses of said tubing string, wherein each said sound is associated with one of said tubing collar recesses, counting a plurality of said sounds produced by said plunger to produce a count number, determining depths of said plunger in said tubing string as a function of said number count and tubing joint length for tubing joints comprising said tubing string, and positioning said plunger representation in said wellbore schematic at a plurality of positions which are a function of said depths determined for said plunger in said tubing string.

30. A method for producing a display for indicating performance of a plunger lift system for a wellbore which has a tubing string installed therein, and a plunger is located in the tubing string, comprising the steps of:

producing on a display screen a schematic of said wellbore and including a representation of said plunger in said tubing string, monitoring gas pressure in said tubing string to produce a pressure signal which includes therein gas pressure variations caused by said plunger passing tubing collar recess in said tubing string, counting said gas pressure variations in said pressure signal to produce a count number, determining depths of said plunger in said tubing string as a function of said count number and tubing joint length for tubing joints comprising said tubing string, acoustically monitoring the interior of said tubing string to detect sounds produced by said plunger as said plunger passes tubing collar recesses of said tubing string, wherein each said sound is associated with one of said tubing collar recesses, counting a plurality of said sounds produced by said plunger to produce a count number, positioning said plunger representation in said wellbore schematic at a plurality of positions which are a function of said depths determined by pressure and acoustically for said plunger in said tubing string.

31. A method for evaluating a production performance of a wellbore which has a plunger lift system in which a plunger is located within a tubing string which is positioned in the wellbore, comprising the steps of:

monitoring casing pressure of said borehole, monitor tubing pressure within said tubing string to produce a tubing pressure signal, calculating one or more parameters relating to the production performance of said borehole, said parameters based on said monitored casing pressure and said monitored tubing pressure, and determining the depth of said plunger in said tubing string based on data in said tubing pressure signal.

* * * * *